US007513067B2

(12) United States Patent
Marvin et al.

(10) Patent No.: US 7,513,067 B2
(45) **Date of Patent: *Apr. 7, 2009**

(54) SHOE HAVING AN INFLATABLE BLADDER

(75) Inventors: William Marvin, Brighton, MA (US); Paul M. Davis, Blackstone, MA (US); Geoff Swales, Somerset, MA (US); Paul E. Litchfield, Westboro, MA (US); Brian J. Christensen, Centerville, MA (US); Mark Busse, Providence, RI (US); Todd Ellis, Boston, MA (US)

(73) Assignee: Reebok International Ltd., Canton, MA (US)

( * ) Notice: Subject to any disclaimer, the term of this patent is extended or adjusted under 35 U.S.C. 154(b) by 422 days.

This patent is subject to a terminal disclaimer.

(21) Appl. No.: 11/330,326

(22) Filed: Jan. 12, 2006

(65) Prior Publication Data

US 2006/0130370 A1 Jun. 22, 2006

Related U.S. Application Data

(63) Continuation of application No. 10/887,927, filed on Jul. 12, 2004, now Pat. No. 7,278,445, which is a continuation-in-part of application No. 10/610,644, filed on Jul. 2, 2003, now Pat. No. 7,047,670, which is a continuation-in-part of application No. 10/186,717, filed on Jul. 2, 2002, now Pat. No. 6,785,985.

(51) Int. Cl.
*A43C 11/00* (2006.01)
*A43B 13/20* (2006.01)

(52) U.S. Cl. ..... 36/50.1; 36/29; 36/88

(58) Field of Classification Search ..... 36/28, 36/29, 3 R, 3 B, 45, 43, 44, 93, 88, 71, 50.5, 36/50.1, 114

See application file for complete search history.

(56) References Cited

U.S. PATENT DOCUMENTS

| | | | |
|---|---|---|---|
| 82,944 | A | 10/1868 | Haskins |
| 167,732 | A | 10/1875 | Blanchard |
| 180,819 | A | 8/1876 | Ames |
| 212,898 | A | 3/1879 | Class |
| 508,034 | A | 11/1893 | Moore |
| 510,504 | A | 12/1893 | Foster |

(Continued)

FOREIGN PATENT DOCUMENTS

| | | |
|---|---|---|
| BR | 8305004 | 9/1983 |

(Continued)

OTHER PUBLICATIONS

Zonic Product Description, date unknown.

(Continued)

*Primary Examiner*—Marie Patterson
(74) *Attorney, Agent, or Firm*—Sterne, Kessler, Goldstein & Fox P.L.L.C.

(57) ABSTRACT

An article of footwear including a sole and an upper with an exterior and interior surface, and one or more bladders which comprises at least one of the exterior or interior surfaces of the upper. The article of footwear also includes a inflation mechanism located under the foot of the wearer to be activated by the normal action of the wearer to inflate the one or more bladders. The inflation mechanism may be monolithic with the bladder or may be a satellite inflation mechanism coupled to the bladder. The article of footwear may also include a deflation mechanism. The deflation mechanism may include a release valve capable of remaining in a open position and/or an adjustable check valve. The deflation mechanism may also be a combination check valve and release valve accessing a single opening in the bladder.

19 Claims, 51 Drawing Sheets

U.S. PATENT DOCUMENTS

| | | | |
|---|---|---|---|
| 536,345 | A | 3/1895 | Harris |
| 545,705 | A | 9/1895 | MacDonald |
| 547,645 | A | 10/1895 | LaCroix |
| 566,422 | A | 8/1896 | Singleton |
| 580,501 | A | 4/1897 | Mobberley |
| 586,155 | A | 7/1897 | Bascom |
| 634,588 | A | 10/1899 | Roche |
| D032,093 | S | 1/1900 | Childs |
| 692,170 | A | 1/1902 | Wallerstein et al. |
| 710,674 | A | 10/1902 | Fassmann |
| 850,327 | A | 4/1907 | Tauber |
| 900,867 | A | 10/1908 | Miller |
| 918,391 | A | 4/1909 | Taarud |
| 950,333 | A | 2/1910 | Koch |
| 1,034,915 | A | 8/1912 | Kaiser |
| 1,053,204 | A | 2/1913 | Morrison |
| 1,059,485 | A | 4/1913 | Orlopp |
| 1,069,001 | A | 7/1913 | Guy |
| 1,071,271 | A | 8/1913 | Spangler |
| 1,145,534 | A | 7/1915 | Wetmore |
| 1,148,376 | A | 7/1915 | Gay |
| 1,193,608 | A | 8/1916 | Poulson |
| 1,198,476 | A | 9/1916 | Pearson |
| 1,216,795 | A | 2/1917 | Gause |
| 1,235,645 | A | 8/1917 | Blatz et al. |
| 1,241,832 | A | 10/1917 | Drunkenmiller |
| 1,257,086 | A | 2/1918 | Marcellus |
| 1,285,695 | A | 11/1918 | Harman |
| 1,304,915 | A | 5/1919 | Spinney |
| 1,322,338 | A | 11/1919 | Pitts |
| 1,328,154 | A | 1/1920 | Jackerson |
| D055,436 | S | 6/1920 | Seiders |
| 1,369,555 | A | 2/1921 | Schweinert et al. |
| 1,383,067 | A | 6/1921 | Borman |
| 1,422,716 | A | 7/1922 | Jones |
| 1,444,189 | A | 2/1923 | Key |
| 1,450,934 | A | 4/1923 | Wilson |
| 1,498,838 | A | 6/1924 | Harrison, Jr. |
| 1,531,731 | A | 3/1925 | Burgess |
| 1,602,675 | A | 10/1926 | Hurley |
| 1,605,985 | A | 11/1926 | Rasmussen |
| 1,630,445 | A | 5/1927 | Murray |
| 1,637,219 | A | 7/1927 | Edelmann |
| 1,776,750 | A | 9/1930 | Burns |
| 1,802,523 | A | 4/1931 | Morangier |
| 1,818,178 | A | 8/1931 | Weisberg |
| 1,869,257 | A | 7/1932 | Hitzler |
| 1,940,542 | A | 12/1933 | Goth |
| 1,954,122 | A | 4/1934 | Fiori |
| 1,979,972 | A | 11/1934 | Guild |
| 2,001,821 | A | 5/1935 | Everston |
| 2,002,527 | A | 5/1935 | Dorogi et al. |
| 2,007,803 | A | 7/1935 | Kelly |
| 2,015,882 | A | 10/1935 | Brewer |
| 2,016,113 | A | 10/1935 | Lambert et al. |
| 2,020,240 | A | 11/1935 | Cochran |
| 2,036,695 | A | 4/1936 | Heigis |
| 2,038,473 | A | 4/1936 | Bronson |
| 2,070,116 | A | 2/1937 | Cutillo |
| 2,074,286 | A | 3/1937 | Sullivan |
| 2,080,469 | A | 5/1937 | Gilbert |
| 2,080,499 | A | 5/1937 | Nathansohn |
| 2,147,197 | A | 2/1939 | Glidden |
| 2,177,116 | A | 10/1939 | Persichino |
| 2,205,938 | A | 6/1940 | Ward |
| 2,275,720 | A | 3/1942 | Bingham, Jr. |
| D133,459 | S | 8/1942 | Corley |
| 2,325,639 | A | 8/1943 | Stritter |
| 2,368,091 | A | 1/1945 | Andersen |
| 2,476,545 | A | 7/1949 | Hayward |
| 2,488,382 | A | 11/1949 | Davis |
| 2,498,596 | A | 2/1950 | Wallach |
| 2,532,742 | A | 12/1950 | Stoiner |
| 2,533,685 | A | 12/1950 | Nurkiewicz |
| 2,574,028 | A | 11/1951 | Fields et al. |
| 2,575,908 | A | 11/1951 | Clifford |
| 2,579,977 | A | 12/1951 | Sjolin |
| 2,600,239 | A | 6/1952 | Gilbert |
| 2,605,560 | A | 8/1952 | Gouabault |
| 2,622,052 | A | 12/1952 | Chandler |
| 2,638,690 | A | 5/1953 | Bullard, III |
| 2,677,904 | A | 5/1954 | Reed |
| 2,677,906 | A | 5/1954 | Reed |
| 2,678,506 | A | 5/1954 | Baroumes |
| 2,682,712 | A | 8/1954 | Cooksley |
| 2,686,081 | A | 8/1954 | Cooksley |
| 2,693,221 | A | 11/1954 | Lyijynen |
| 2,698,490 | A | 1/1955 | Goldman |
| 2,717,100 | A | 9/1955 | Engelder |
| 2,717,556 | A | 9/1955 | Bartoo |
| 2,762,134 | A | 9/1956 | Town |
| 2,774,152 | A | 12/1956 | Alber |
| 2,775,401 | A | 12/1956 | Storrs |
| 2,845,032 | A | 7/1958 | Krohm |
| 2,860,634 | A | 11/1958 | Duncan et al. |
| 2,863,230 | A | 12/1958 | Cortina |
| 2,878,683 | A | 3/1959 | Huthsing, Sr. et al. |
| 2,942,614 | A | 6/1960 | Lardner |
| 2,949,927 | A | 8/1960 | Mackal |
| 2,981,010 | A | 4/1961 | Aaskov |
| 2,982,448 | A | 5/1961 | Leonard et al. |
| 3,015,414 | A | 1/1962 | Wilson |
| 3,027,659 | A | 4/1962 | Gianola |
| 3,044,190 | A | 7/1962 | Urbany |
| 3,060,965 | A | 10/1962 | Taggart |
| 3,062,152 | A | 11/1962 | Huff, Sr. |
| 3,068,494 | A | 12/1962 | Pinkwater |
| 3,078,679 | A | 2/1963 | Mortimer et al. |
| 3,080,094 | A | 3/1963 | Modderno |
| 3,120,712 | A | 2/1964 | Menken |
| 3,180,039 | A | 4/1965 | Burns, Jr. |
| D201,606 | S | 7/1965 | McCord |
| 3,196,062 | A | 7/1965 | Kristal |
| 3,211,164 | A | 10/1965 | Bender et al. |
| 3,221,932 | A | 12/1965 | Anderson |
| 3,225,463 | A | 12/1965 | Burnham |
| 3,245,428 | A | 4/1966 | Klimak et al. |
| 3,256,131 | A | 6/1966 | Koch et al. |
| D205,276 | S | 7/1966 | Kort |
| 3,273,263 | A | 9/1966 | Klima |
| 3,329,983 | A | 7/1967 | Clamp |
| 3,331,146 | A | 7/1967 | Karras |
| 3,372,495 | A | 3/1968 | Finn |
| 3,397,418 | A | 8/1968 | Steadman et al. |
| 3,410,004 | A | 11/1968 | Finn |
| 3,426,787 | A | 2/1969 | Fuller |
| 3,454,033 | A | 7/1969 | Smith |
| 3,484,881 | A | 12/1969 | Krieger |
| D216,694 | S | 3/1970 | Lause |
| 3,548,869 | A | 12/1970 | Weise et al. |
| 3,586,003 | A | 6/1971 | Baker |
| D221,432 | S | 8/1971 | Dunlap |
| 3,628,531 | A | 12/1971 | Harris |
| 3,642,563 | A | 2/1972 | Davis et al. |
| 3,658,208 | A | 4/1972 | Hansen |
| 3,664,043 | A | 5/1972 | Polumbus, Jr. |
| 3,685,176 | A | 8/1972 | Rudy |
| 3,716,930 | A | 2/1973 | Brahm |
| 3,721,265 | A | 3/1973 | Hoffland |
| 3,739,414 | A | 6/1973 | Skelham |
| D227,888 | S | 7/1973 | Felix |
| 3,744,159 | A | 7/1973 | Nishimura |
| 3,760,056 | A | 9/1973 | Rudy |
| 3,765,422 | A | 10/1973 | Smith |

3,776,227 A 12/1973 Pitesky et al.
3,791,375 A 2/1974 Pfeiffer
3,834,433 A 9/1974 Thompson
3,854,228 A 12/1974 Conroy
3,888,242 A 6/1975 Harris et al.
3,931,685 A 1/1976 Laukaitis
3,973,336 A 8/1976 Ah
3,976,907 A 8/1976 Kass et al.
3,983,907 A 10/1976 Sorensen
3,985,155 A 10/1976 Nightingale
3,993,099 A 11/1976 Nightingale
3,995,653 A 12/1976 Mackal et al.
3,996,957 A 12/1976 Goldish et al.
D243,457 S 2/1977 Ryan
4,014,048 A 3/1977 Rapppleyea
4,039,039 A 8/1977 Gottfried
4,044,867 A 8/1977 Fisher
4,054,163 A 10/1977 Brown, Jr. et al.
D246,486 S 11/1977 Nickel
4,069,602 A 1/1978 Kremer et al.
4,078,322 A 3/1978 Dalebout
4,083,127 A 4/1978 Hanson
4,088,147 A 5/1978 Krechel et al.
4,100,686 A 7/1978 Sgarlato et al.
4,106,222 A 8/1978 Houck
D249,279 S 9/1978 Backlund
4,123,855 A 11/1978 Thedford
4,129,951 A 12/1978 Petrosky
D252,703 S 8/1979 Cupit
4,168,015 A 9/1979 Robinette
4,169,353 A 10/1979 Fresard
4,183,156 A 1/1980 Rudy
4,217,705 A 8/1980 Donzis
4,219,945 A 9/1980 Rudy
4,222,183 A 9/1980 Haddox
4,232,459 A 11/1980 Vaccari
4,271,606 A 6/1981 Rudy
4,297,755 A 11/1981 Mollura
4,316,334 A 2/1982 Hunt
4,316,335 A 2/1982 Giese et al.
4,335,530 A 6/1982 Stubblefield
4,340,626 A 7/1982 Rudy
4,342,157 A 8/1982 Gilbert
4,361,969 A 12/1982 Vermonet
4,370,997 A 2/1983 Braithwaite et al.
4,372,297 A 2/1983 Perlin
4,397,104 A 8/1983 Doak
4,398,357 A 8/1983 Batra
4,399,621 A 8/1983 Dassler
4,417,407 A 11/1983 Fukuoka
4,439,937 A 4/1984 Daswick
4,446,634 A 5/1984 Johnson et al.
4,454,662 A 6/1984 Stubblefield
4,457,335 A 7/1984 Trick
4,458,429 A 7/1984 Schmid
4,458,430 A 7/1984 Peterson
4,462,171 A 7/1984 Whispell
4,485,568 A 12/1984 Landi et al.
4,489,855 A 12/1984 Boetger
4,490,928 A 1/1985 Kawashima
4,506,695 A 3/1985 Kuypers
4,508,582 A 4/1985 Fink
4,535,554 A 8/1985 De Obaldia B.
4,541,186 A 9/1985 Mulvihill
4,542,598 A 9/1985 Misevich et al.
4,546,559 A 10/1985 Dassler
4,547,979 A 10/1985 Harada et al.
D281,350 S 11/1985 Heier
4,550,510 A 11/1985 Stubblefield
4,571,853 A 2/1986 Medrano
4,571,995 A 2/1986 Timme
4,578,883 A 4/1986 Dassler
4,579,141 A 4/1986 Arff
D284,264 S 6/1986 Resan
D284,265 S 6/1986 Resan
D285,716 S 9/1986 Bova
4,608,769 A 9/1986 Sturlaugson
4,610,099 A 9/1986 Signori
4,628,945 A 12/1986 Johnson, Jr.
4,641,438 A 2/1987 Laird et al.
4,642,917 A 2/1987 Ungar
4,649,552 A 3/1987 Yukawa
4,651,445 A 3/1987 Hannibal
4,654,986 A 4/1987 George
4,658,869 A 4/1987 Soon-Fu
4,662,087 A 5/1987 Beuch
4,662,412 A 5/1987 Swallert
4,669,498 A 6/1987 Hansen
4,670,995 A 6/1987 Huang
4,676,010 A 6/1987 Cheskin
4,681,148 A 7/1987 Decker, Jr. et al.
4,694,520 A 9/1987 Paul et al.
4,694,591 A 9/1987 Banich et al.
4,694,850 A 9/1987 Fumino
4,700,403 A 10/1987 Vacanti
4,702,022 A 10/1987 Porcher
4,729,543 A 3/1988 Aricha
4,730,403 A 3/1988 Walkhoff
4,736,531 A 4/1988 Richard
4,742,844 A 5/1988 Szlaga
4,744,157 A 5/1988 Dubner
D296,581 S 7/1988 Hattori
4,760,651 A 8/1988 Pon-Tzu
4,763,426 A 8/1988 Polus et al.
4,771,554 A 9/1988 Hannemann
4,773,454 A 9/1988 Kroh et al.
4,774,776 A 10/1988 Gulli
4,776,110 A 10/1988 Shiang
4,778,595 A 10/1988 Sable et al.
4,779,359 A 10/1988 Famolare, Jr.
D299,379 S 1/1989 Haggerty et al.
4,805,601 A 2/1989 Eischen, Sr.
4,811,497 A 3/1989 Merino Ciudad
4,817,303 A 4/1989 Selbiger
4,823,482 A 4/1989 Lakic
D302,764 S 8/1989 Peoples et al.
4,852,274 A 8/1989 Wilson
4,854,057 A 8/1989 Misevich et al.
4,856,208 A 8/1989 Zaccaro
RE33,066 E 9/1989 Stubblefield
4,874,640 A 10/1989 Donzis
4,877,057 A 10/1989 Christensen
4,878,300 A 11/1989 Bogaty
4,887,367 A 12/1989 Mackness et al.
4,906,502 A 3/1990 Rudy
4,910,889 A 3/1990 Bonaventure et al.
4,912,861 A 4/1990 Huang
D307,508 S 5/1990 Miller et al.
4,922,631 A 5/1990 Anderie
4,934,543 A 6/1990 Schmidt
D309,211 S 7/1990 Nakagawa
4,969,493 A 11/1990 Lee
D314,172 S 1/1991 Whitley, II
4,991,317 A 2/1991 Lakic
4,995,124 A 2/1991 Wridge, Jr. et al.
4,995,173 A 2/1991 Spier
4,999,072 A 3/1991 Dischler
5,010,661 A 4/1991 Chu
5,012,954 A 5/1991 Will
5,020,395 A 6/1991 Mackey
5,022,565 A 6/1991 Sturman et al.
5,025,575 A 6/1991 Lakic
5,042,176 A 8/1991 Rudy
5,052,130 A 10/1991 Barry et al.
5,056,992 A 10/1991 Simons et al.
5,060,694 A 10/1991 Florida et al.

| | | | | |
|---|---|---|---|---|
| 5,070,829 | A | 12/1991 | Guntly et al. | |
| 5,074,765 | A | 12/1991 | Pekar | |
| D323,419 | S | 1/1992 | Brown et al. | |
| 5,083,320 | A | 1/1992 | Halstead | |
| 5,083,581 | A | 1/1992 | Jaw | |
| 5,111,838 | A | 5/1992 | Langston | |
| 5,113,599 | A | 5/1992 | Cohen et al. | |
| 5,121,840 | A | 6/1992 | Schram | |
| D327,769 | S | 7/1992 | Serna et al. | |
| 5,129,107 | A | 7/1992 | Lorenzo | |
| 5,129,109 | A | 7/1992 | Runckel | |
| 5,131,173 | A | 7/1992 | Anderie | |
| 5,135,025 | A | 8/1992 | Mackal | |
| D329,733 | S | 9/1992 | Miller et al. | |
| 5,144,708 | A | 9/1992 | Pekar | |
| 5,155,864 | A | 10/1992 | Walker et al. | |
| 5,155,865 | A | 10/1992 | Walker et al. | |
| 5,155,866 | A | 10/1992 | Walker et al. | |
| 5,155,927 | A | 10/1992 | Bates et al. | |
| 5,158,767 | A | 10/1992 | Cohen et al. | |
| 5,181,279 | A | 1/1993 | Ross | |
| 5,185,943 | A | 2/1993 | Tong et al. | |
| 5,191,727 | A | 3/1993 | Barry et al. | |
| 5,195,254 | A | 3/1993 | Tyng | |
| 5,230,249 | A | 7/1993 | Sasaki et al. | |
| 5,234,015 | A | 8/1993 | Fumino | |
| 5,243,772 | A | 9/1993 | Francis et al. | |
| 5,253,435 | A | 10/1993 | Auger et al. | |
| D341,189 | S | 11/1993 | Legassie et al. | |
| 5,295,313 | A | 3/1994 | Lee | |
| 5,313,717 | A | 5/1994 | Allen et al. | |
| 5,317,819 | A | 6/1994 | Ellis, III | |
| 5,319,866 | A | 6/1994 | Foley et al. | |
| 5,335,382 | A | 8/1994 | Huang | |
| 5,343,638 | A | 9/1994 | Legassie et al. | |
| 5,351,710 | A | 10/1994 | Phillips | |
| 5,353,525 | A | 10/1994 | Grim | |
| 5,375,345 | A | 12/1994 | Djuric | |
| 5,381,607 | A | 1/1995 | Sussmann | |
| 5,390,430 | A | 2/1995 | Fitchmun et al. | |
| 5,392,534 | A | 2/1995 | Grim | |
| 5,400,526 | A | 3/1995 | Sessa | |
| 5,406,661 | A | 4/1995 | Pekar | |
| 5,406,719 | A | 4/1995 | Potter | |
| 5,408,760 | A | 4/1995 | Tse et al. | |
| 5,444,926 | A | 8/1995 | Allen et al. | |
| 5,544,429 | A | 8/1996 | Ellis, III | |
| 5,692,321 | A | 12/1997 | Holstine | |
| 5,701,687 | A | 12/1997 | Schmidt et al. | |
| 5,784,807 | A | 7/1998 | Pagel | |
| 5,806,208 | A | 9/1998 | French | |
| 5,826,349 | A | 10/1998 | Goss | |
| 5,829,172 | A | 11/1998 | Kaneko | |
| 5,832,634 | A | 11/1998 | Wong | |
| 5,846,063 | A | 12/1998 | Lakic | |
| 5,893,219 | A | 4/1999 | Smith et al. | |
| 5,915,820 | A | 6/1999 | Kraeuter et al. | |
| 5,953,835 | A * | 9/1999 | Kwon | 36/29 |
| 5,987,779 | A | 11/1999 | Litchfield et al. | |
| 6,014,823 | A | 1/2000 | Lakic | |
| 6,134,812 | A * | 10/2000 | Voss | 36/29 |
| 6,161,240 | A | 12/2000 | Huang | |
| 6,195,914 | B1 | 3/2001 | Otis | |
| 6,553,691 | B2 | 4/2003 | Huang | |
| 2006/0272179 | A1 | 12/2006 | Passke et al. | |

FOREIGN PATENT DOCUMENTS

| | | | |
|---|---|---|---|
| CA | 1143938 | | 11/1982 |
| CA | 1230225 | | 3/1986 |
| DE | 352167 | | 4/1922 |
| DE | 820869 | | 11/1951 |
| DE | 867585 | | 2/1953 |
| DE | 917173 | | 8/1954 |
| DE | 2005365 | | 9/1970 |
| DE | 2321817 | | 11/1973 |
| DE | 2308547 | | 8/1974 |
| DE | 2365329 | | 9/1974 |
| DE | 2456612 | | 6/1975 |
| DE | 2800359 | | 7/1979 |
| DE | 2845824 | | 11/1980 |
| DE | 3245182 | | 5/1983 |
| DE | 3205264 | | 8/1983 |
| DE | 3427644 | | 1/1986 |
| DE | 8802338 | | 8/1989 |
| EP | 229273 | | 7/1978 |
| EP | 40189 | | 11/1981 |
| EP | 152401 | | 8/1985 |
| EP | 184781 | | 6/1986 |
| EP | 352807 | | 1/1990 |
| EP | 389215 | | 9/1990 |
| EP | 472110 | | 2/1992 |
| EP | 629360 | | 12/1994 |
| EP | 630592 | | 12/1994 |
| FR | 601166 | | 4/1926 |
| FR | 720257 | | 2/1932 |
| FR | 1204093 | | 1/1960 |
| FR | 2026062 | | 9/1970 |
| FR | 2180315 | | 11/1973 |
| FR | 2252820 | | 6/1975 |
| FR | 2356384 | | 1/1978 |
| FR | 2484215 | | 12/1981 |
| FR | 2496423 | | 6/1982 |
| FR | 2670369 | A1 * | 6/1992 |
| GB | 14955 | | 5/1894 |
| GB | 26637 | | 7/1897 |
| GB | 23547 | | 1/1900 |
| GB | 288671 | | 9/1927 |
| GB | 338266 | | 6/1930 |
| GB | 520514 | | 12/1939 |
| GB | 817524 | | 7/1959 |
| GB | 887832 | | 1/1962 |
| GB | 2039717 | | 8/1980 |
| GB | 2114425 | | 8/1983 |
| GB | 2114869 | | 9/1983 |
| GB | 2165439 | | 4/1986 |
| GB | 2240254 | | 7/1991 |
| GB | 2271710 | | 4/1994 |
| JP | 1-164804 | | 6/1989 |
| TW | 95419 | | 2/1988 |
| WO | 87/03789 | | 7/1987 |
| WO | 89/10074 | | 11/1989 |
| WO | 90/04323 | | 5/1990 |
| WO | 91/16830 | | 11/1991 |
| WO | 91/18527 | | 12/1991 |
| WO | 93/14659 | | 8/1993 |
| WO | 93/21790 | | 11/1993 |
| WO | WO 03/000083 | A1 | 1/2003 |

OTHER PUBLICATIONS

Superflate by Innovations in Cycling, Inc., Interbike Buyer 1991 International Bicycle Expos, p. 145.
Runner's World pp. 58-59, 69 and 74 (Apr. 1991).
Running Times, pp. 23 and 26 (Apr. 1991).
Innovations in Cycling, Inc., Interbike Buyer Official Show Guide, 10th Ann. Interbike 1991 Int'l Bicycle Expo.
Mega MicroBlast $CO_2$ Air Dispenser, Date Unknown.

* cited by examiner

SHOE HAVING AN INFLATABLE BLADDER

This application is a CON of Ser. No. 10/887,927 filed Jul. 12, 2004 now U.S. Pat. No. 7,278,445, which is a CIP of Ser. No. 10/610,644 filed Jul. 2, 2003 now U.S. Pat. No. 7,147,670 which is a CIP of Ser. No. 10/186,717 filed Jul. 2, 2002 now U.S. Pat. No. 6,785,985.

BACKGROUND OF THE INVENTION

1. Field of the Invention

This invention relates to footwear, and more particularly to an athletic shoe having an inflatable bladder.

2. Background Art

Athletic footwear must provide stable and comfortable support for the body while subject to various types of stress. It is important that the shoe be comfortable and provide support during various foot movements associated with athletic activity.

Articles of footwear typically include an upper and a sole, and are sold in a variety of sizes according to the length and width of the foot. However, even feet of similar length do not have the same geometry. Therefore, a conventional upper must be adjustable to provide support to various foot contours. Many different products and designs have focused on the need for adjustable upper support. For example, the upper may include an ankle portion which encompasses a portion of the ankle region of the foot and thereby provides support thereto.

In addition, it is well known to adjust the size of a shoe through lacing or through one or more straps reaching across the throat of a typical shoe. Lacing alone, however, suffers from several disadvantages, for example, when the shoe laces or strap is drawn too tightly, the fastening system can cause pressure on the instep of the foot. Such localized pressure is uncomfortable to the wearer and can make it difficult for the shoe to be worn for prolonged periods of time. Furthermore, while lacing allows the upper of the shoe to be adjustable to accommodate varying foot and ankle configurations, it does not mold the shoe to the contour of individual feet. Moreover, there are areas of the foot which are not supported by the upper, due to the irregular contour of the foot. The ski boot industry has often resorted to using inflatable insertable devices to improve the fit of the boots without the pressure caused by lacing.

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury. The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the Achilles' tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

In light of the above, numerous attempts have been made over the years to incorporate into a shoe a means for providing improved cushioning and resiliency to the shoe. For example, attempts have been made to enhance the natural elasticity and energy return of the foot with foams such as EVA, which tend to break down over time and lose their resiliency, or with fluid-filled inserts. Fluid filled devices attempt to enhance cushioning and energy return by containing pressurized fluid disposed adjacent the heel and forefoot areas of a shoe. Several overriding problems exist with these devices.

One of these problems is that often fluid filled devices are not adjustable for physiological variances between people and the variety of activities for which athletic shoes are worn. It has been known to adjust fluids in the sole of footwear, such as in U.S. Pat. No. 4,610,099 to Signori. However, under foot devices, while providing cushioning to the sole, typically do not aid in support for the sides, top and back of the foot. Attempts to cushion the upper and sole of a shoe with pressurized air have resulted in products that are either ineffective or, because of the construction techniques used, are too heavy and cumbersome to be used for a running shoe.

In some conventional underfoot cushioning systems, the underfoot portion of an inflatable bladder is typically separate from the portions of an inflatable bladder along the sides and top of the foot. Thus, downward pressure in the heel of a conventional cushioning device has no effect on the cushioning surrounding the sides and heel of a foot. Further, conventional inflatable shoe inserts are also designed to be used in conjunction with a conventional shoe upper. A shoe with this type of design can be quite expensive because it requires all the materials of the upper and the additional materials of the inflatable insert. Often the inflatable inserts also add bulk to the shoe because they require a system of complex tubing between the inflation mechanism and the inflatable bladder hidden within several layers of upper padding and material.

Most conventional inflatable shoes include either a hand-held inflation mechanism, e.g., that described in Brazilian Patent No. 8305004 to Signori, or an on-board inflation mechanism which is used to selectively inflate only a portion of a shoe. Other inflatable shoes are pre-inflated at the factory. Whether inflated at the factory or inflated by the user, there is a problem with diffusion of air out of the shoe. In the case of shoes inflated at the factory, the problem of diffusion has been partially solved by utilizing a large molecule gas as the fluid for inflating the shoe. While the large molecule gas does not diffuse at the same rate as air, the gas is more expensive which increases the costs of the shoe, and a user is not capable of varying the amount of pressure in the shoe to his individual preferences. Nonetheless, one problem associated with inflation devices in shoes is how to bleed excess air out of an inflated bladder to avoid over inflation.

It is also well known to use an inflatable bladder in the upper of a shoe to accommodate the variation in foot shape. The assignee of the present invention, Reebok International Ltd., popularized such a shoe with its introduction of "The Pump" in the late 1980's, described in U.S. Pat. No. 5,158,767 and incorporated herein by reference in its entirety. Also in the mid-1980's, Reebok International Ltd. developed a self inflating shoe which is disclosed in U.S. Pat. No. 5,893,219

("the '219 patent"), which is incorporated herein by reference in its entirety. Later Reebok International Ltd. introduced a shoe known as the PUMP FURY shoe which utilizes an inflatable exoskeleton to support the upper of a shoe. This shoe is described in U.S. Pat. No. 6,237,251, the disclosure of which is incorporated herein by reference in its entirety.

One of the problems associated with technologically advanced shoes such as the one described in the '219 patent is how to manufacture such shoes at a reasonable cost with as few parts and as little weight as possible. Accordingly, what is needed is a shoe which includes one continuously fluidly interconnected inflatable bladder, wherein fluid may flow between the underside of the foot to the medial and lateral sides of the foot. The footwear must be securely fitted and fastened to the foot of the wearer, whereby a comfortable but secure grip is assured around the ankle and around the instep of the wearer. Further, the bladder in the athletic shoe must be lightweight, inexpensive, self-contained, and easy to use. In addition, the shoe should be easily constructed with minimum required stitching.

BRIEF SUMMARY OF THE INVENTION

The present invention is generally an article of footwear having a sole, and an upper. The upper has an outer surface and an inner surface. At least a portion of either the outer surface or the inner surface or both is formed from an inflatable bladder. The bladder is inflated by an inflation mechanism located in such a manner that the downward pressure of a user's foot causes the operation of the inflation mechanism. The bladder may be made from two sheets of film welded together. In one aspect of the invention, the bladder is formed from a polyurethane film, a polyester film, such as MYLAR®, or a laminate, such as a film and cloth laminate or a film and synthetic/film laminate.

In one aspect of the invention, the inflatable bladder is monolithic and includes a sole compartment, a medial compartment, and a lateral compartment, such that the bladder forms a continuous cushion running from one side of an inserted foot, under the foot, to a second side of the foot.

In another aspect of the present invention an article of footwear includes a deflation mechanism, which communicates between the bladder and the ambient atmosphere. The deflation mechanism may be a release valve, whereby a user can reduce the amount of air in a bladder manually. In another aspect, the deflation valve is a check valve, whereby the pressure in a bladder is automatically released at a predetermined pressure. In yet another aspect, the deflation mechanism is a combination check valve and release valve, including at least a cap, a seating and a check valve forming an air-tight seal with the seating. Downward pressure on the cap is used to activate the release valve. In another aspect, the deflation mechanism includes a check valve (either alone or in combination with a release valve) that is adjustable, so as to adjust the bladder pressure at which air from the bladder automatically releases. In another aspect, the deflation mechanism includes a release valve (either alone or in combination with a check valve) that is capable of being left open to keep the bladder from inflating, if desired.

In another aspect, more than one underfoot inflation mechanism is used in the present invention. In one aspect, air is directed into an underfoot inflation mechanism from an outside location through a tube open to the environment. In another aspect, an entry to the inflation mechanism may be covered by a material which is permeable to air, but not moisture or environmental particles.

In another aspect, a bladder includes a vamp compartment, having a series of cross-hatched channels formed by a plurality of openings defined by a plurality of interior weld lines. In another aspect, one or more bladders may be fluidly connected to an underfoot inflation mechanism via a plurality of tubes, such as via a channel that is fluidly connected to the inflation mechanism located under the foot. In yet another aspect, a bladder forms an X-shape across the vamp of the shoe, providing better ventilation and fit.

In another aspect, an underfoot inflation mechanism inflates a plurality of flexible tubes, that when inflated tighten a conventional upper around a foot inserted therein. Another aspect is an inflatable sockliner having an underfoot inflation mechanism. In another aspect, an inflatable sockliner includes a deflation mechanism, such as at least one perforation that opens when the air within the sockliner reaches a predetermined pressure.

BRIEF DESCRIPTION OF THE DRAWINGS/FIGURES

The foregoing and other features and advantages of the present invention will be apparent from the following, more particular description of a preferred embodiment of the invention, as illustrated in the accompanying drawings.

Figure 7A:
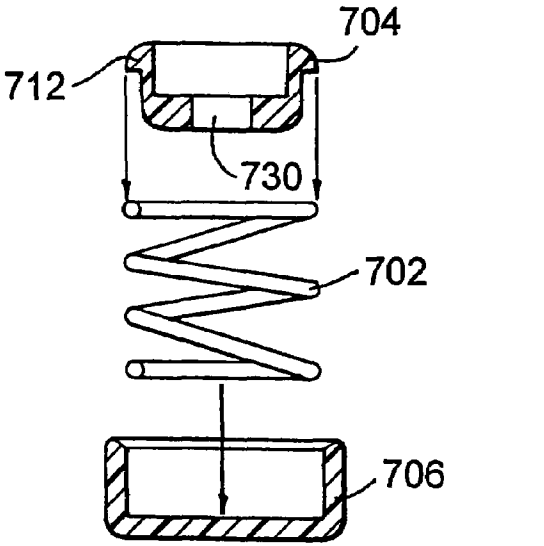
Figure 7B:
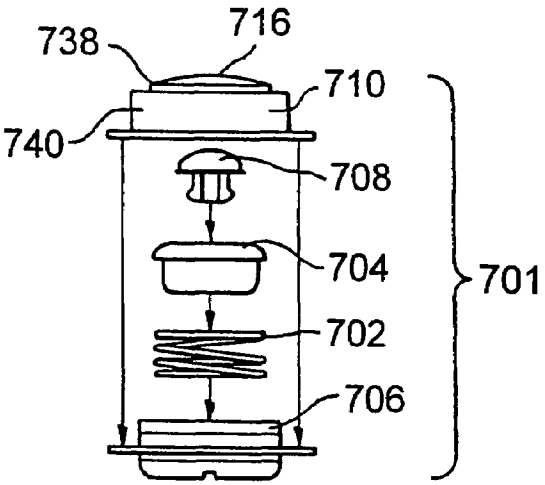
Figure 7C:
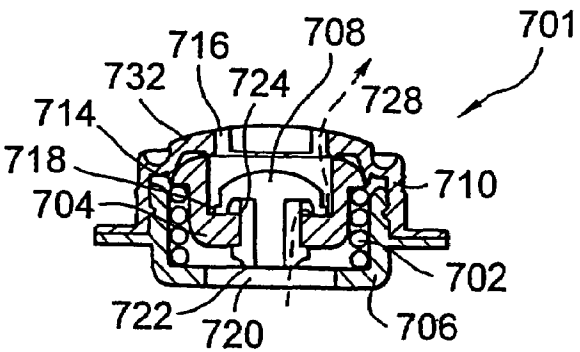
Figure 7D:
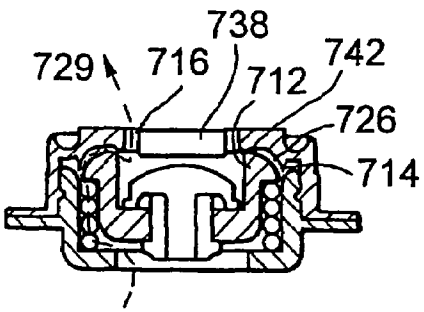

FIG. 7*a* is an exploded view of a portion of an embodiment of a combination check valve and release valve shown in FIG. 7*b*. FIG. 7*b* is an exploded view of an embodiment of a combination check valve and release valve. FIG. 7*c* is a cross section of the combination release valve and check valve of FIG. 7*b*. FIG. 7*d* is a cross section of the combination release valve and check valve of FIG. 7*b* in operation.

Figure 8B:
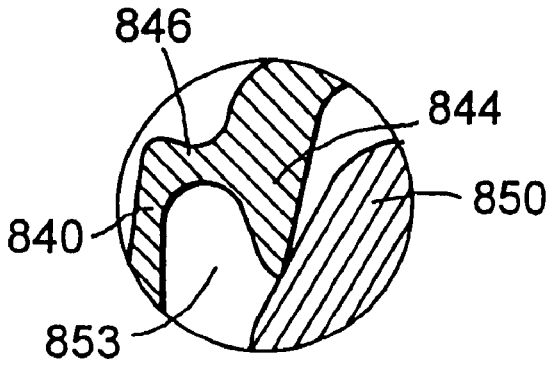
Figure 8A:
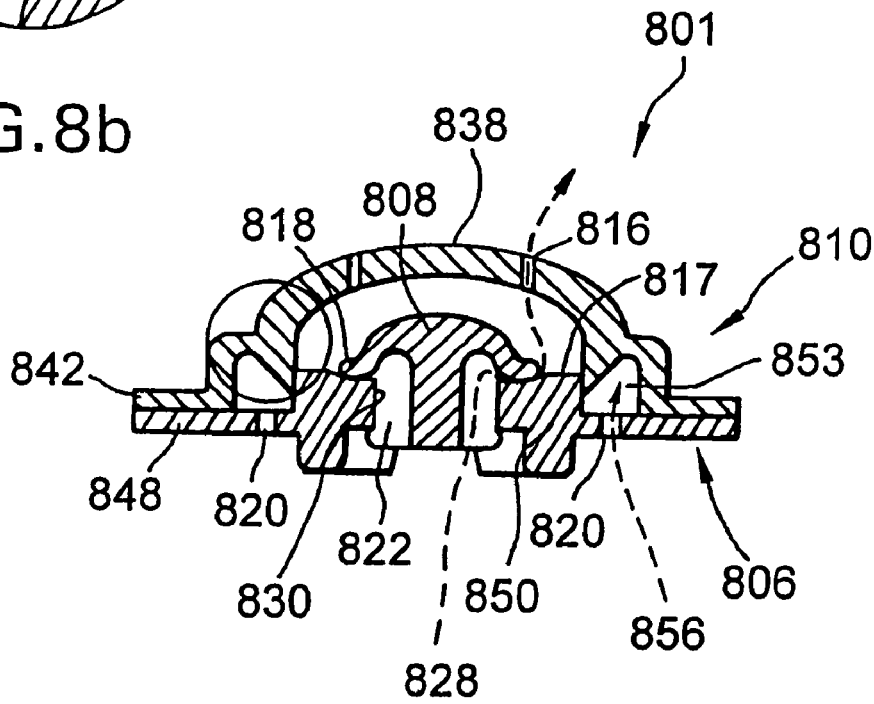

FIG. 8*a* is cross-sectional view of another embodiment of a combination check valve and release valve. FIG. 8*b* is a detailed view of a circled portion of FIG. 8*a*.

Figure 9:
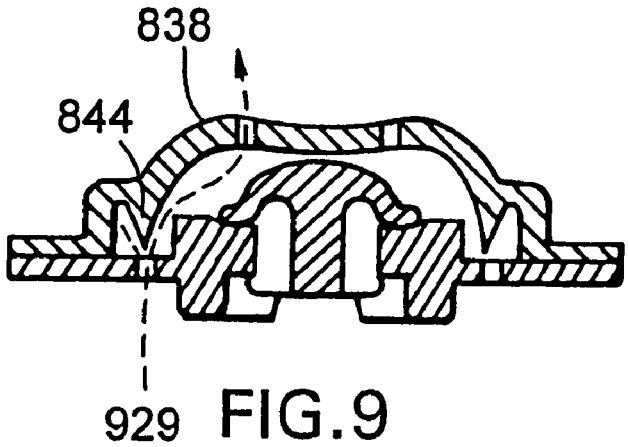

FIG. 9 is a cross-sectional view of the combination check valve and release valve of FIG. 8*a* in operation.

Figure 10:
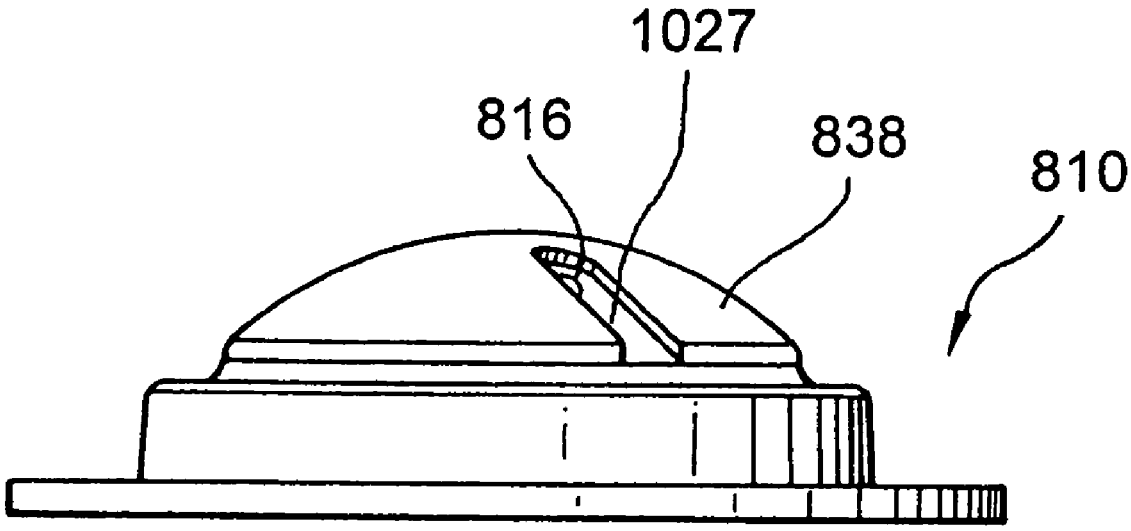

FIG. 10 is a perspective view of the combination check valve and release valve of FIGS. 8*a*, 8*b* and 9.

Figure 11A:
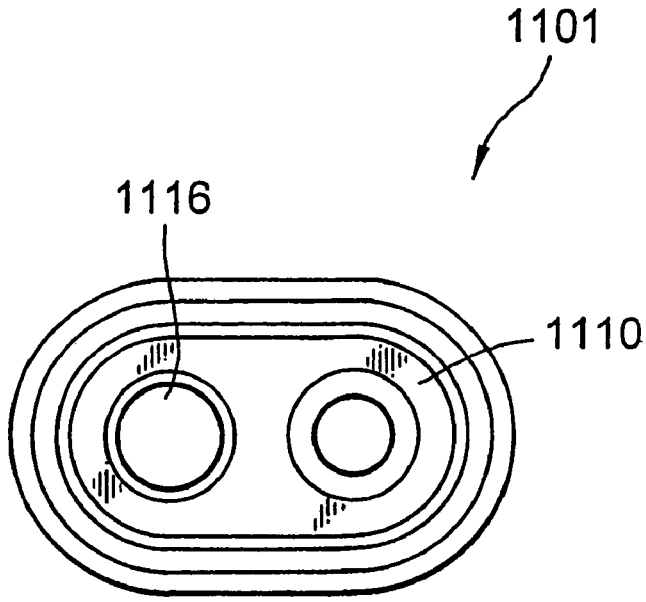
Figure 11B:
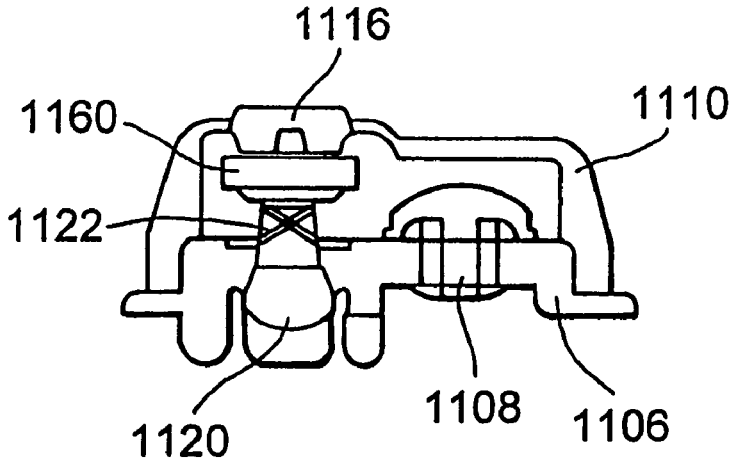

FIG. 11*a* is an above plan view of another embodiment of a combination check valve and release valve. FIG. 11*b* is a schematic cross-sectional view of the combination check valve and release valve of FIG. 11*a*.

Figure 12:
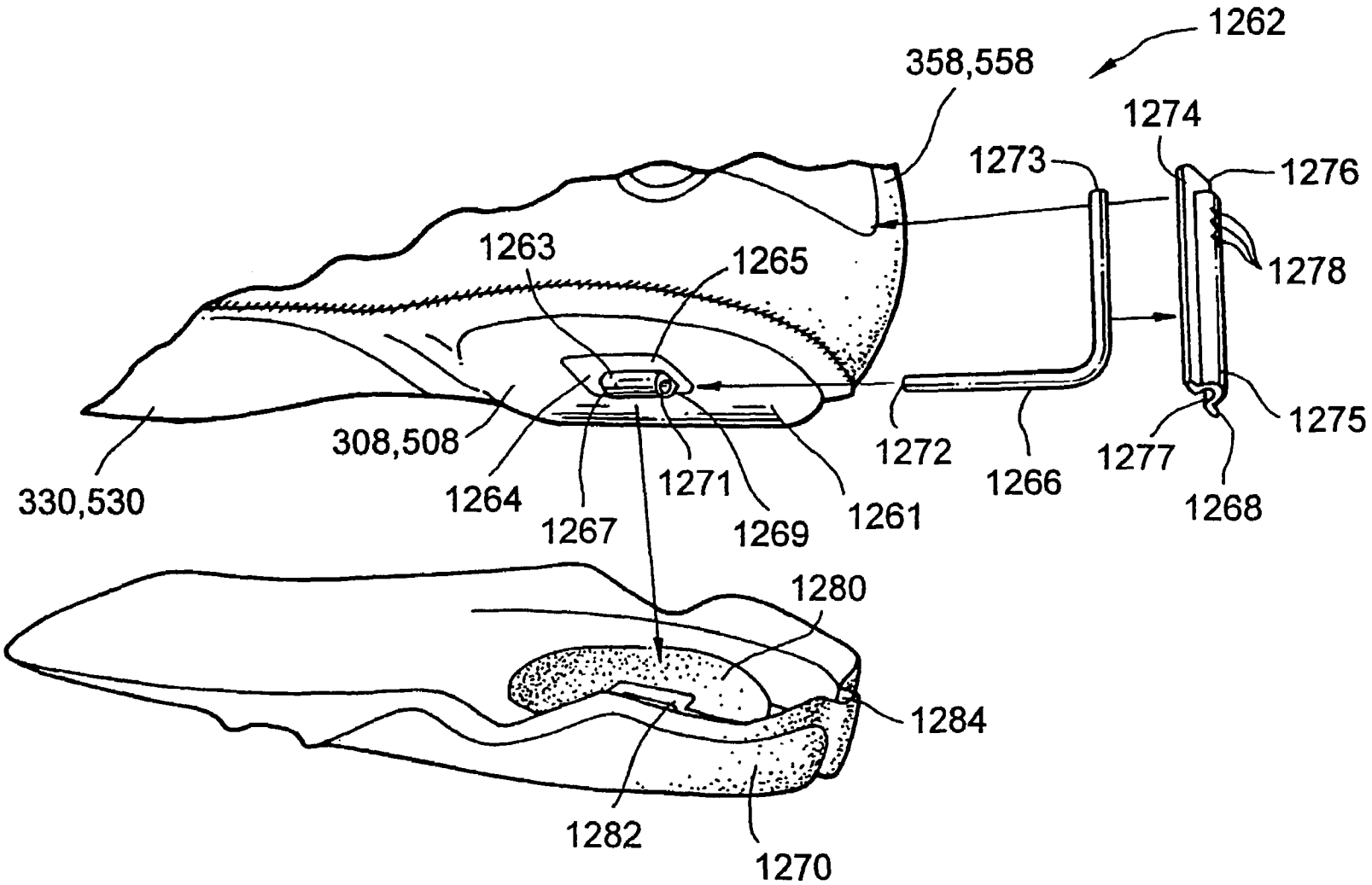

FIG. 12 is an exploded perspective view of an embodiment of a snorkel assembly.

Figure 13:
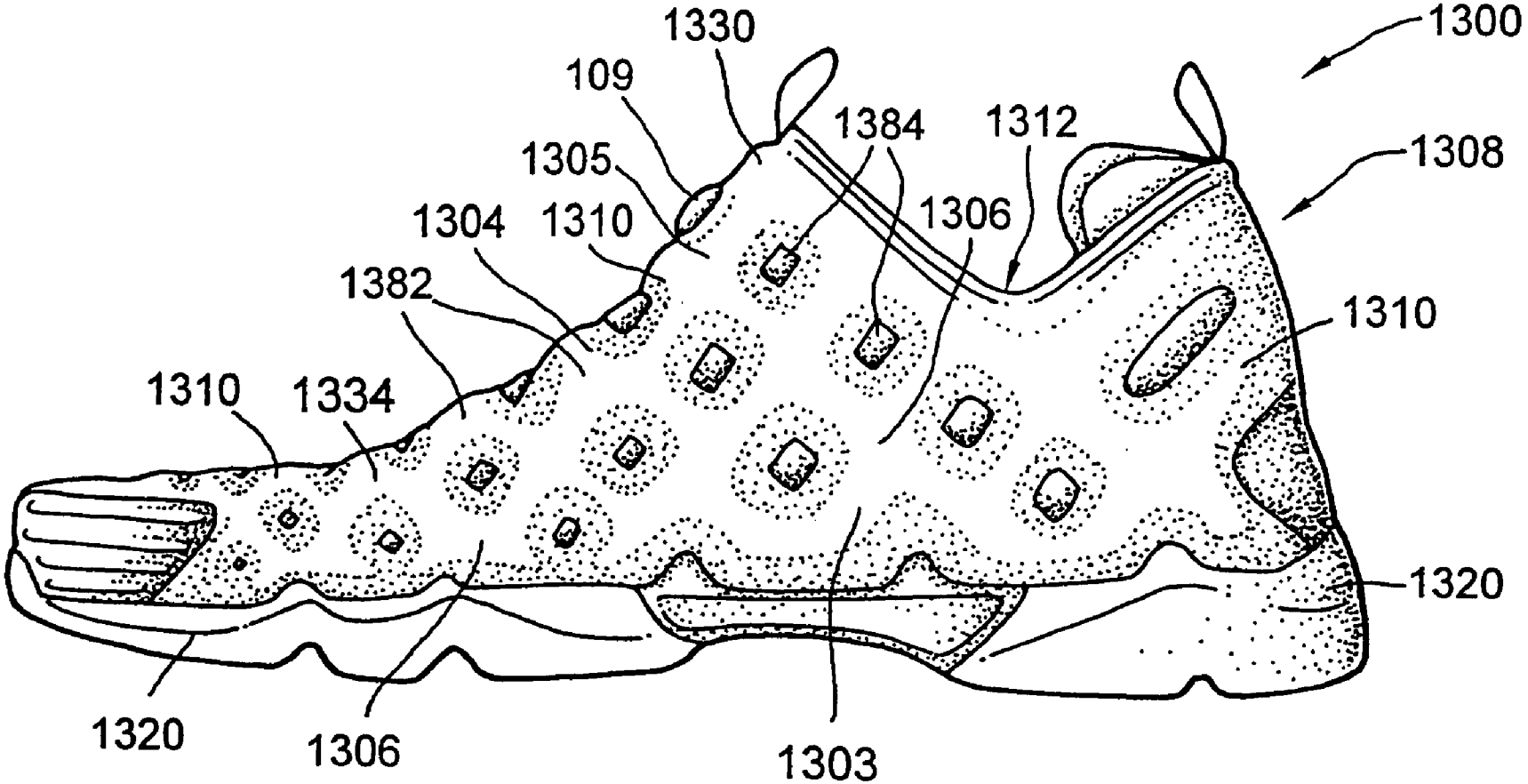

FIG. 13 is a lateral side view of another embodiment of a shoe.

Figure 14:
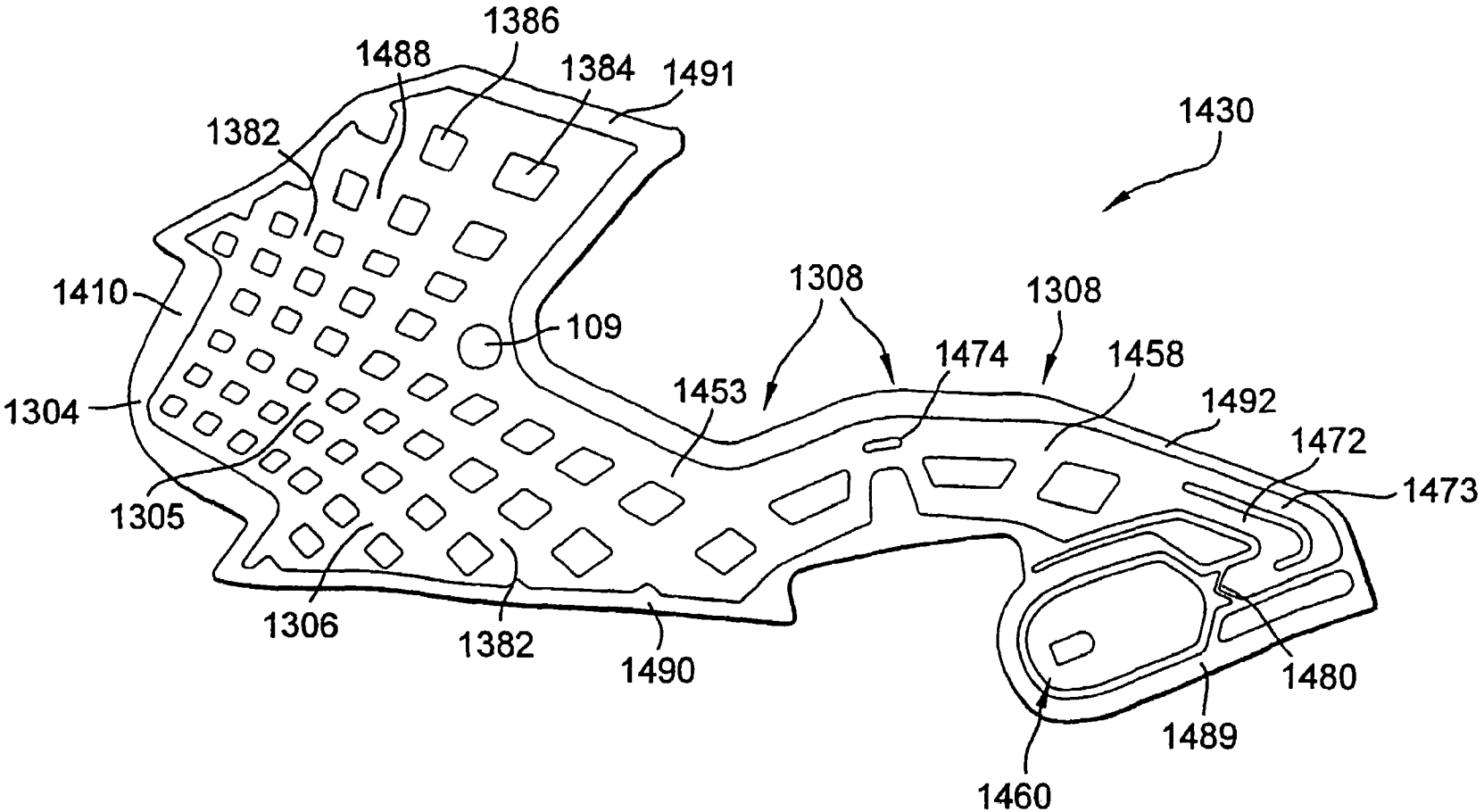

FIG. 14 is an above plan view of another embodiment of a bladder.

Figure 15:
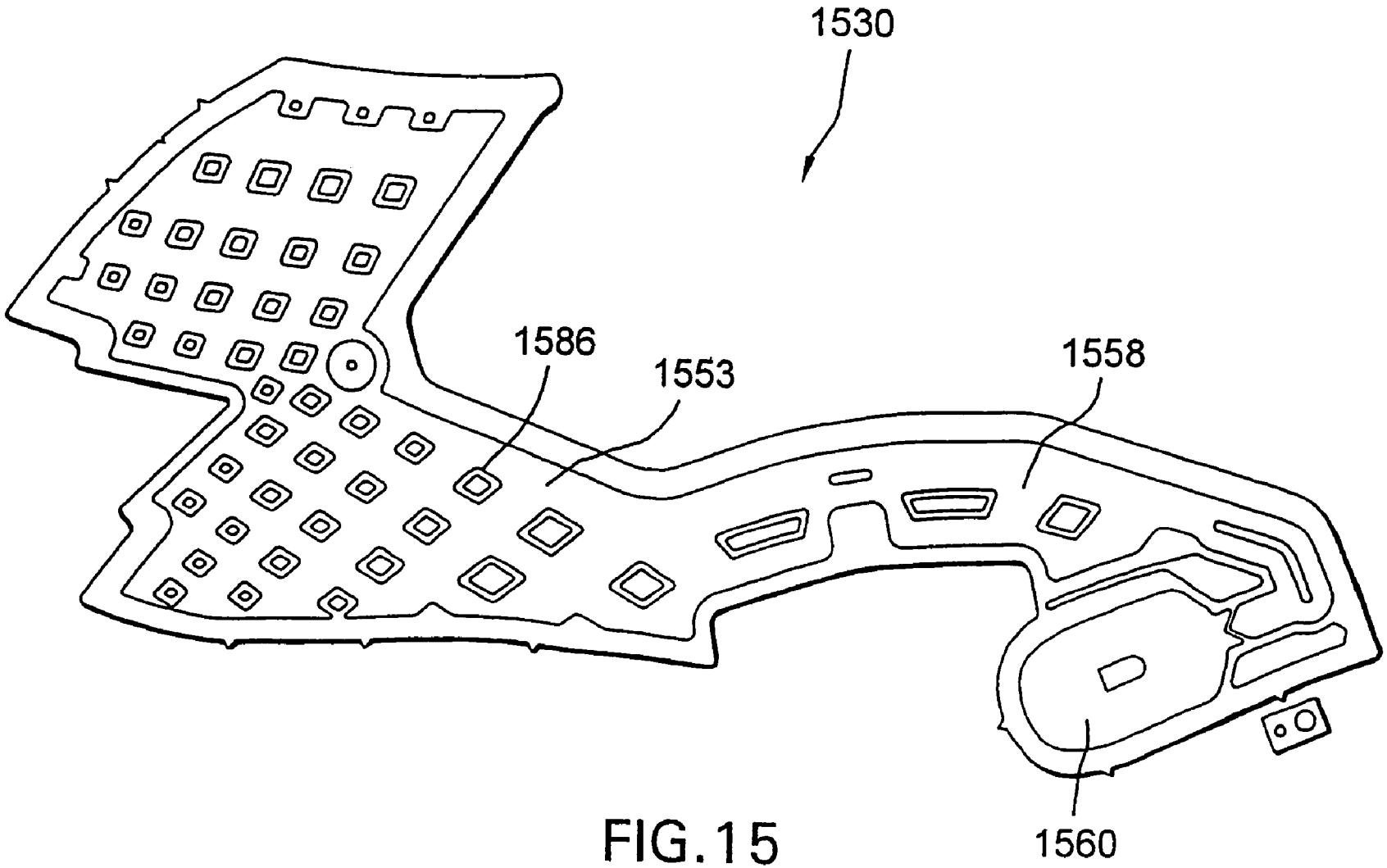

FIG. 15 is an above plan view of another embodiment of a bladder.

Figure 16:
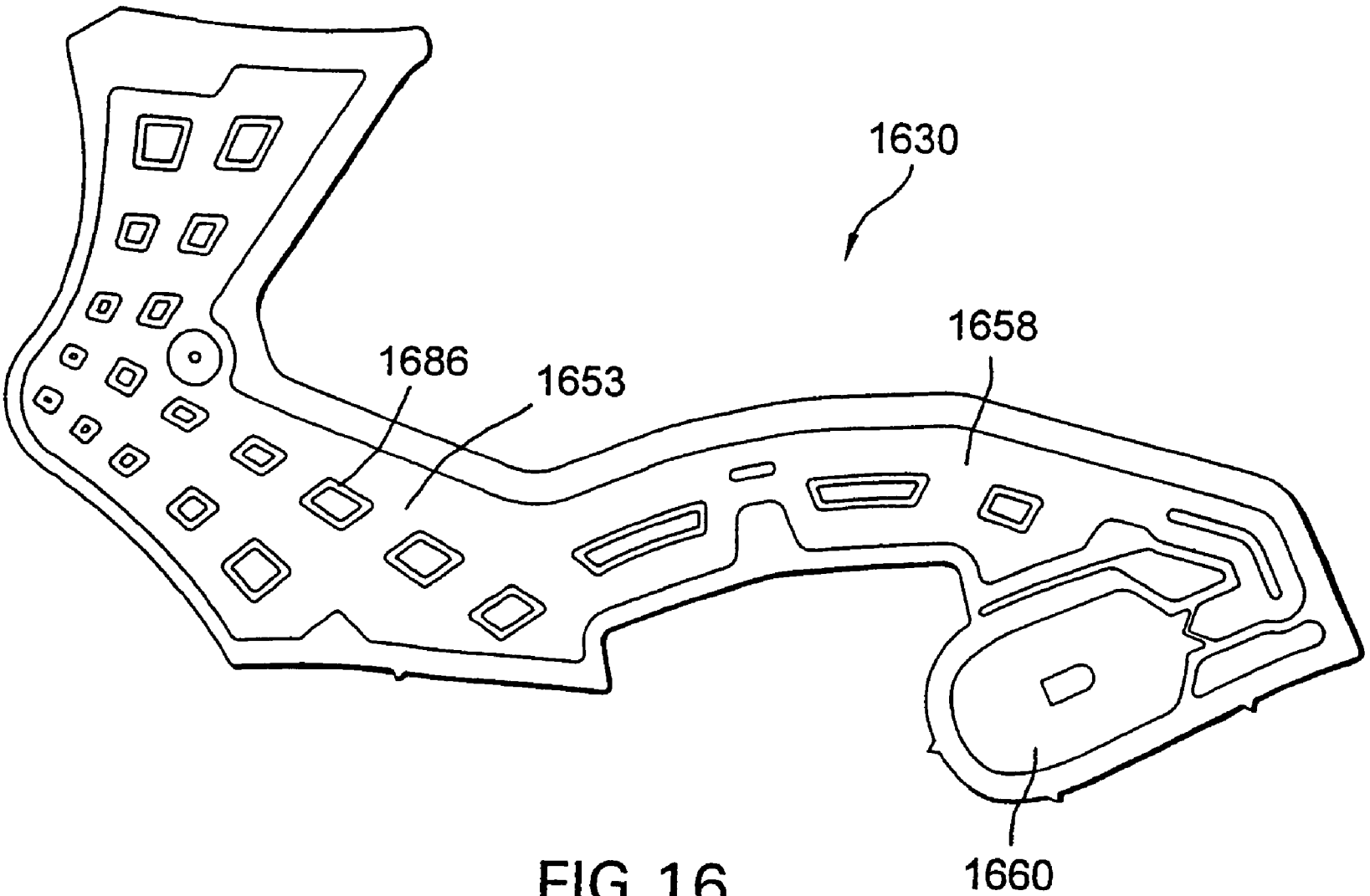

FIG. 16 is an above plan view of another embodiment of a bladder.

Figure 17:
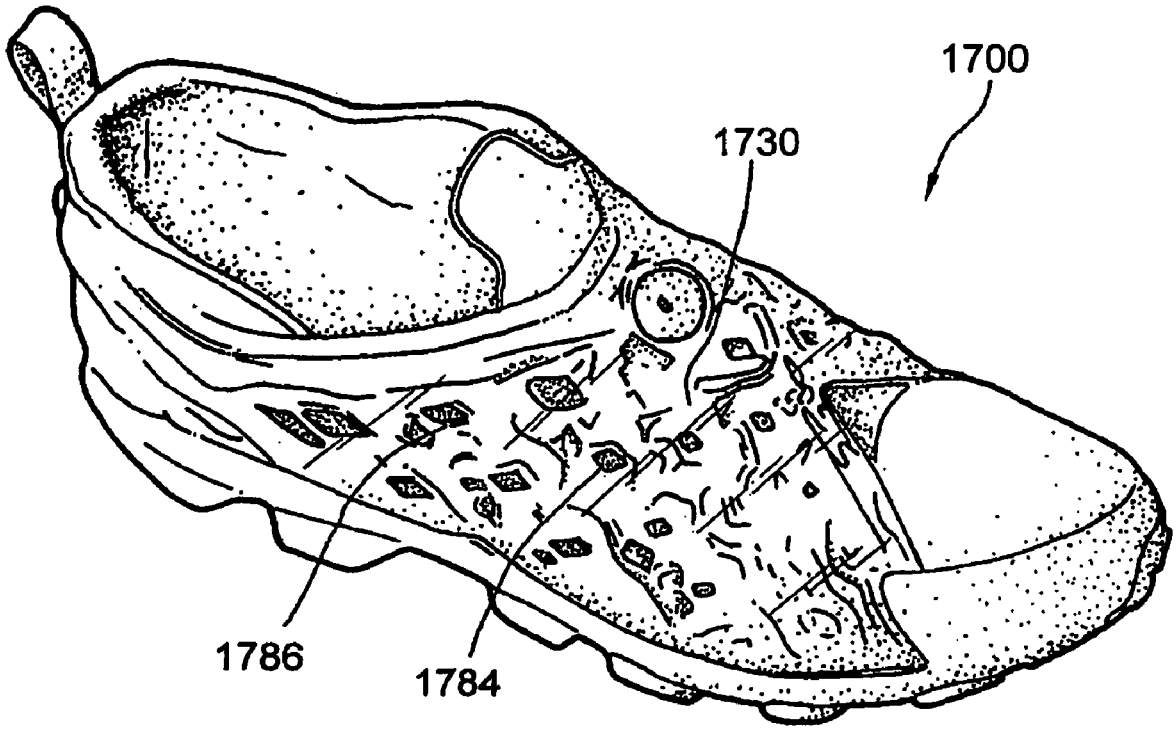

FIG. 17 is a lateral side view of another embodiment of a shoe.

Figure 18:
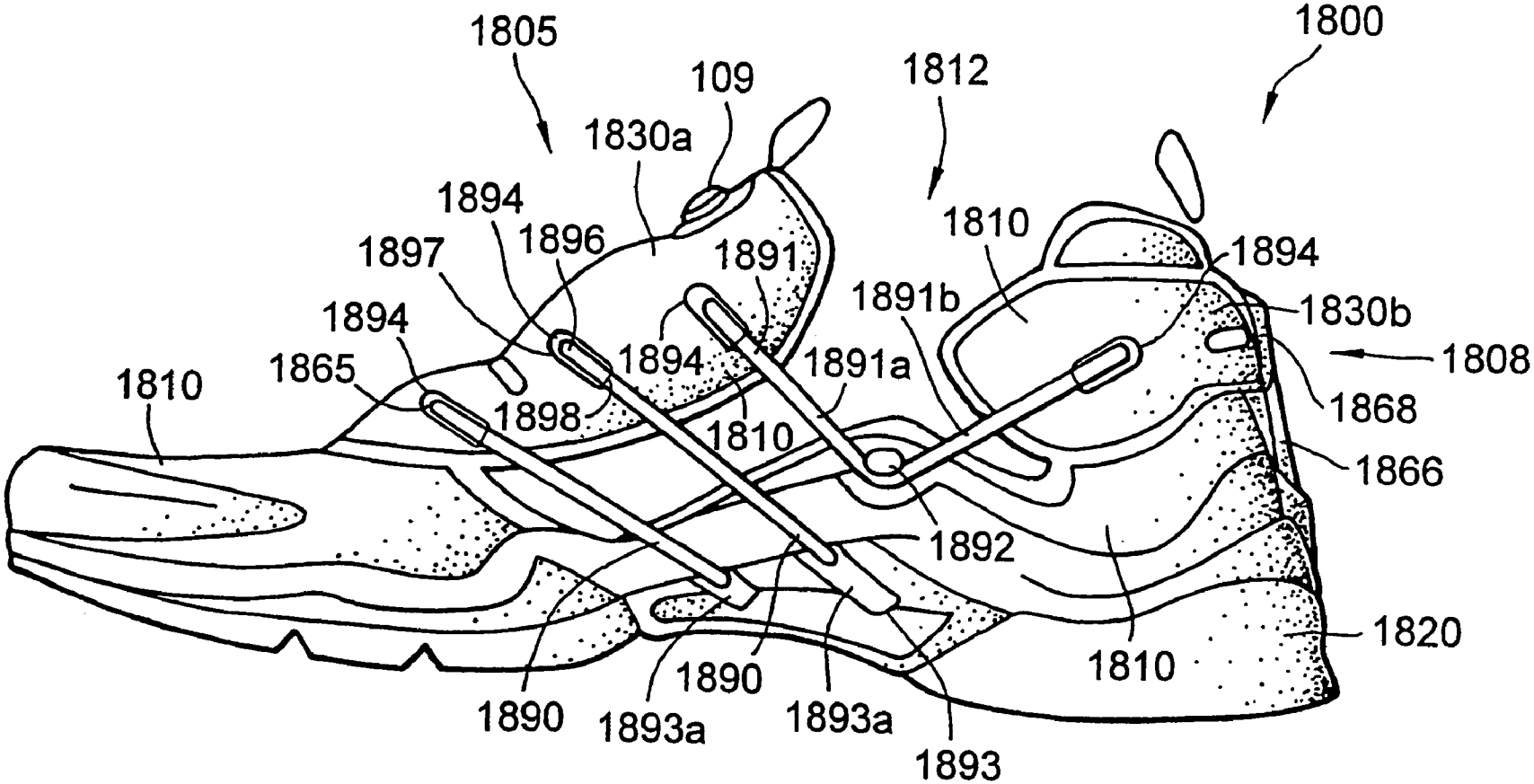

FIG. 18 is a lateral side view of another embodiment of a shoe.

Figure 19B:
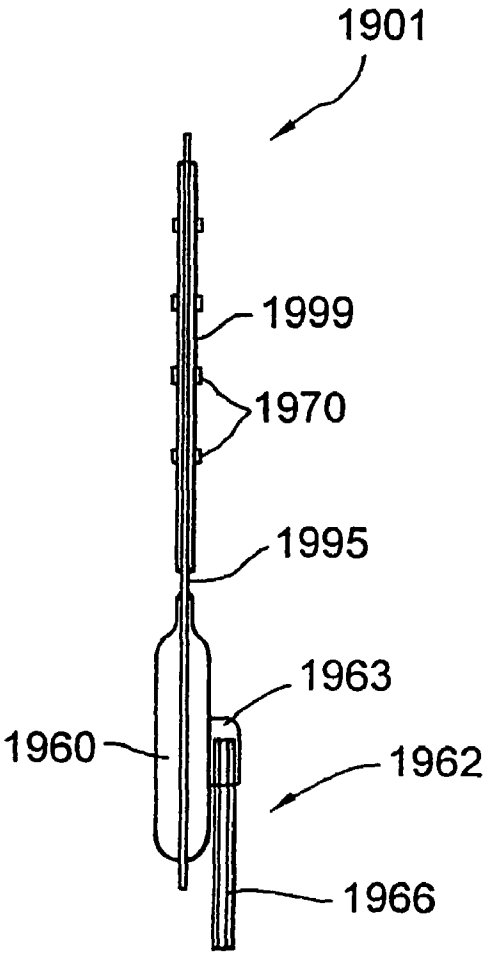
Figure 19A:
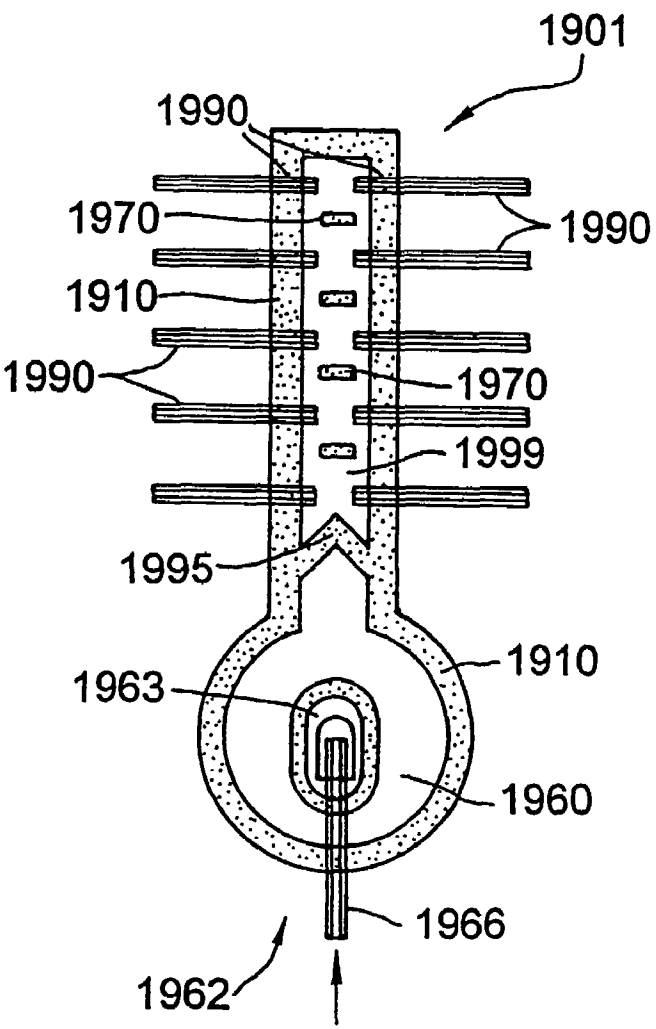

FIG. 19*a* is an above plan view of an embodiment of a heel compartment assembly. FIG. 19*b* is a side plan view of the heel compartment assembly of FIG. 19*a*.

Figure 20:
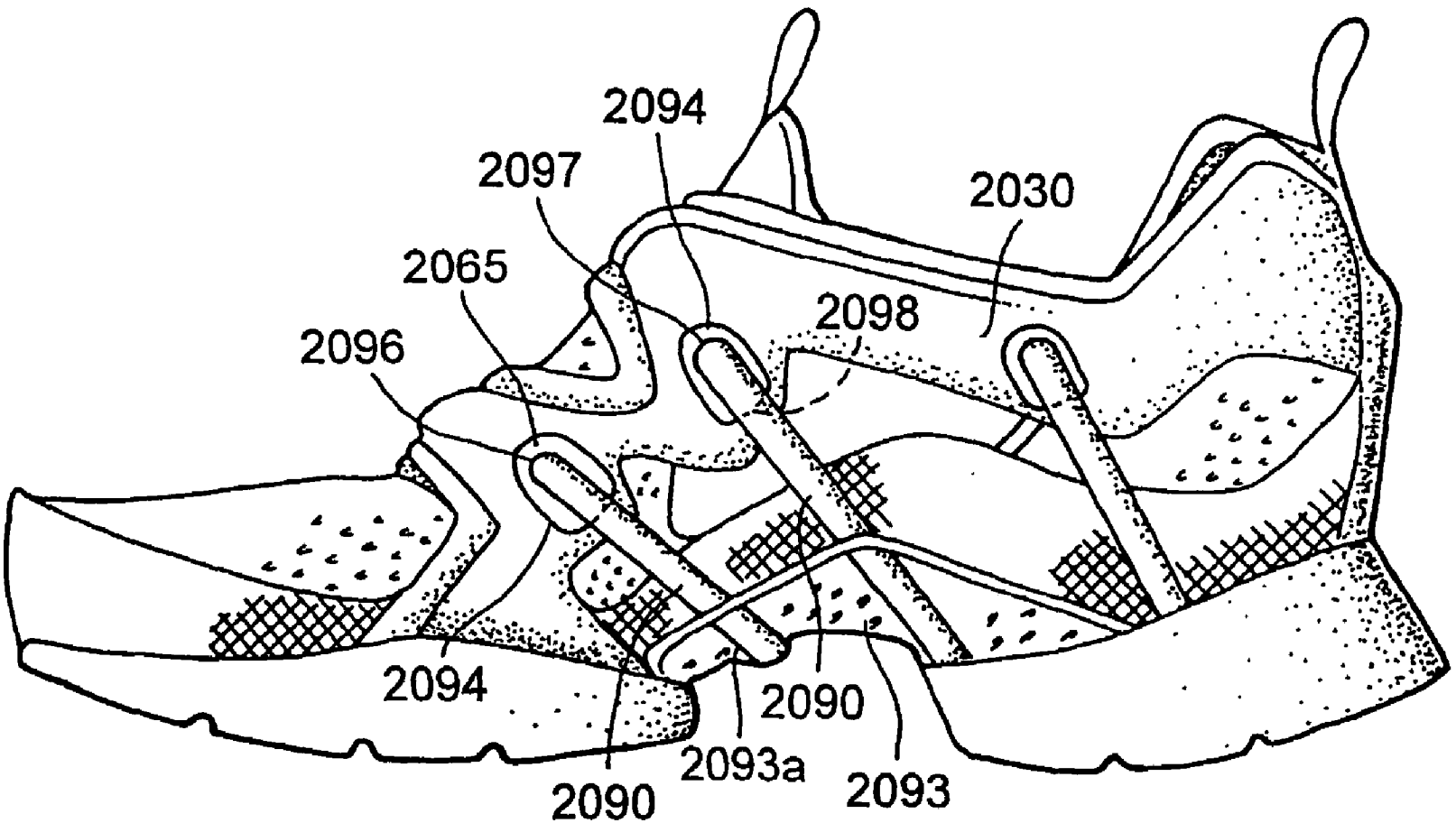

FIG. 20 is a lateral side view of another embodiment of a shoe.

Figure 21:
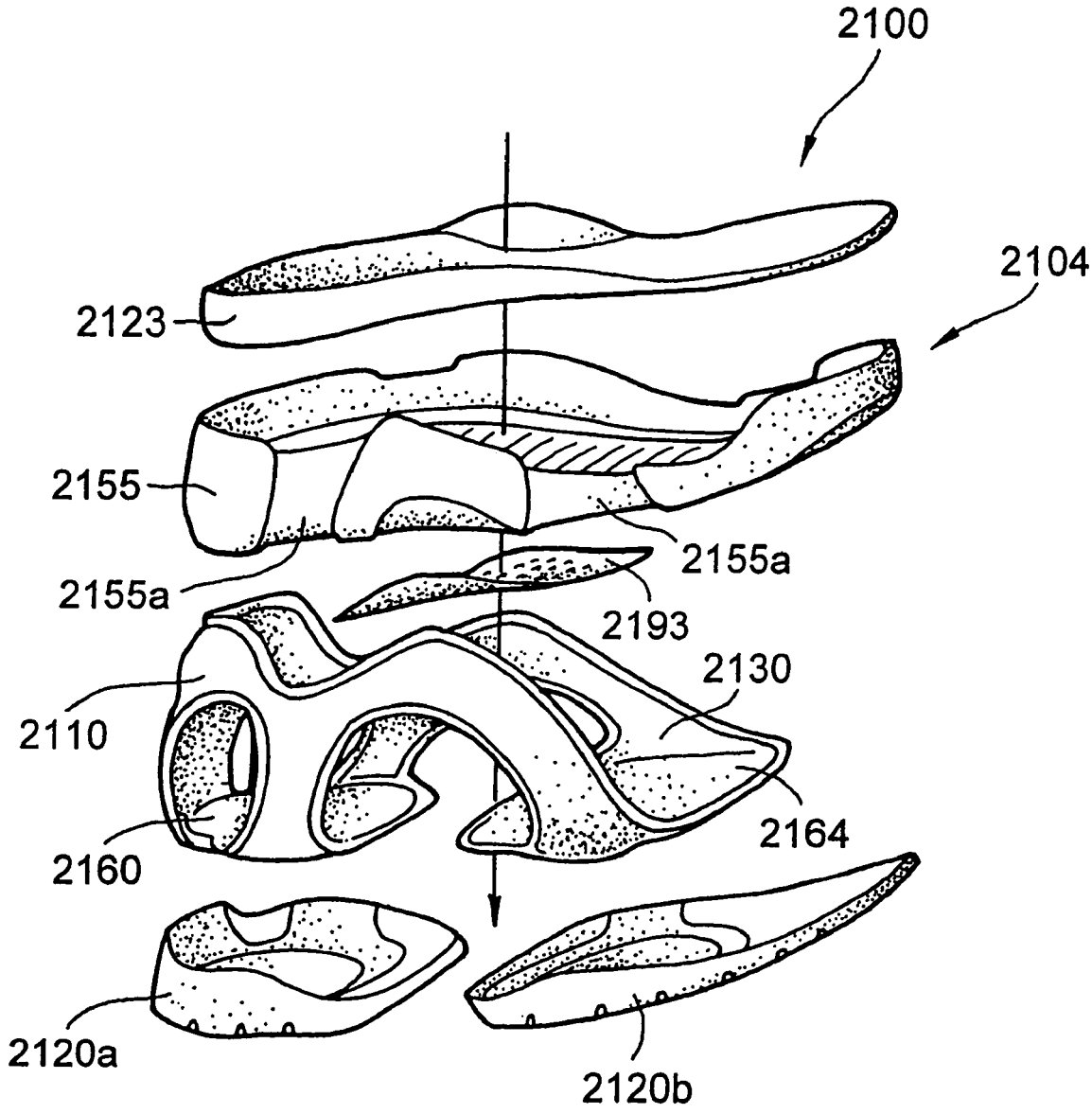

FIG. 21 is an exploded perspective view of another embodiment of a shoe.

Figure 22:
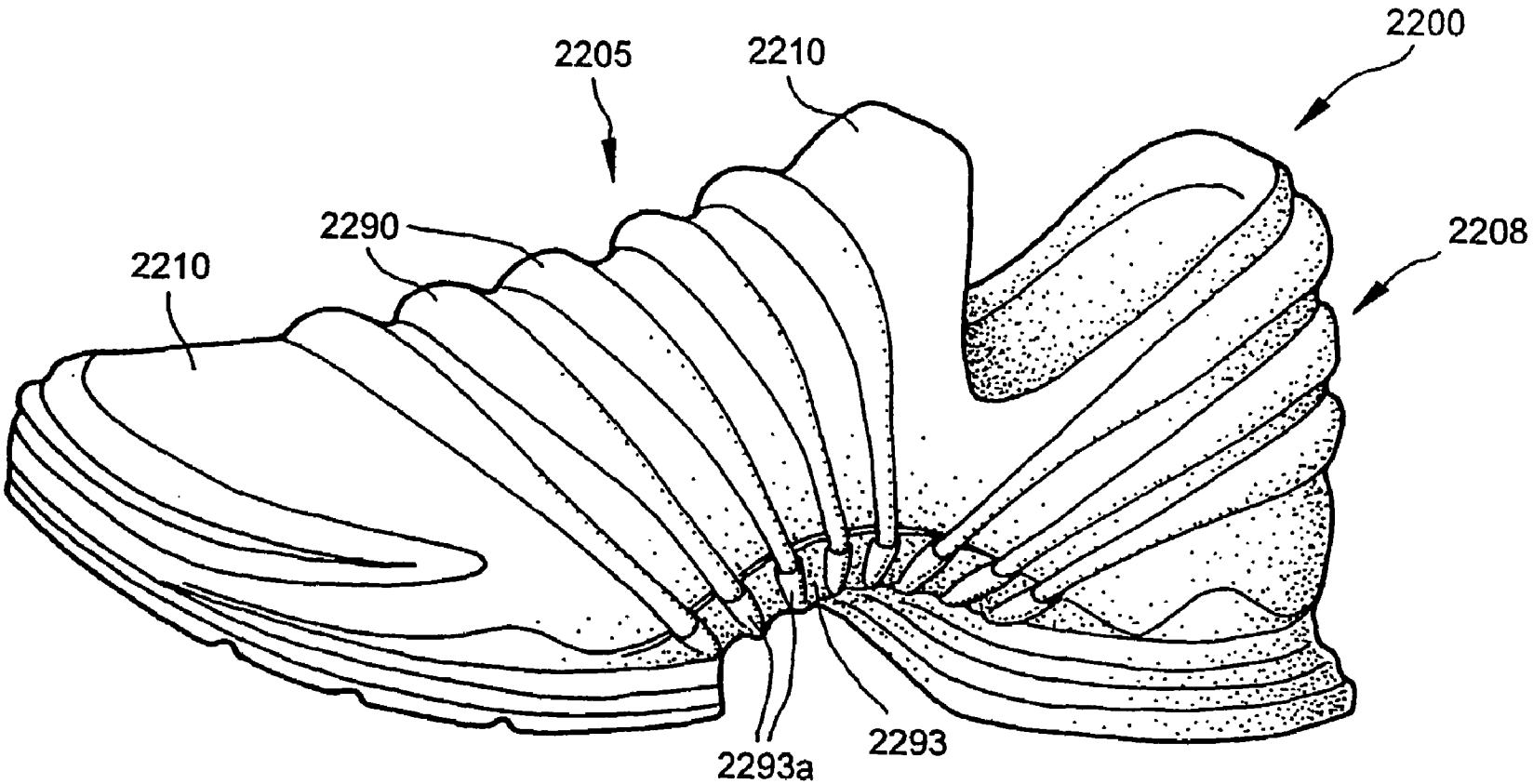

FIG. 22 is a lateral side view of another embodiment of a shoe.

Figure 23:
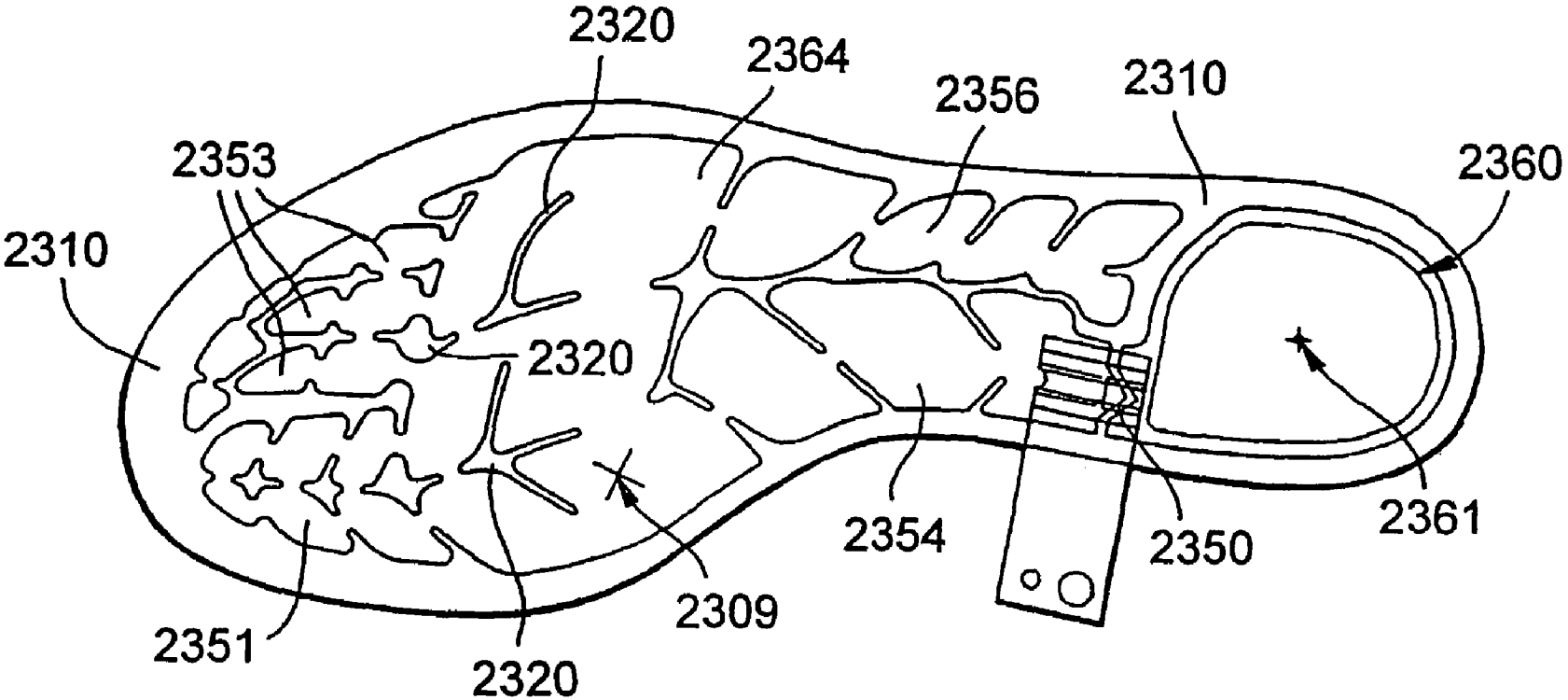

FIG. 23 is an above plan view of an embodiment of an inflatable sockliner.

Figure 24A:
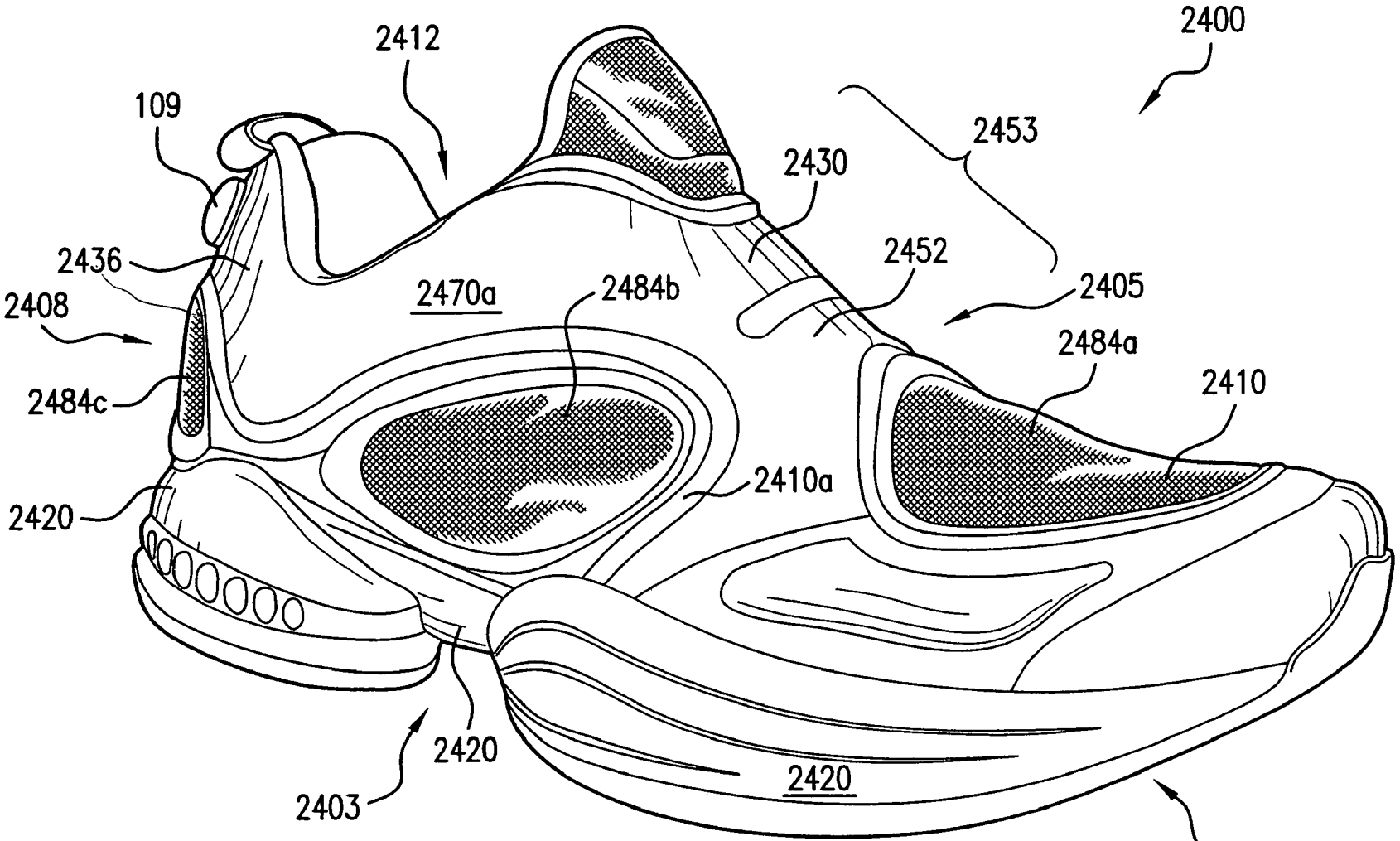
Figure 24B:
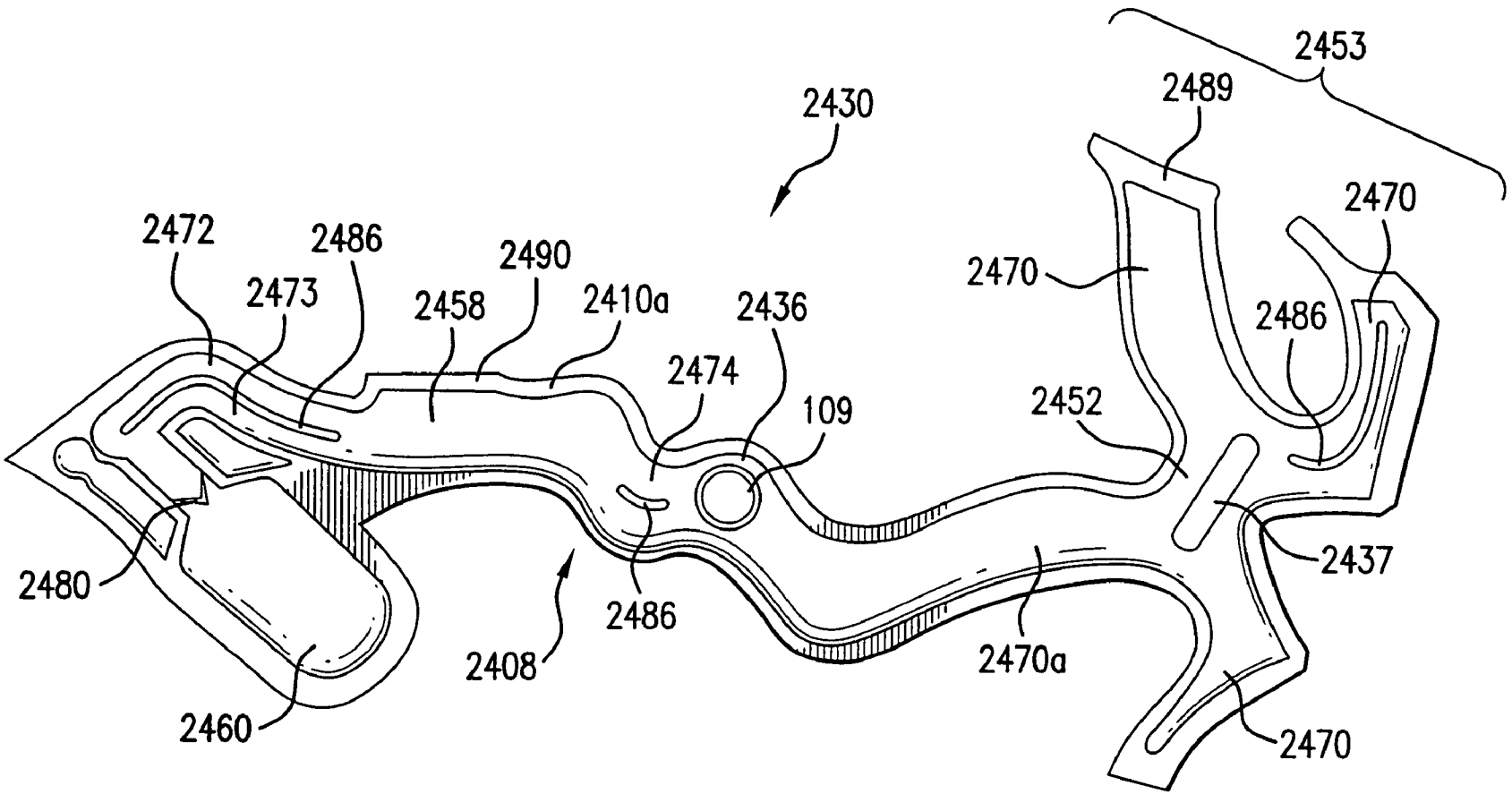
Figure 24C:
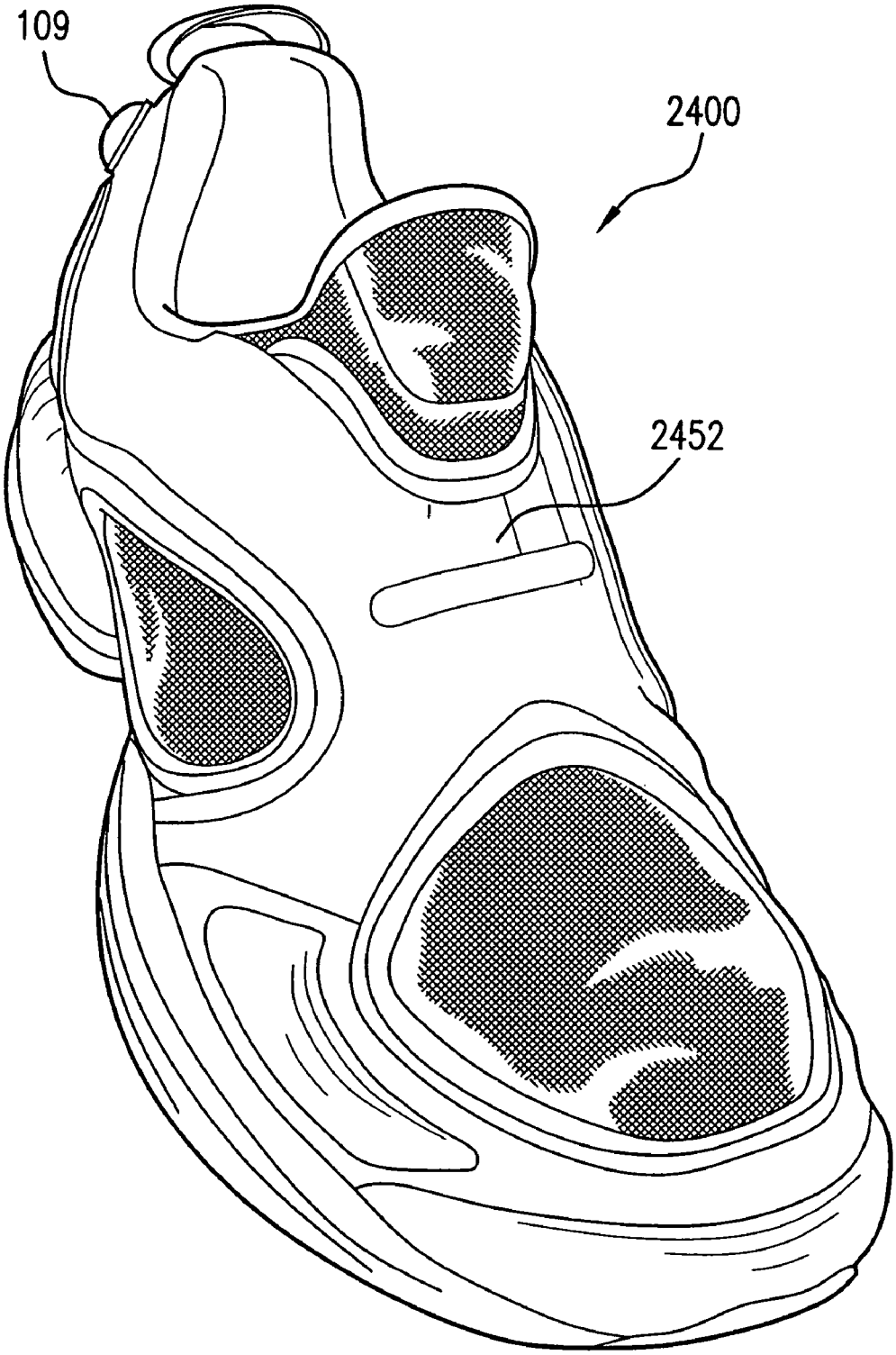
Figure 24D:
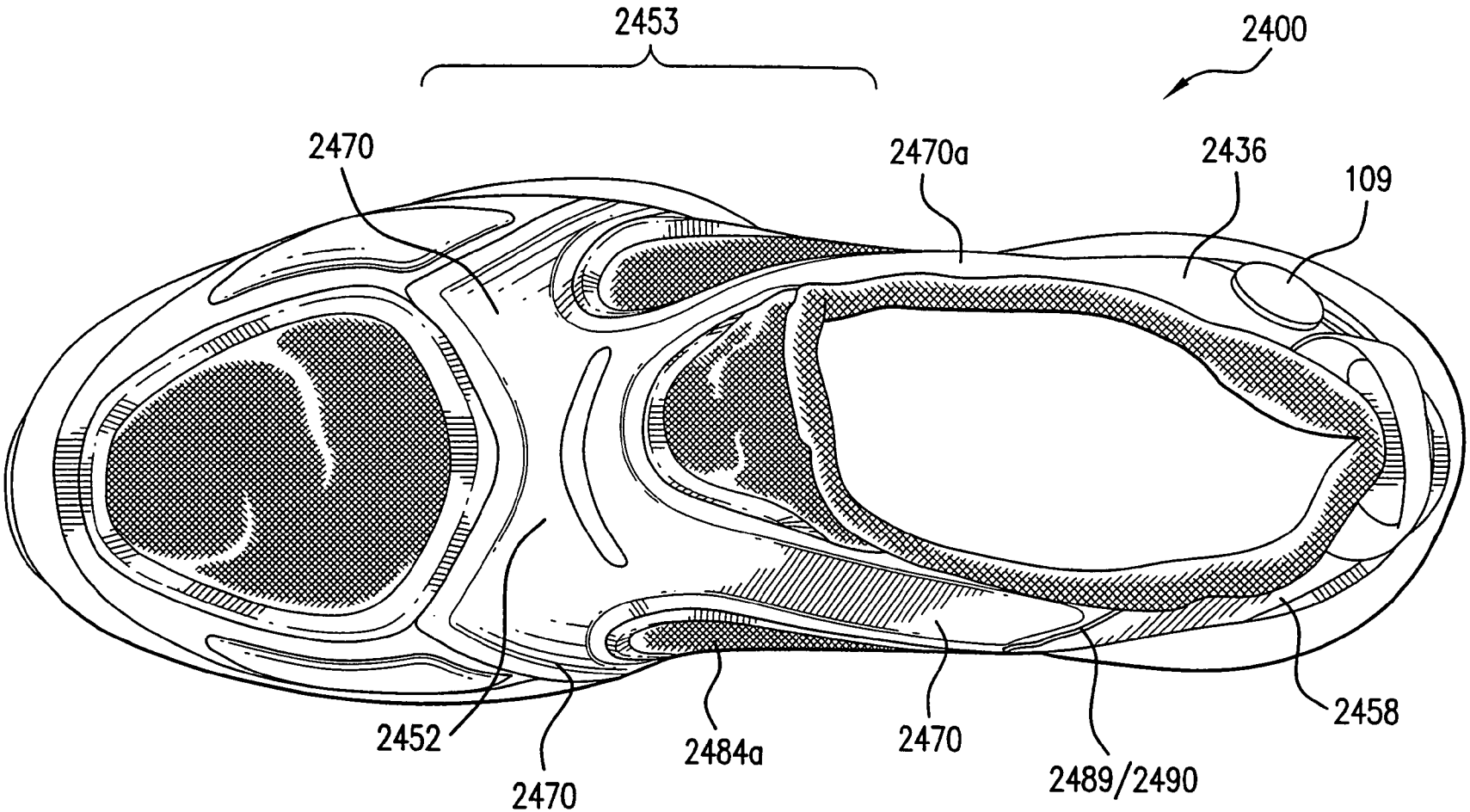
Figure 24E:
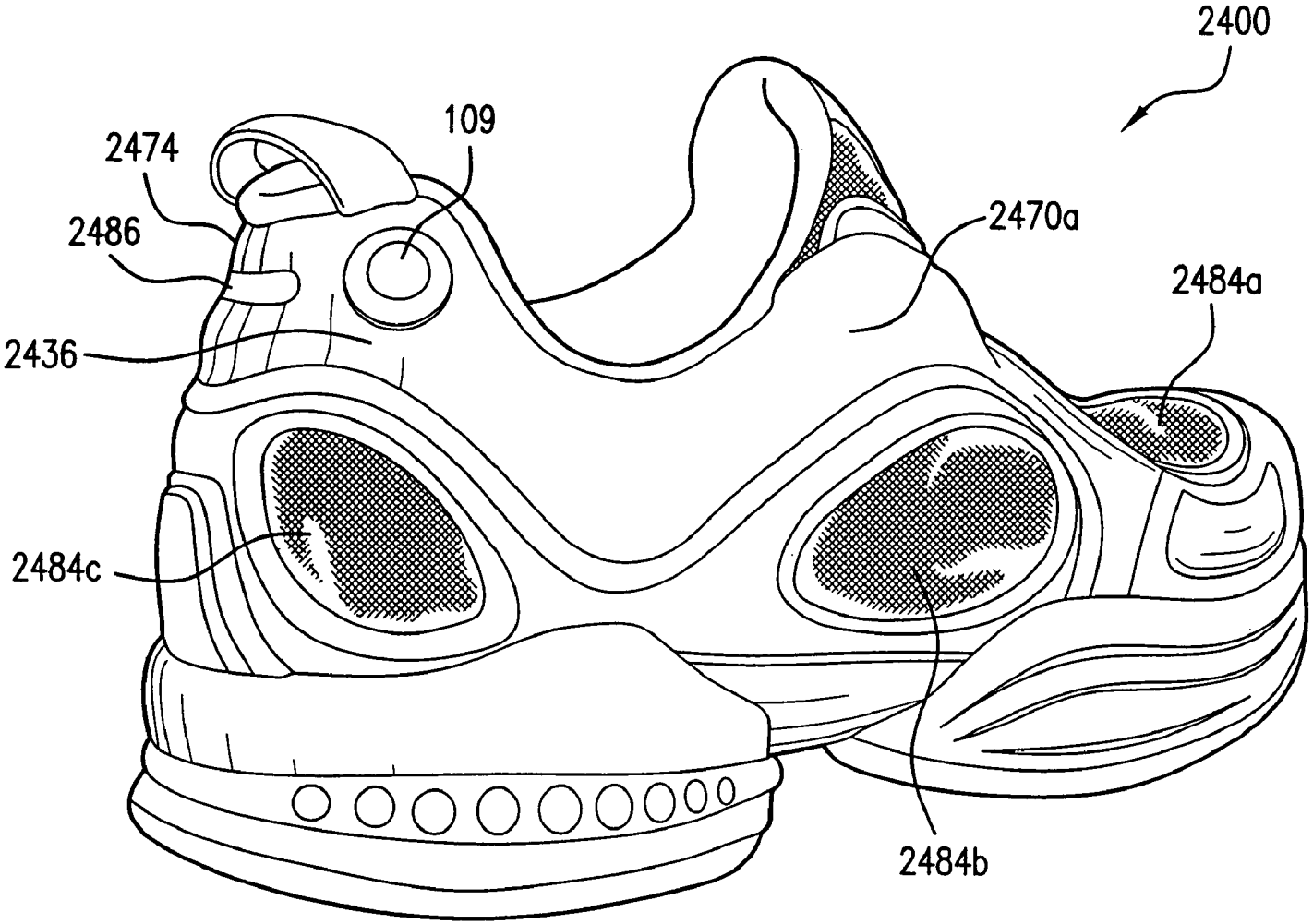

FIG. 24A is a perspective side view of another embodiment of a shoe. FIG. 24B is an above plan view of another embodiment of a bladder. FIG. 24C is another perspective front above view of the shoe of FIG. 24A. FIG. 24D is an above view of the shoe of FIG. 24A. FIG. 24E is a rear perspective view of the shoe of FIG. 24A.

Figure 25A:
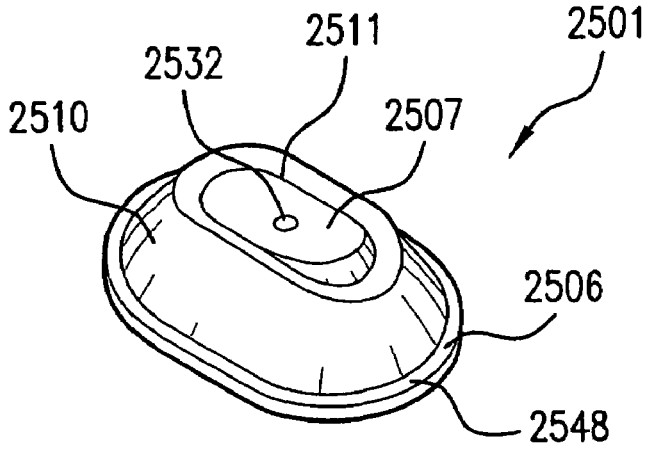
Figure 25B:
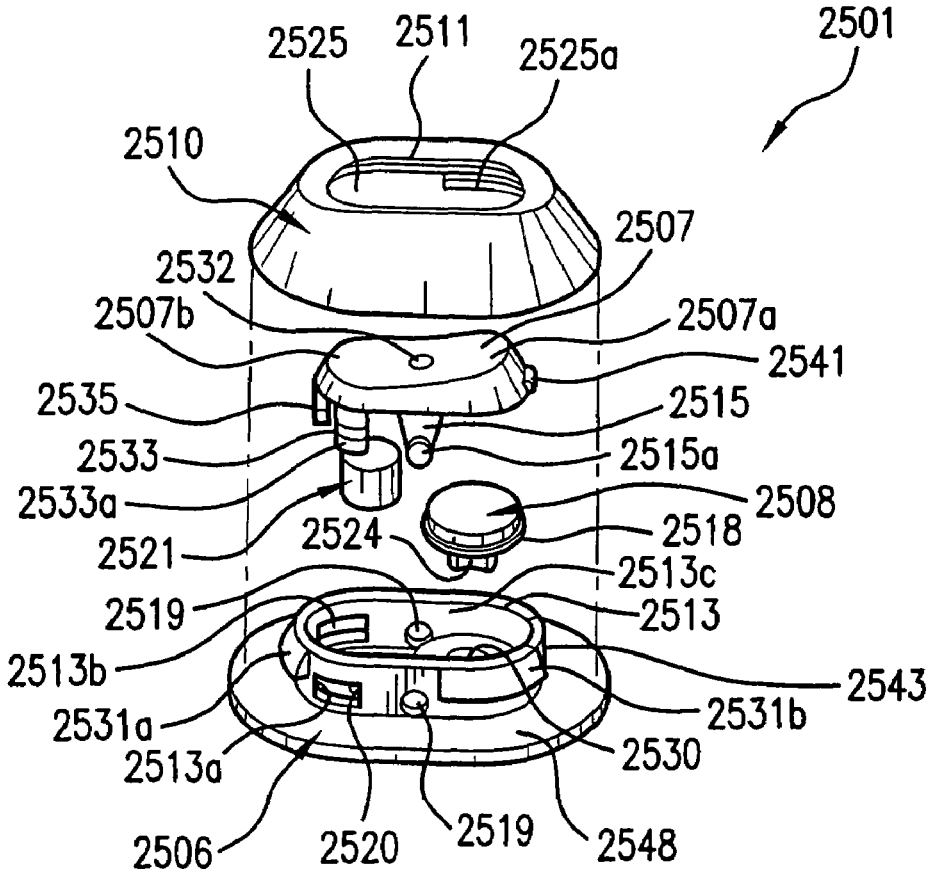
Figure 25C:
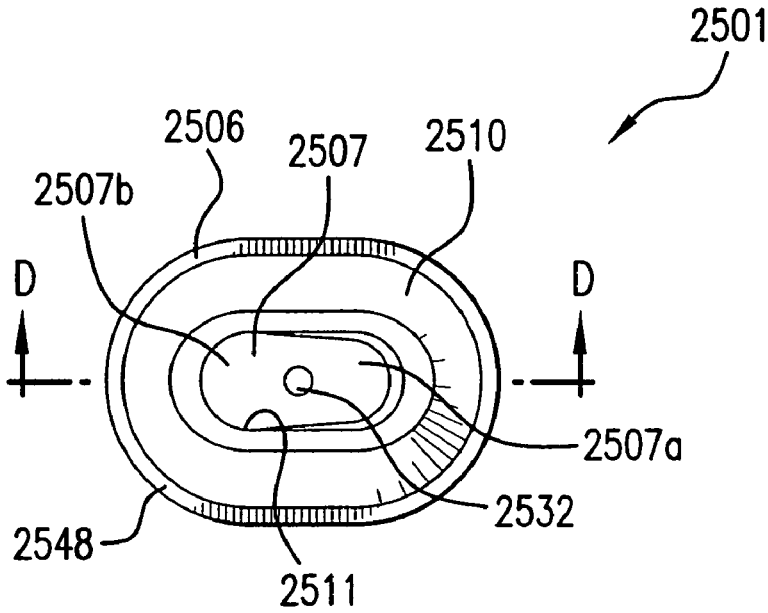
Figure 25D:
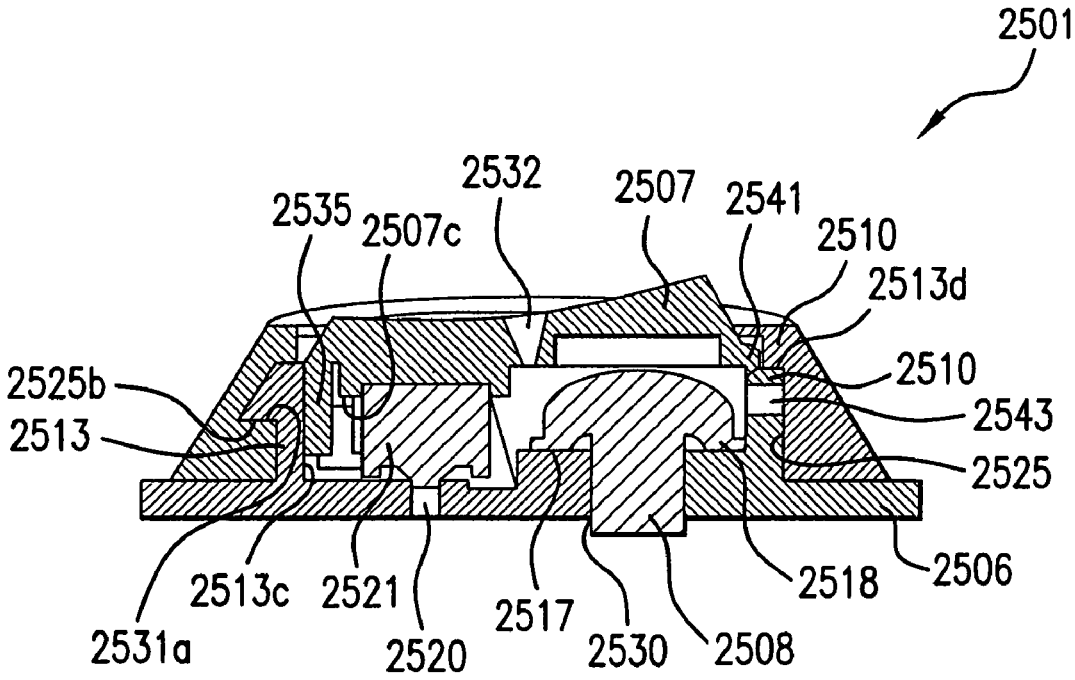
Figure 25E:
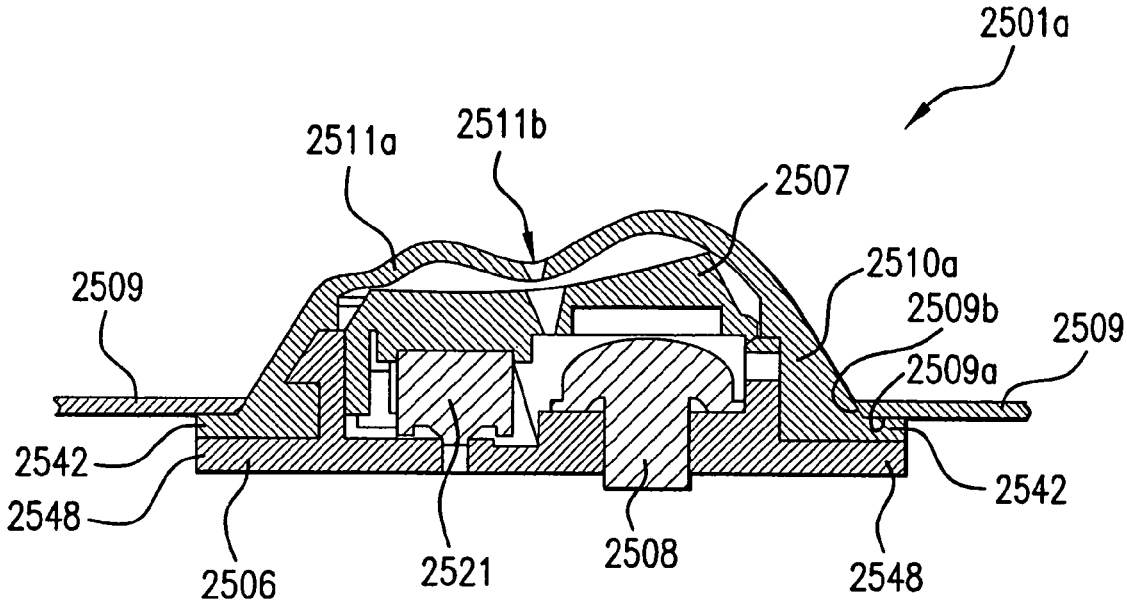
Figure 25F:
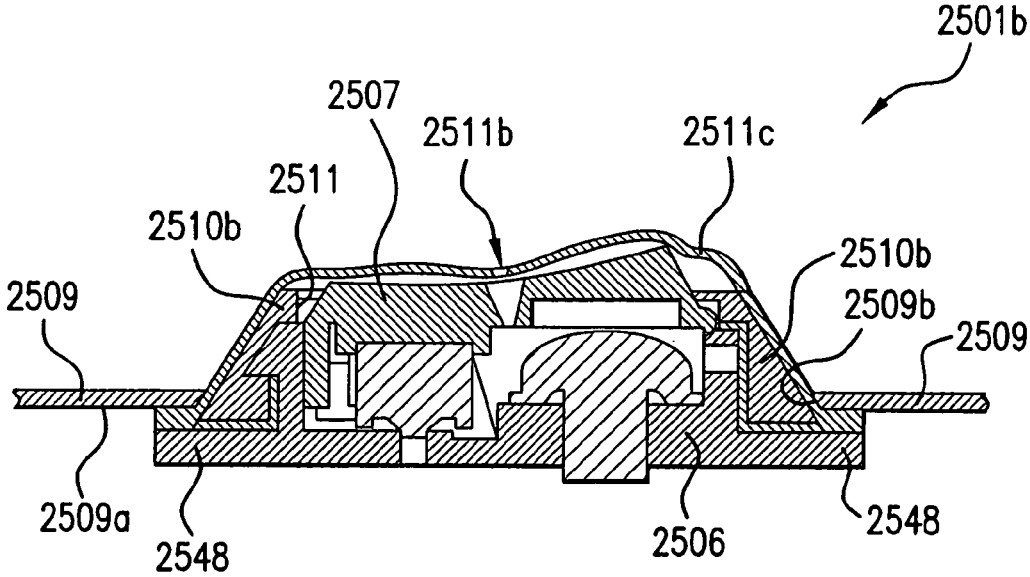

FIG. 25A is an above perspective view of another embodiment of a combination check valve and release valve. FIG. 25B is an exploded side perspective view of the combination check valve and release valve of FIG. 25A. FIG. 25C is an above plan view of the combination check valve and release valve of FIG. 25A. FIG. 25D is a cross sectional view of combination check valve and release valve along line D-D of FIG. 25C. FIG. 25E is a cross-sectional view of another embodiment of a combination check valve and release valve. FIG. 25F is a cross-sectional view of another embodiment of a combination check valve and release valve.

Figure 26A:
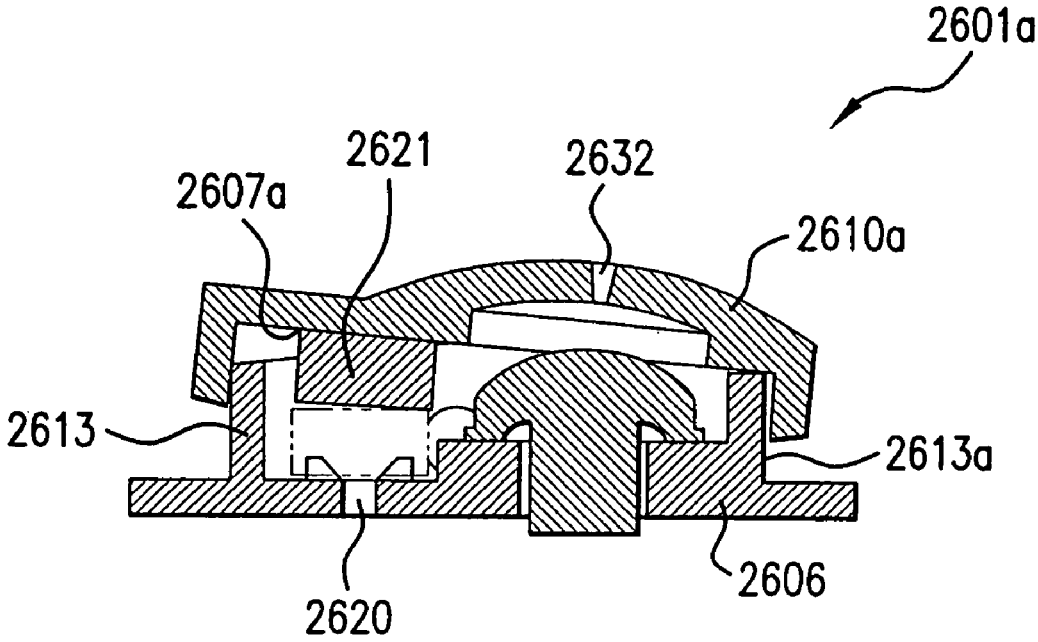
Figure 26B:
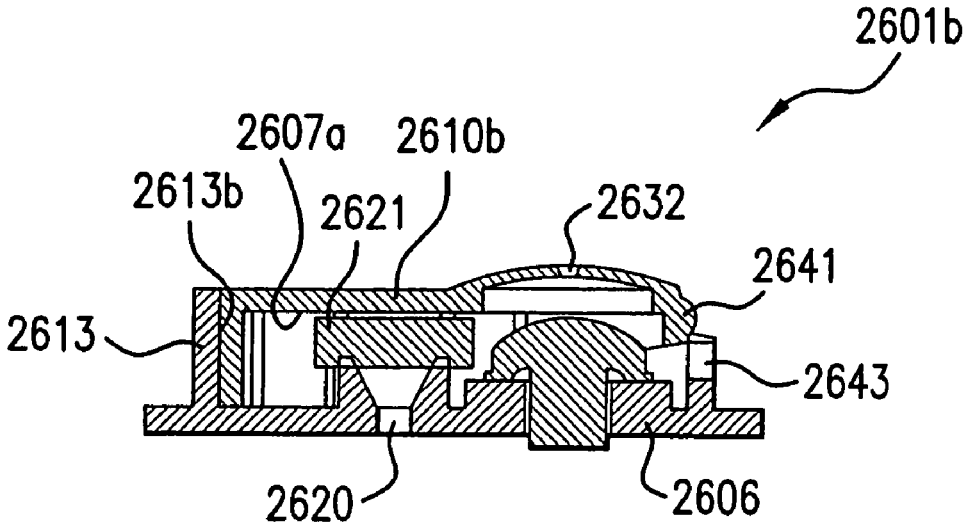

FIG. 26A is a cross sectional view of another embodiment of a combination check valve and release valve. FIG. 26B is a cross sectional view of another embodiment of a combination check valve and release valve.

Figure 27A:
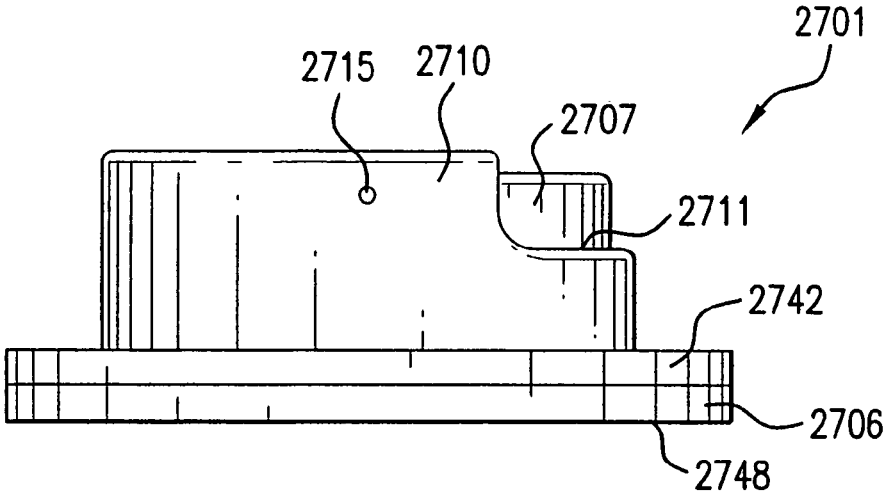
Figure 27B:
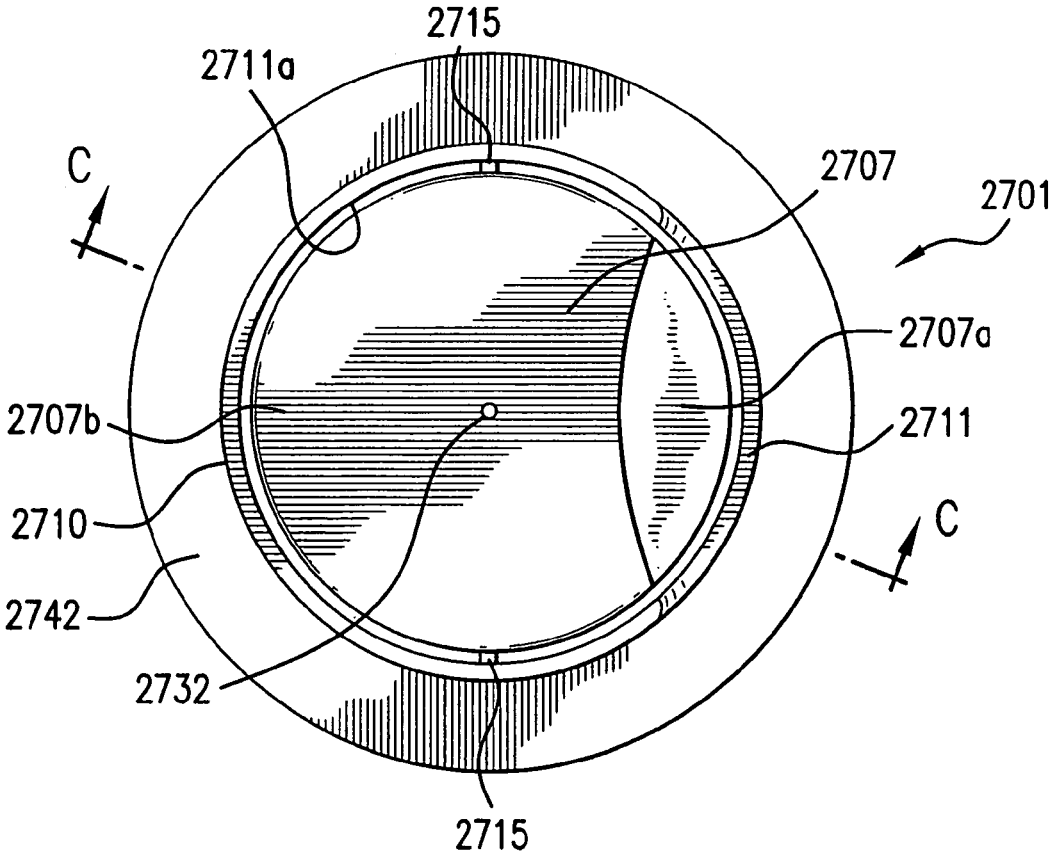
Figure 27C:
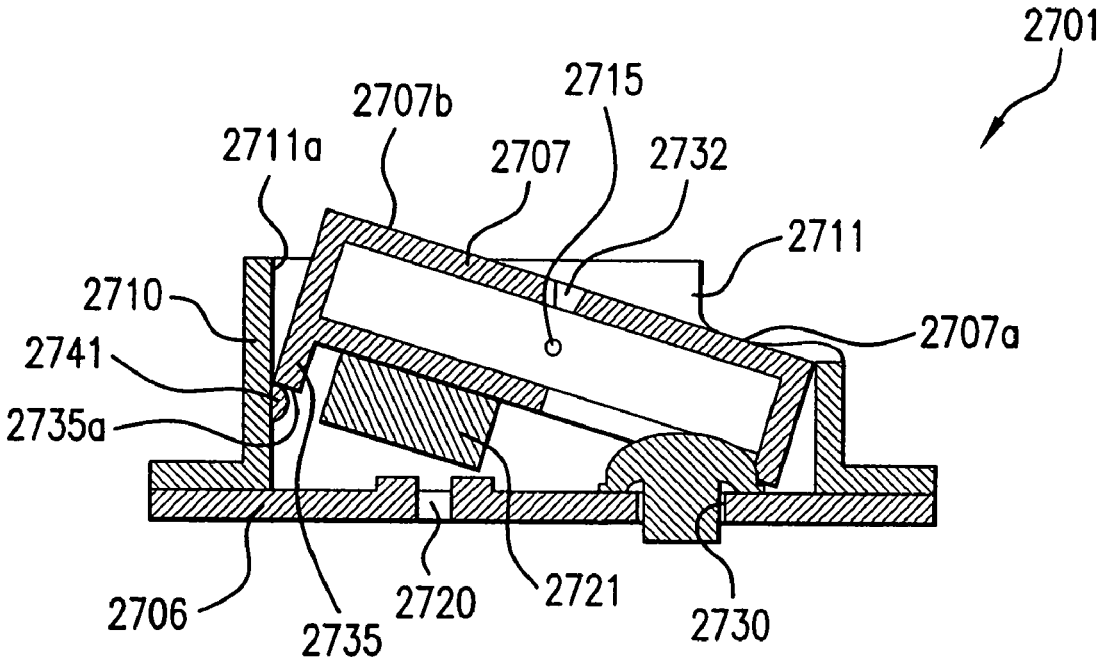
Figure 27D:
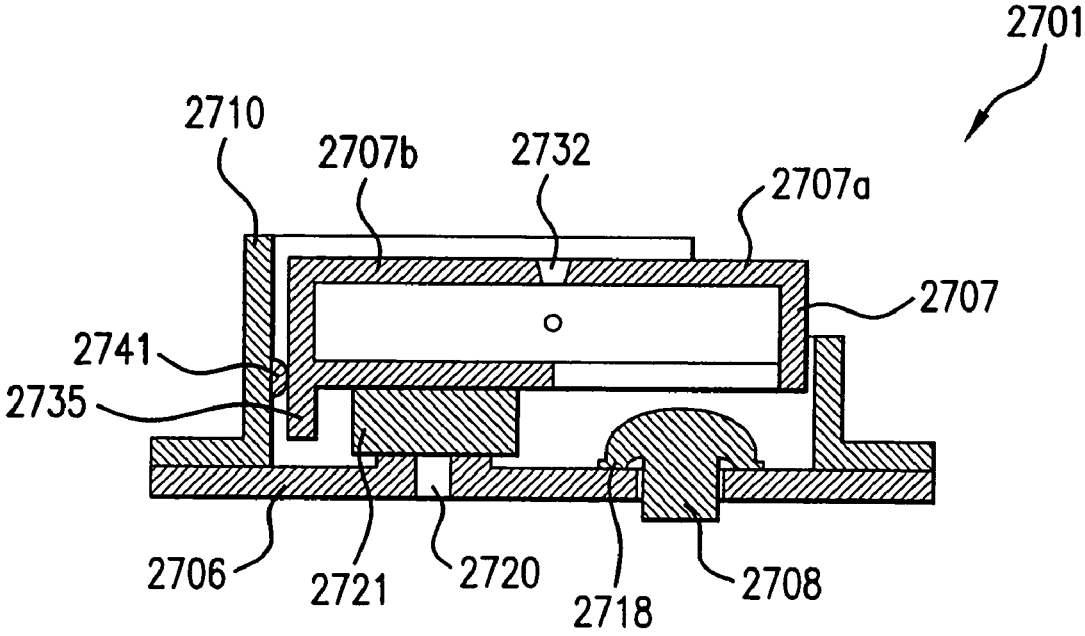

FIG. 27A is a side plan view of another combination check valve and release valve. FIG. 27B is an above plan view of the combination check valve and release valve of FIG. 27A. FIG. 27C is a cross sectional view taken along line C-C of FIG. 27B. FIG. 27D is an alternative cross-sectional view taken along line C-C of FIG. 27B.

Figure 28A:
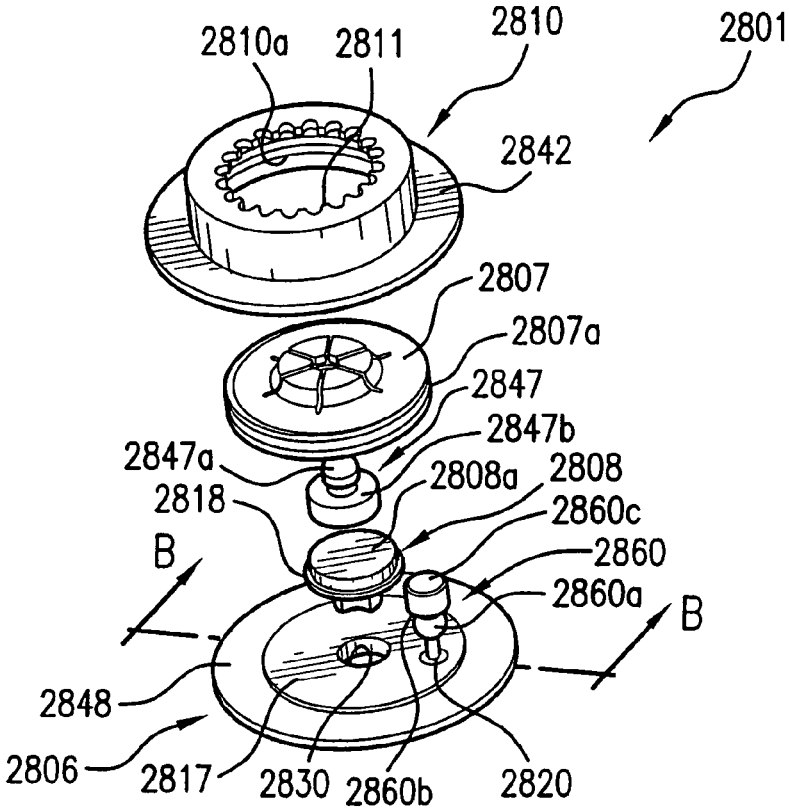
Figure 28B:
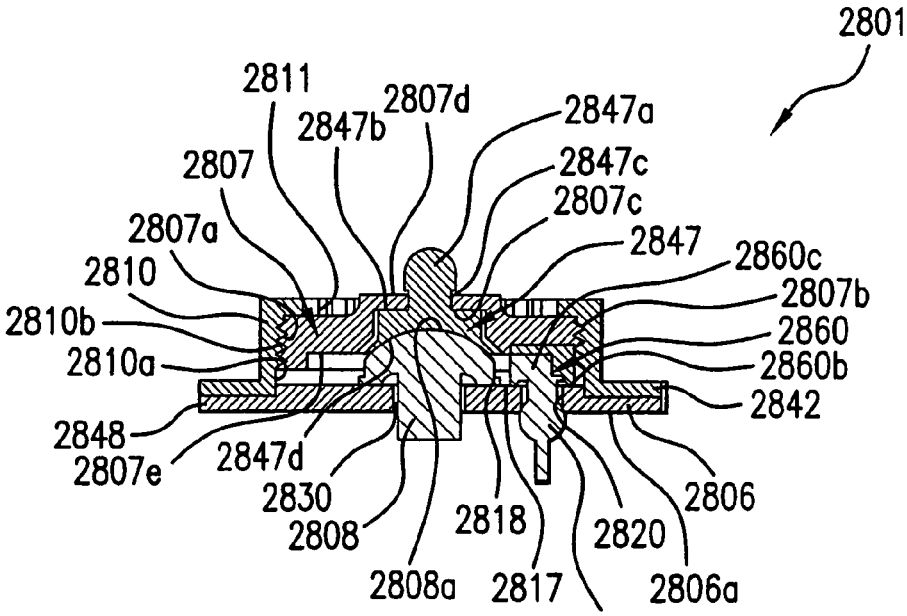

FIG. 28A is an above exploded view of another embodiment of a combination check valve and release valve. FIG. 28B is a cross sectional view taken along line B-B of FIG. 28A.

Figure 29A:
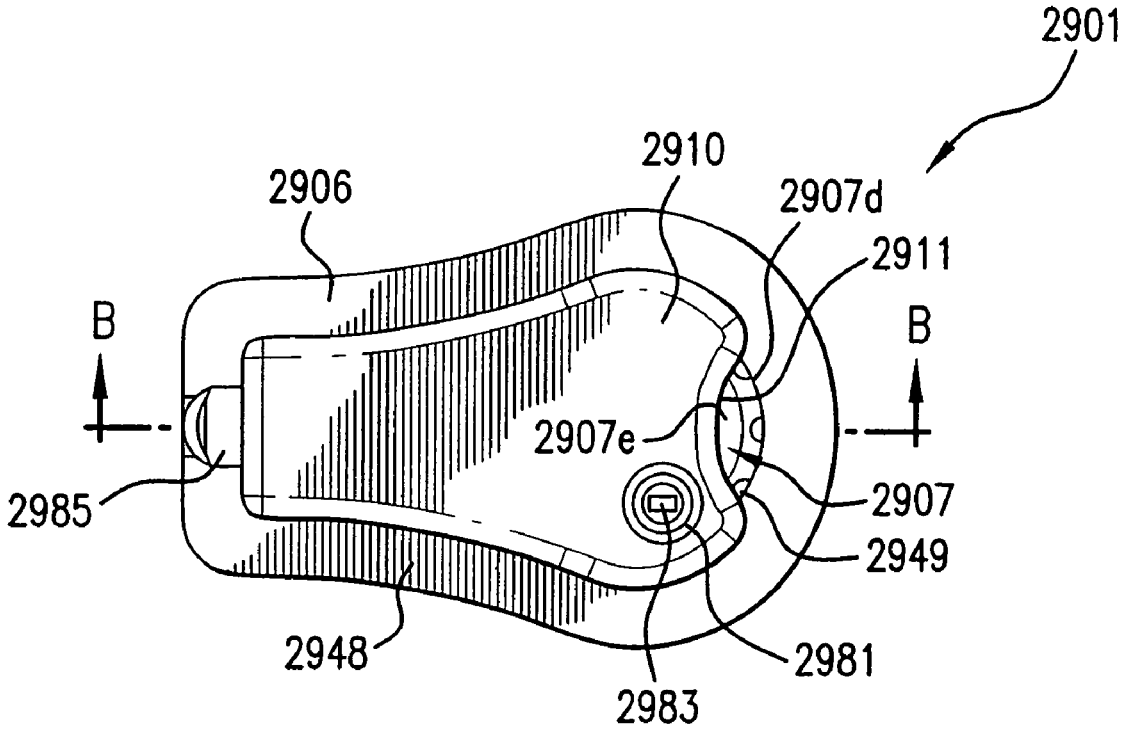
Figure 29B:
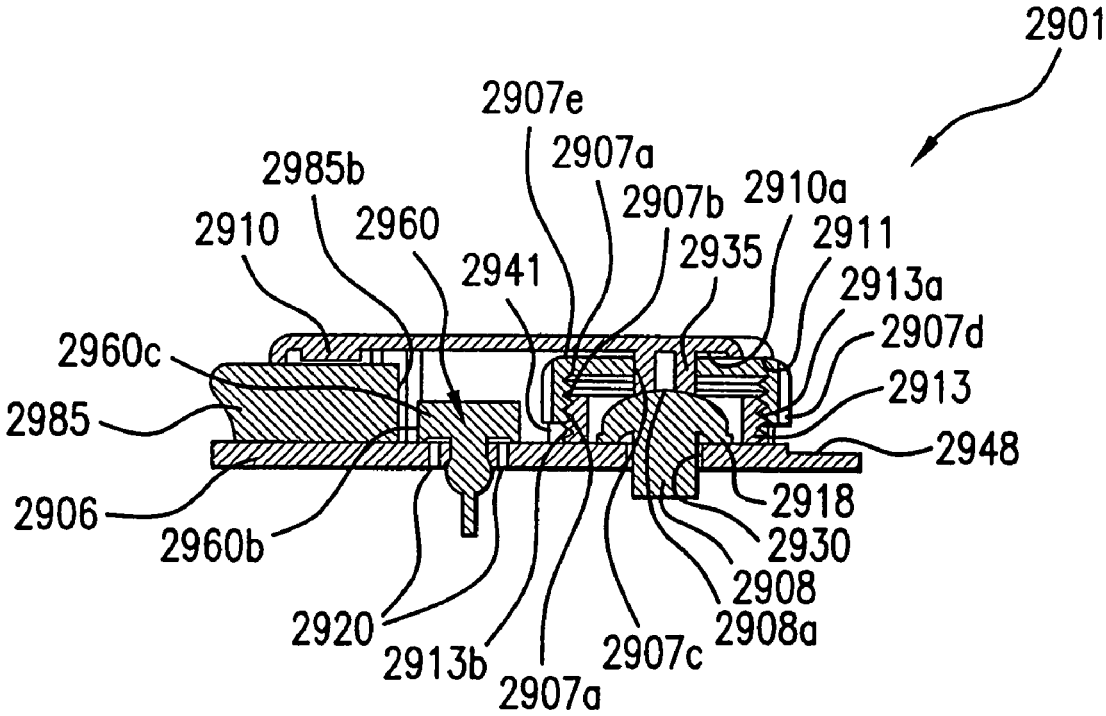
Figure 29C:
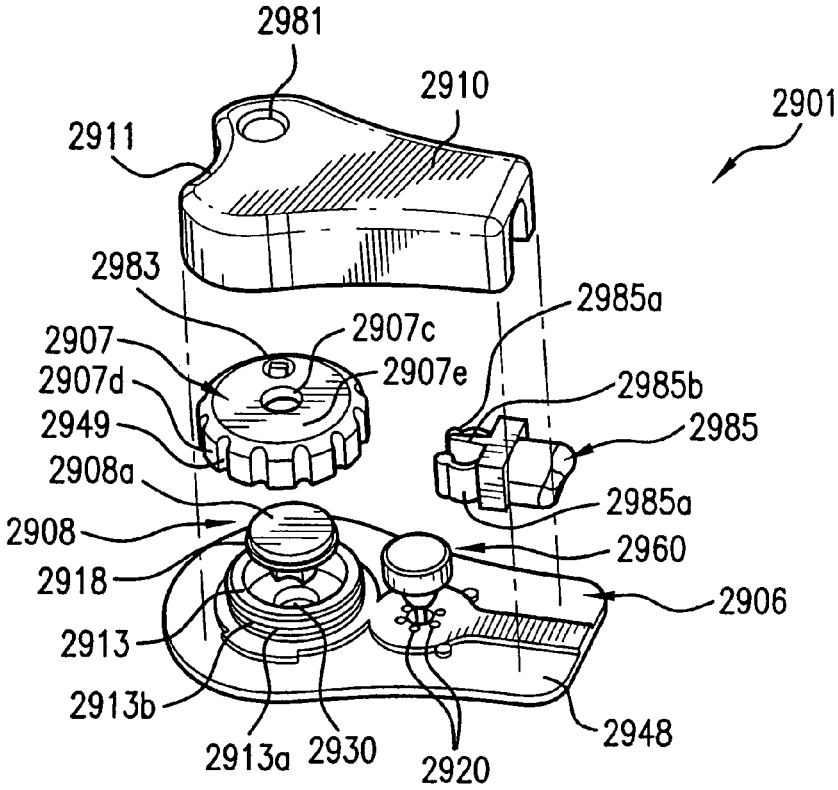
Figure 29D:
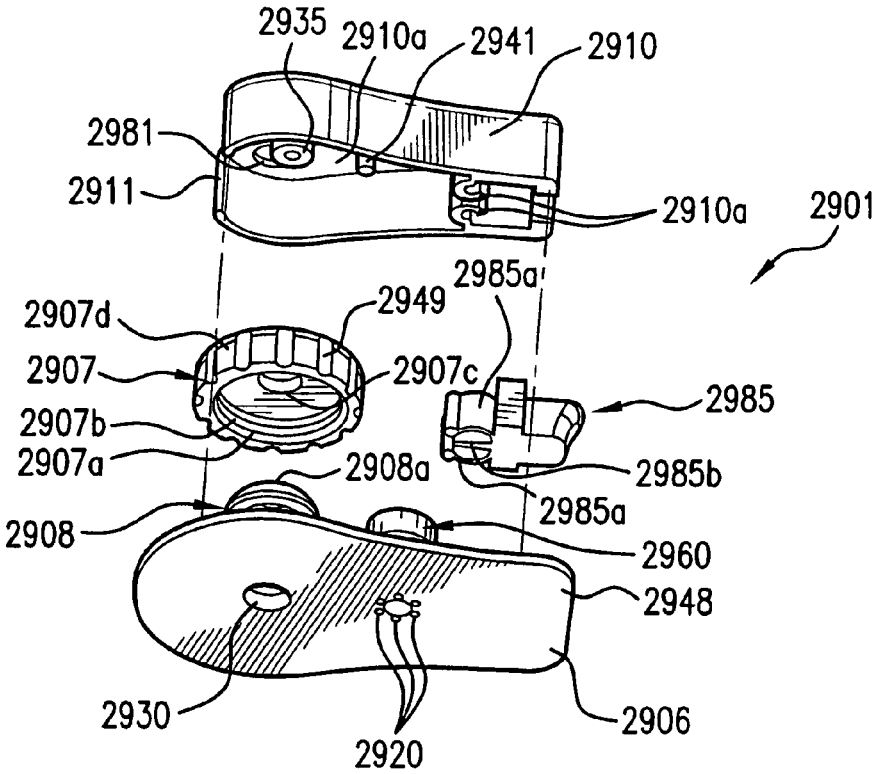

FIG. 29A is an above plan view of another embodiment of a combination check valve and release valve. FIG. 29B is a cross-sectional view taken along line B-B of FIG. 29A. FIG. 29C is an above exploded view of the combination check valve and release valve of FIG. 29A. FIG. 29D is a below exploded view of the combination check valve and release valve of FIG. 29A.

Figure 30A:
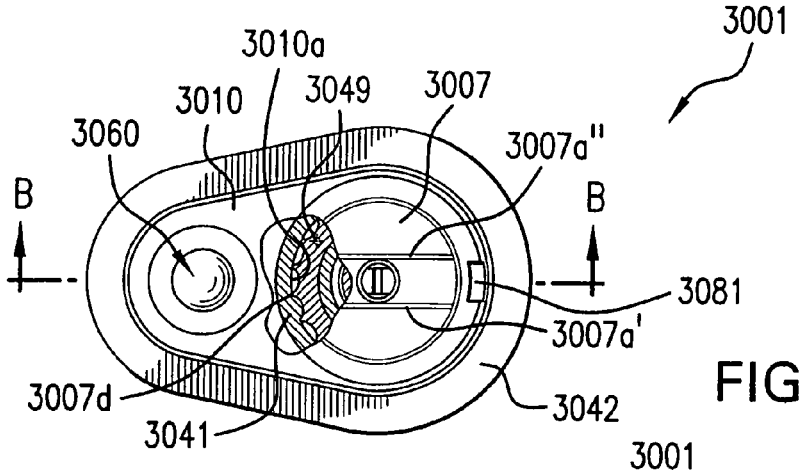
Figure 30B:
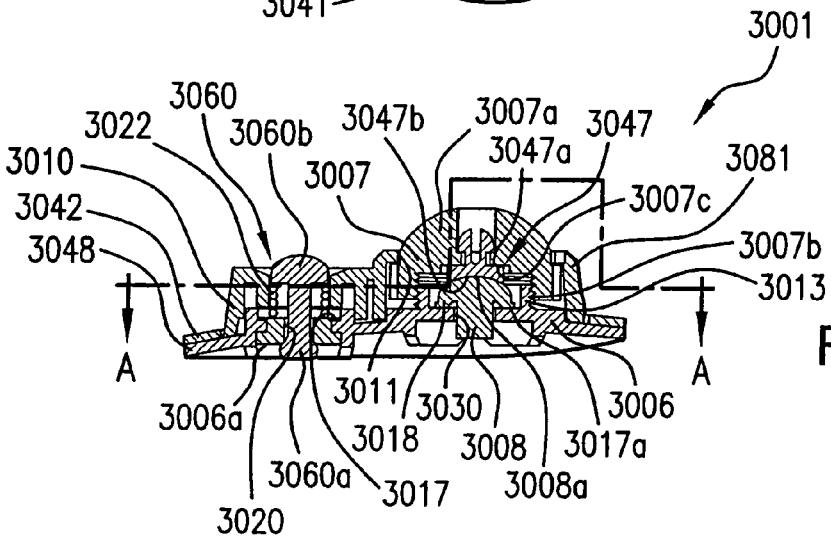
Figure 30C:
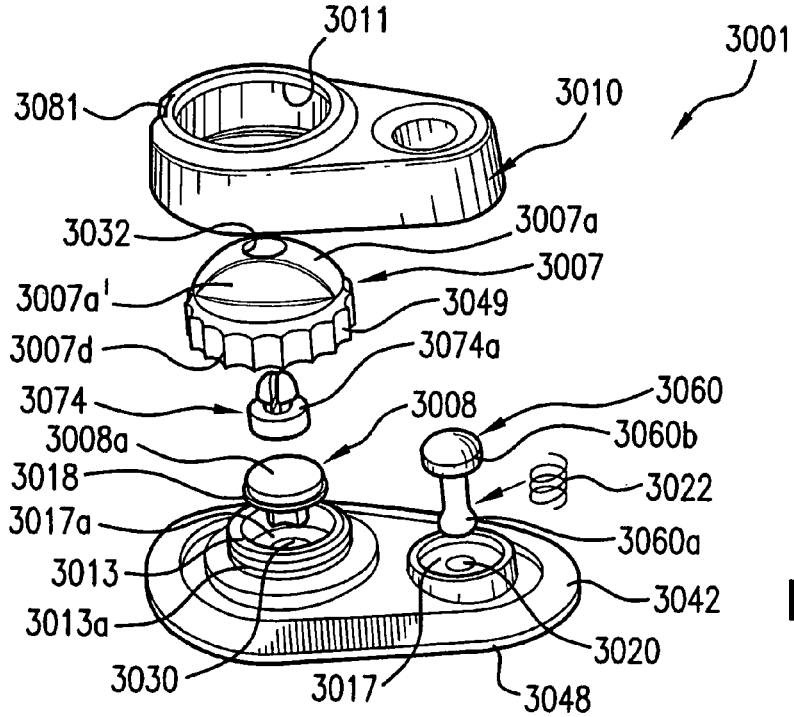
Figure 30E:
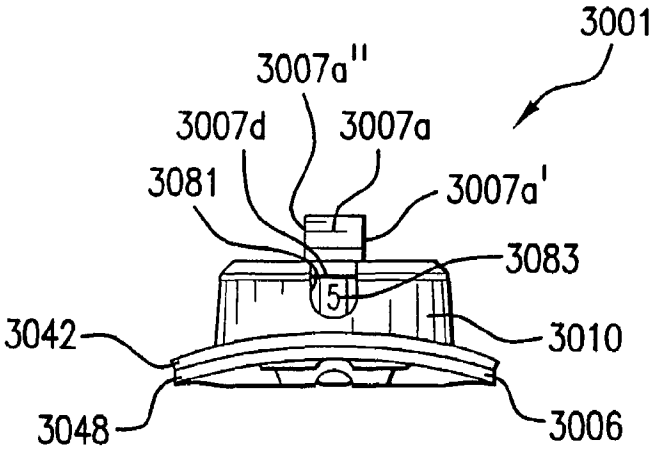

FIG. 30A is an above, partial cross sectional view of an embodiment of a combination check valve and release valve taken along a line A-A of FIG. 30B. FIG. 30B is a cross-sectional view taken along line B-B of FIG. 30A. FIG. 30C is an above exploded view of the combination check valve and release valve of FIG. 30A. FIG. 30D is a below exploded view of the combination check valve and release valve of FIG. 30A. FIG. 30E is a front plan view of the combination check valve and release valve of FIG. 30A. FIG. F is a side plan view of the combination check valve and release valve of FIG. 30A.

Figure 31A:
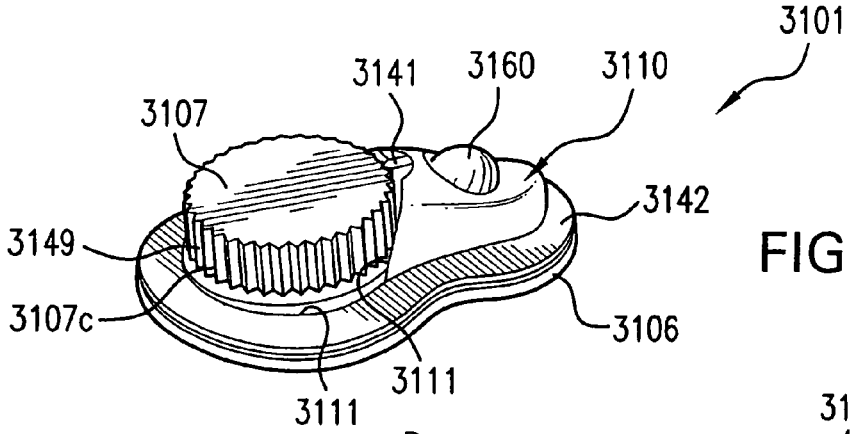
Figure 31B:
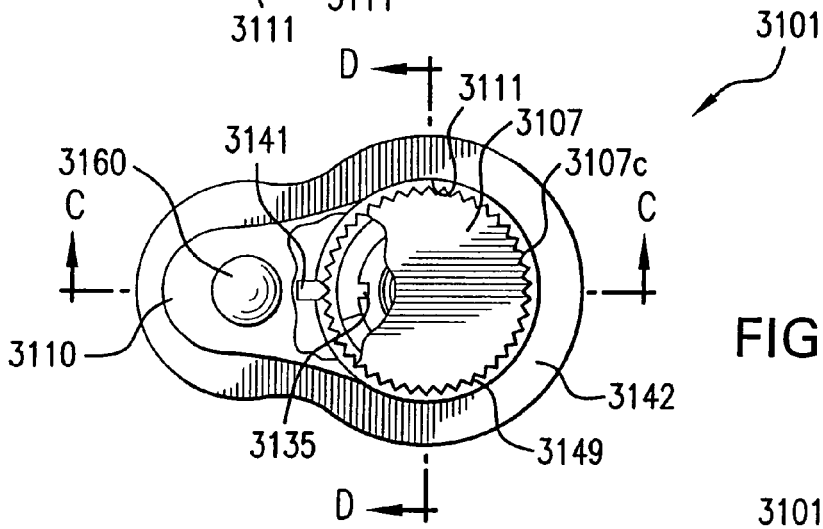
Figure 31C:
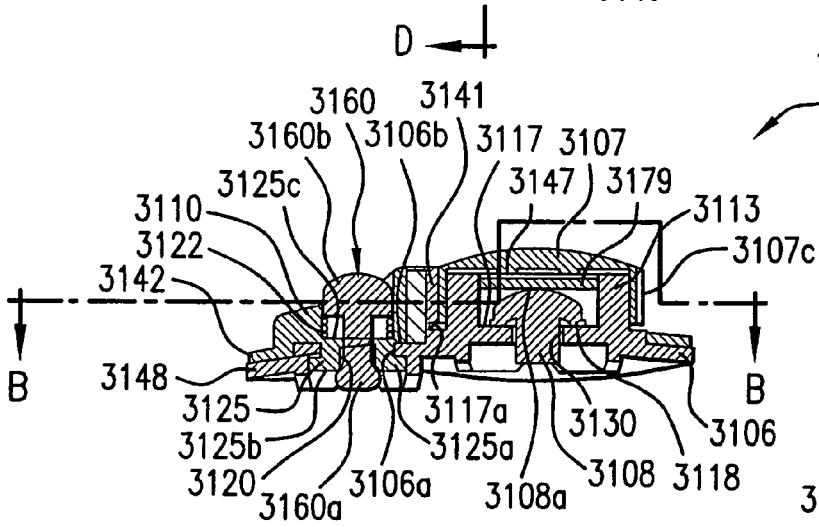
Figure 31D:
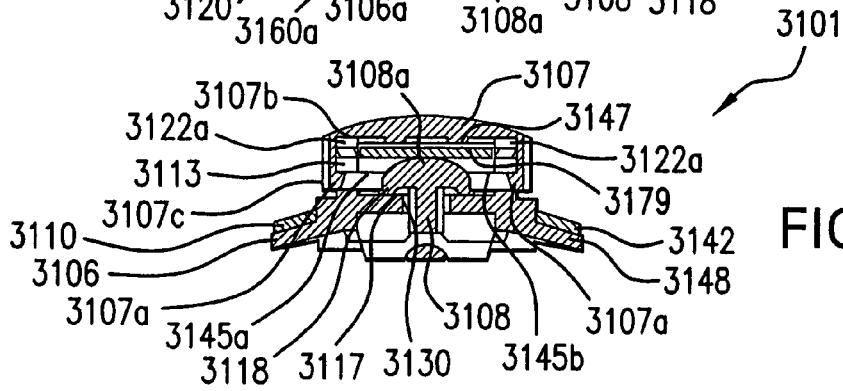
Figure 31F:
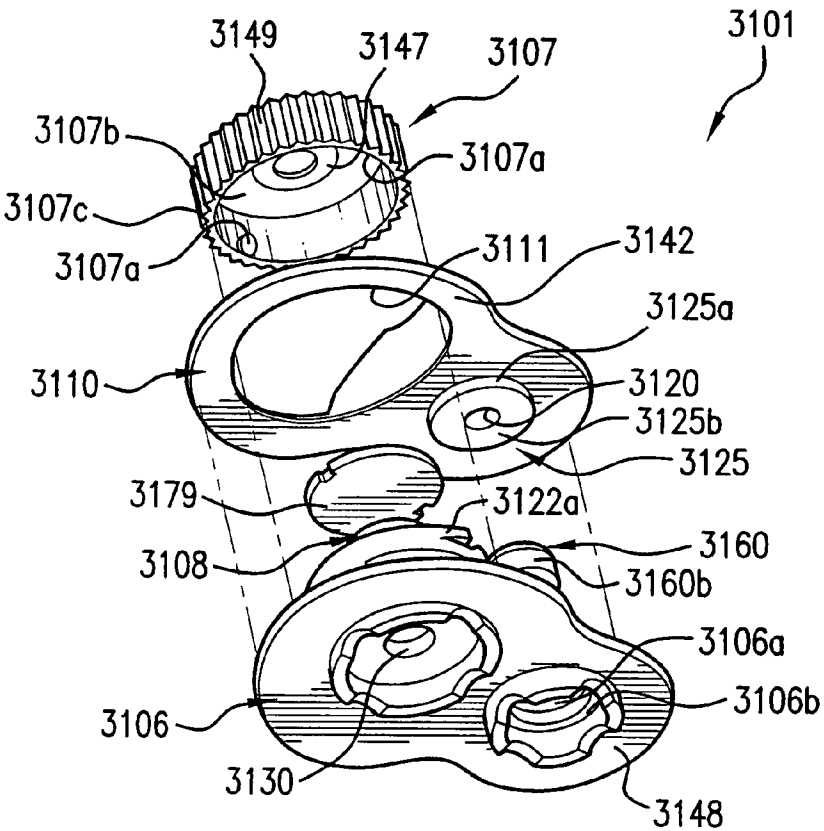
Figure 31E:
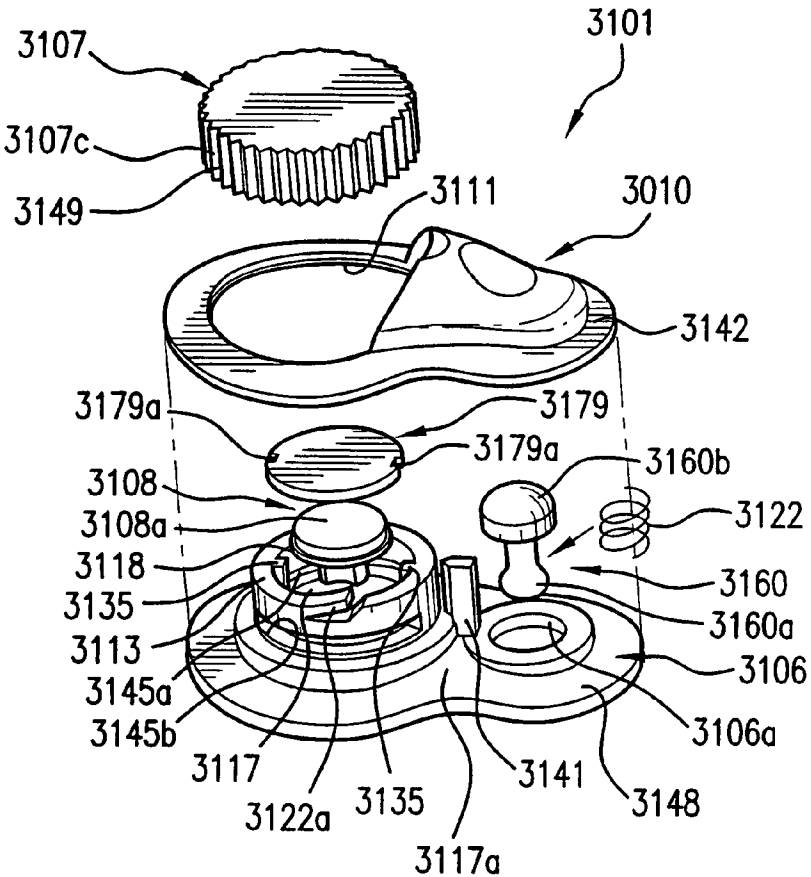

FIG. 31A is an above perspective view of an embodiment of a combination check valve and release valve. FIG. 31B is an above partial cross-sectional view of the combination check valve and release valve of FIG. 31A taken along line B-B of FIG. 31C. FIG. 31C is a cross-sectional view taken along line C-C of FIG. 31B. FIG. 31D is a cross-sectional view taken along line D-D of FIG. 31B. FIG. 31E is an above exploded view of the combination check valve and release valve of FIG. 31A. FIG. 31F is a below exploded view of the combination check valve and release valve of FIG. 31A.

Figure 32A:
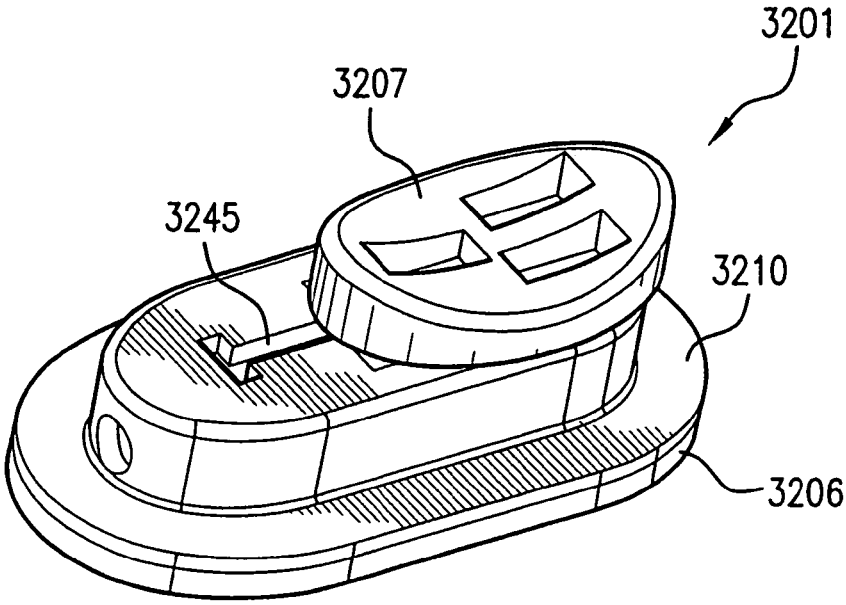
Figure 32B:
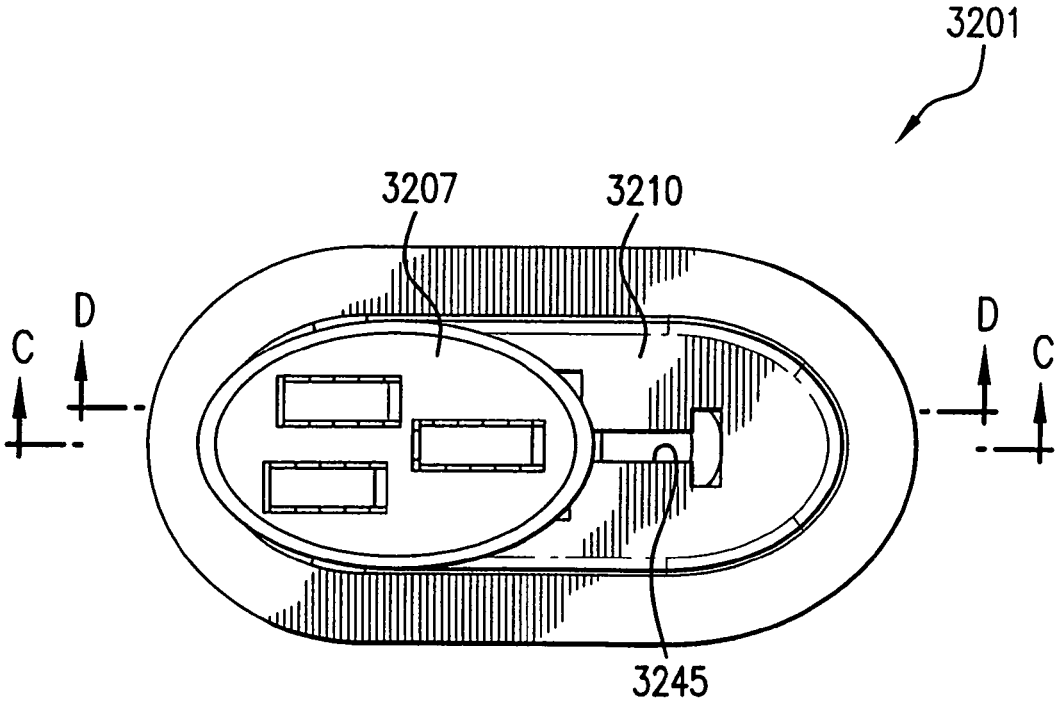
Figure 32C:
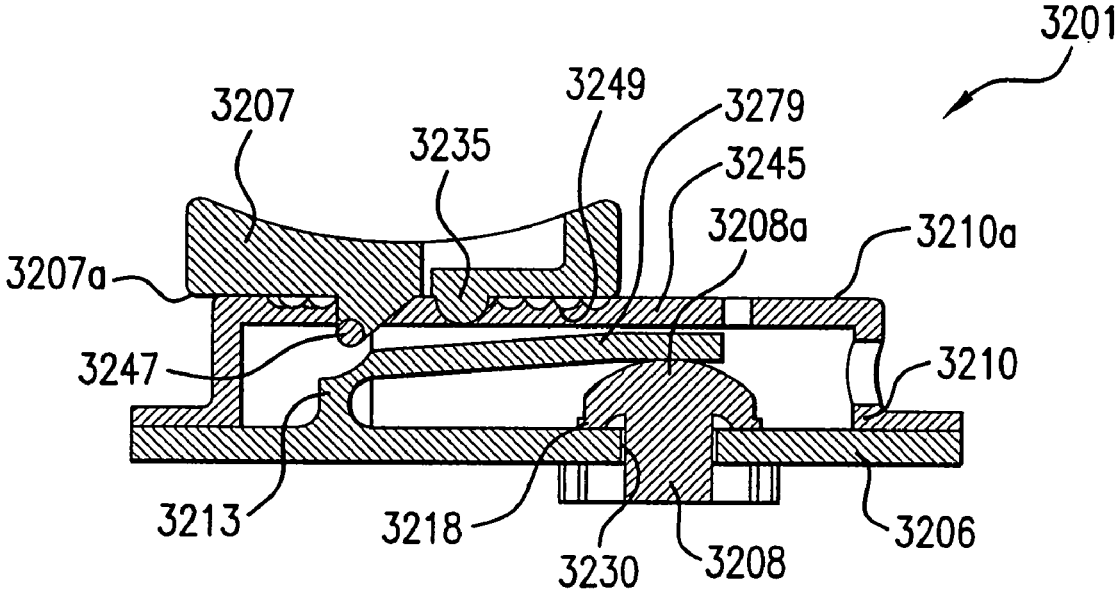
Figure 32D:
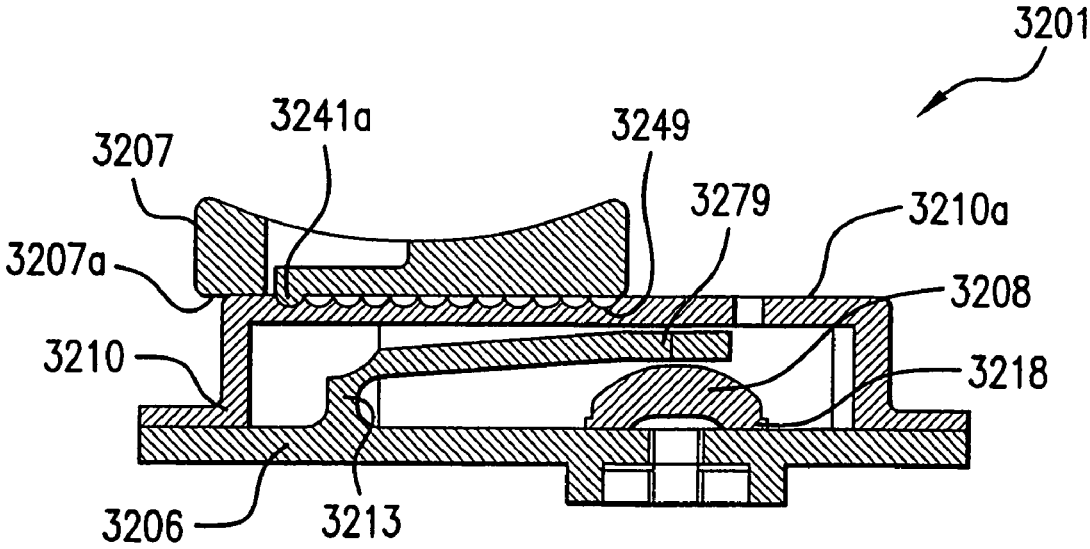
Figure 32E:
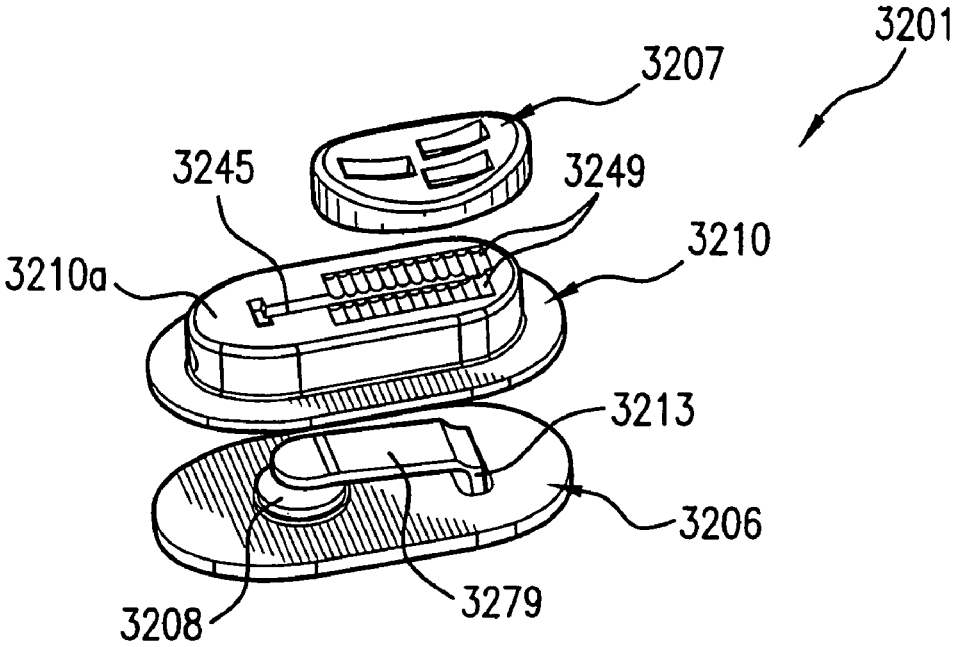
Figure 32F:
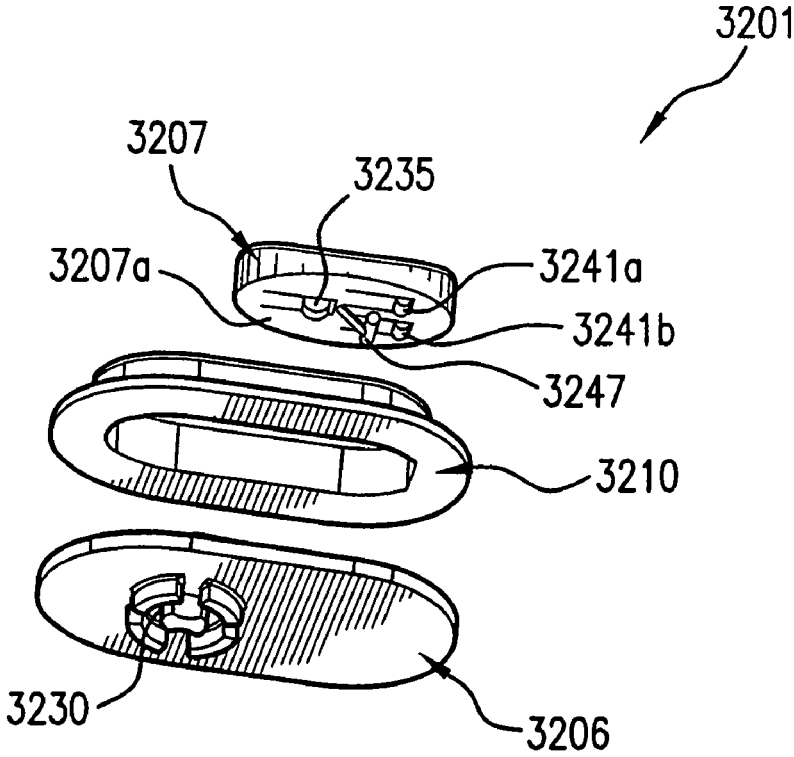

FIG. 32A is an above perspective view of an embodiment of an adjustable check valve. FIG. 32B is an above plan view of the adjustable check valve of FIG. 32A. FIG. 32C is a cross sectional view along line C-C of FIG. 32B. FIG. 32D is a cross sectional view along line D-D of FIG. 32B. FIG. 32E is an above exploded view of the adjustable check valve of FIG. 32A. FIG. 32F is a below exploded view of the adjustable check valve of FIG. 32A.

Figure 33A:
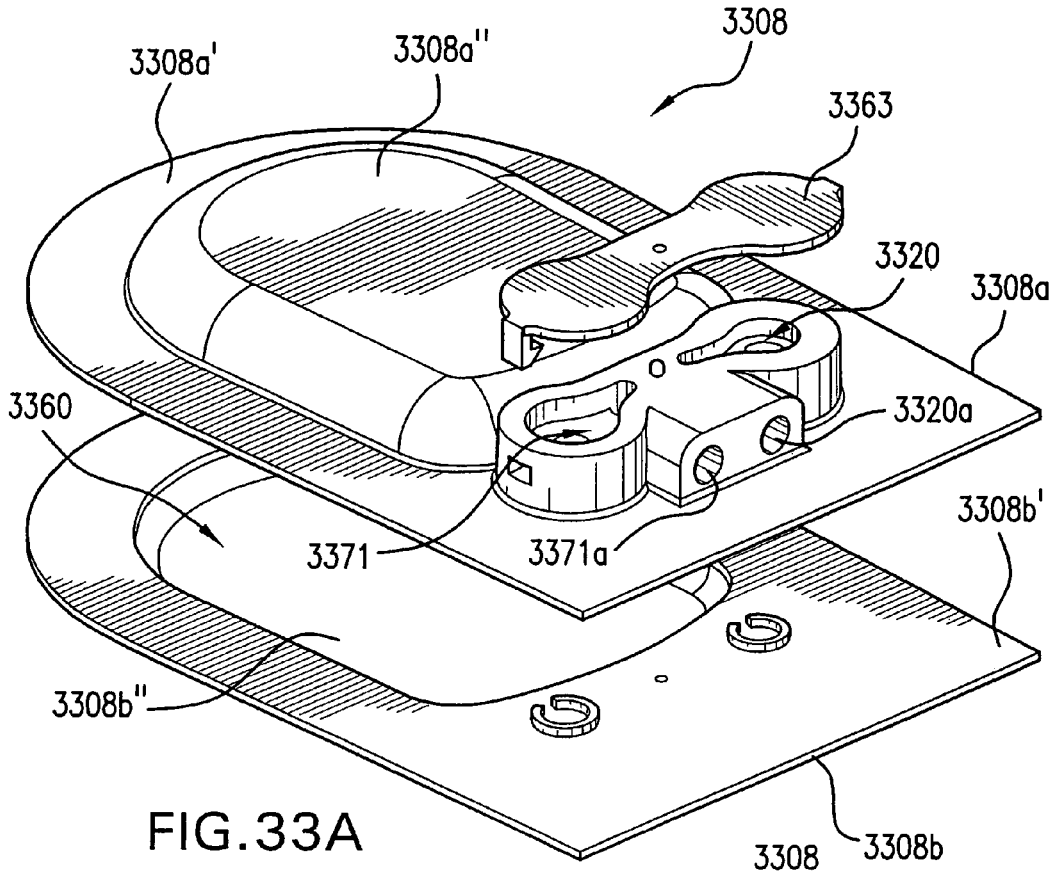
Figure 33B:
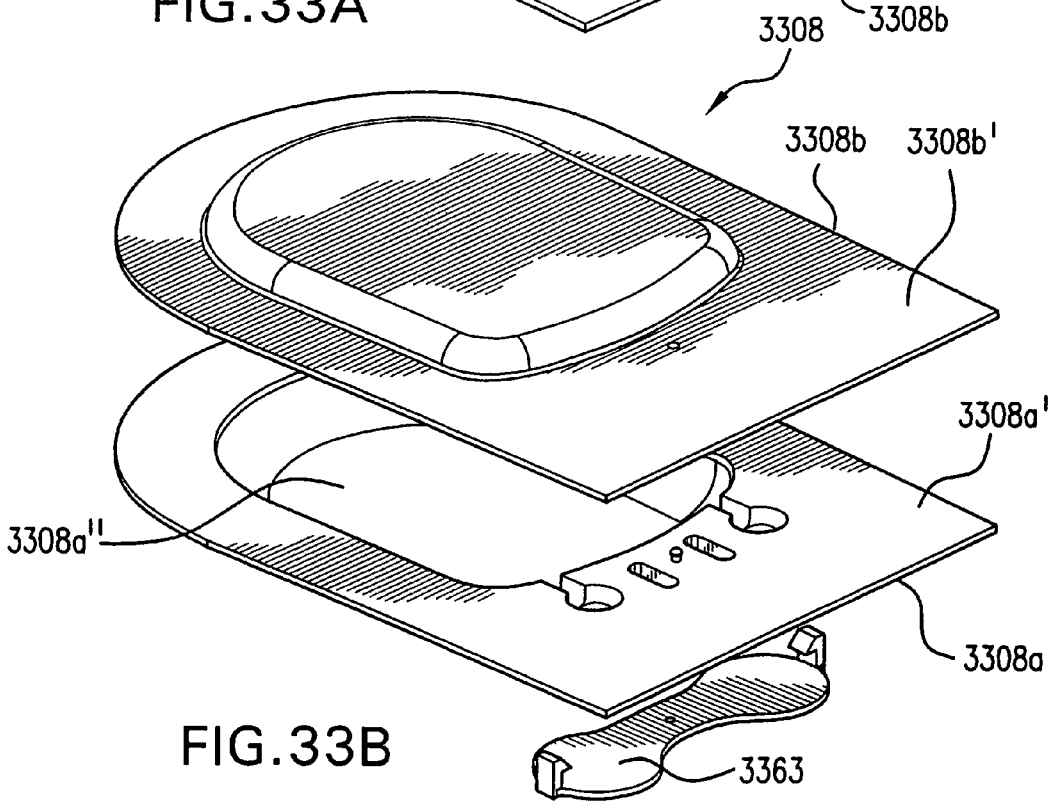

FIG. 33A is a below exploded view of a satellite inflation mechanism. FIG. 33B is an above exploded view of the satellite inflation mechanism of FIG. 33A.

Figure 34A:
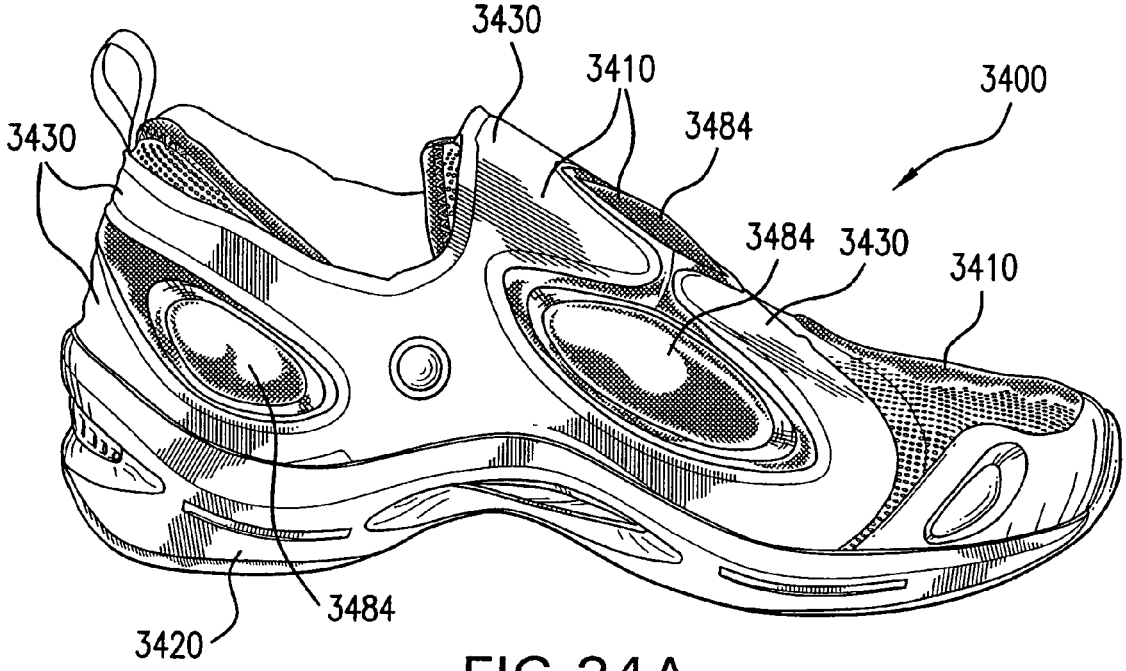
Figure 34B:
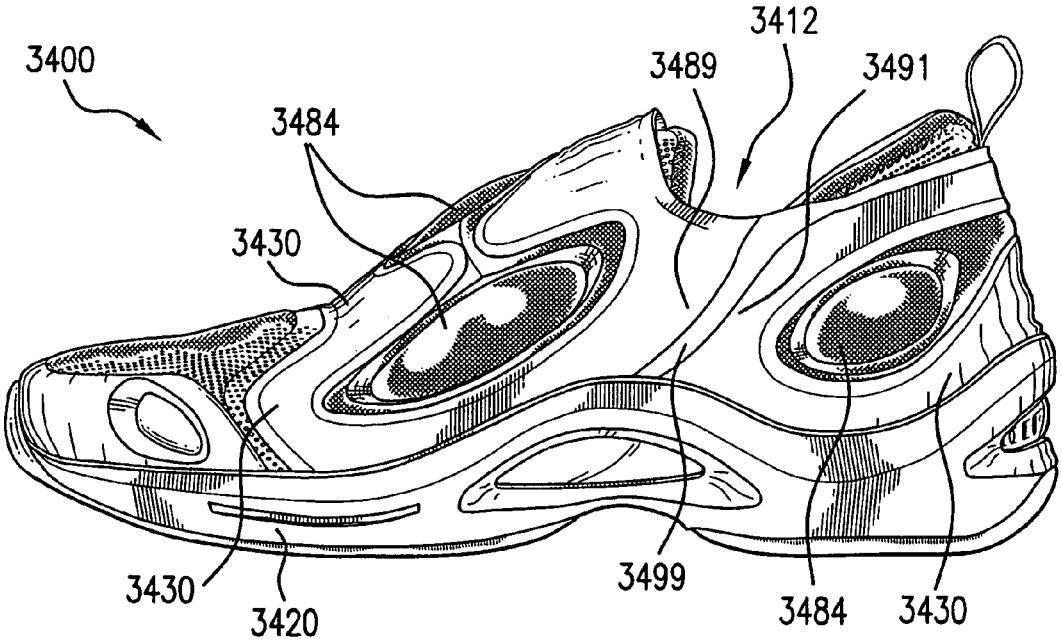
Figure 34C:
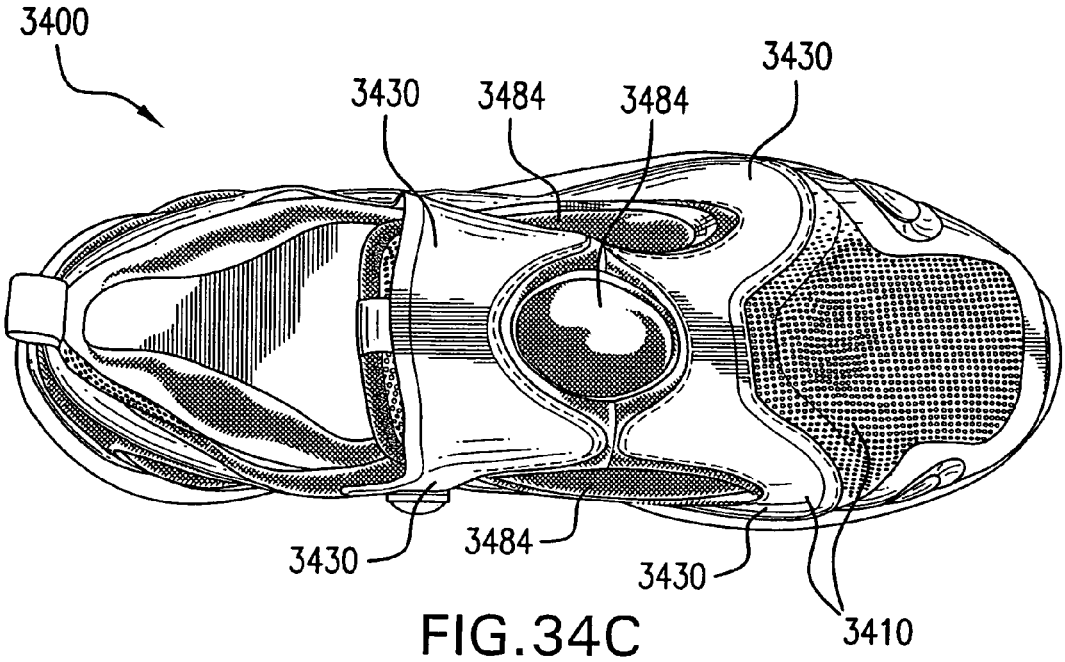
Figure 34D:
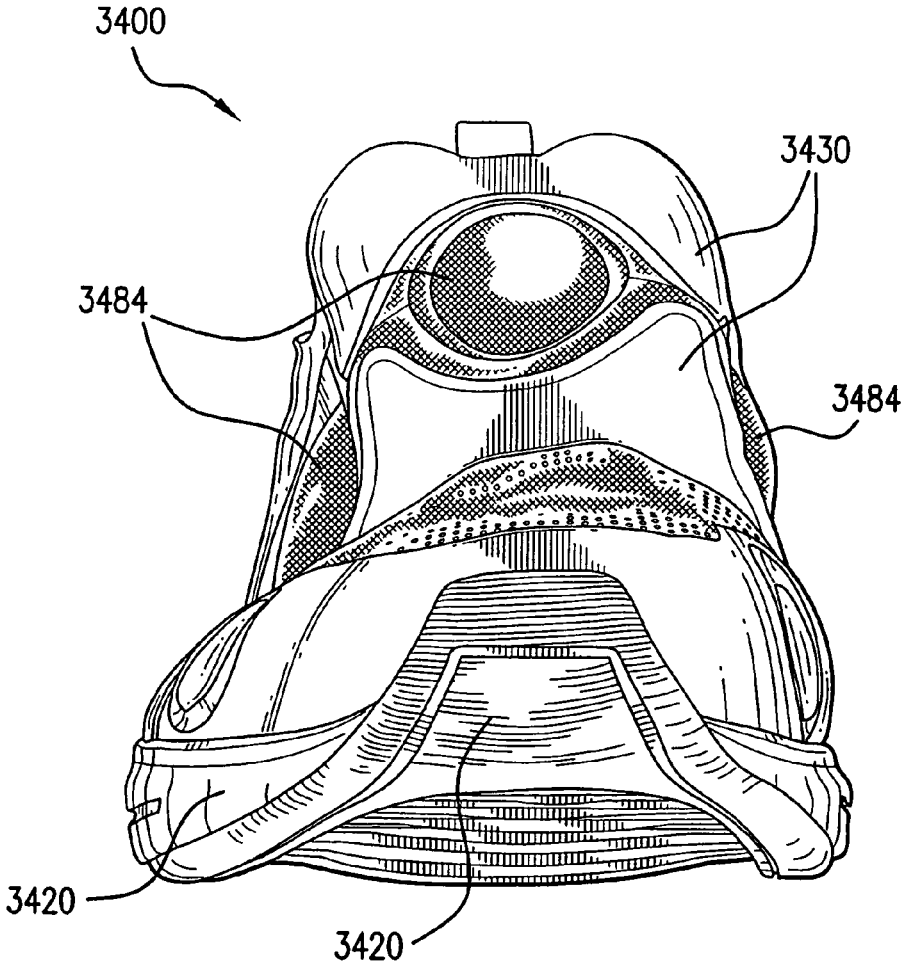
Figure 34E:
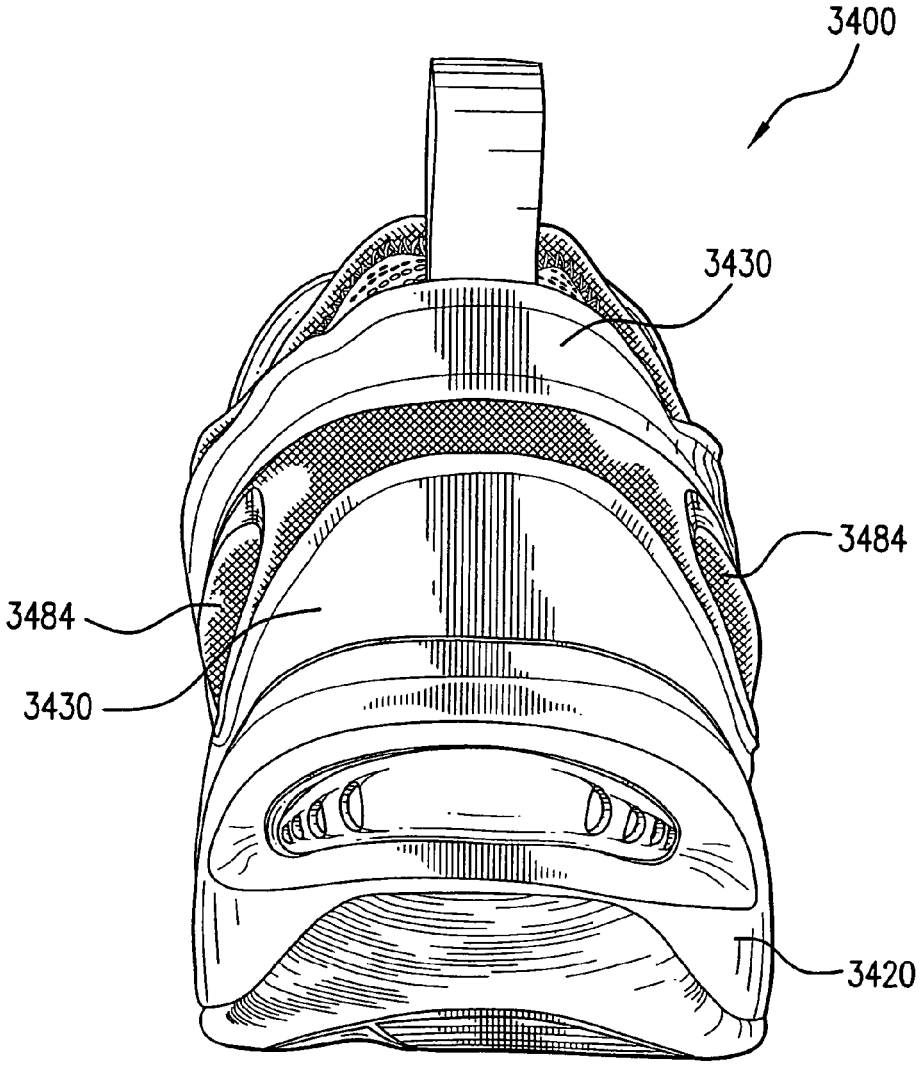
Figure 34F:
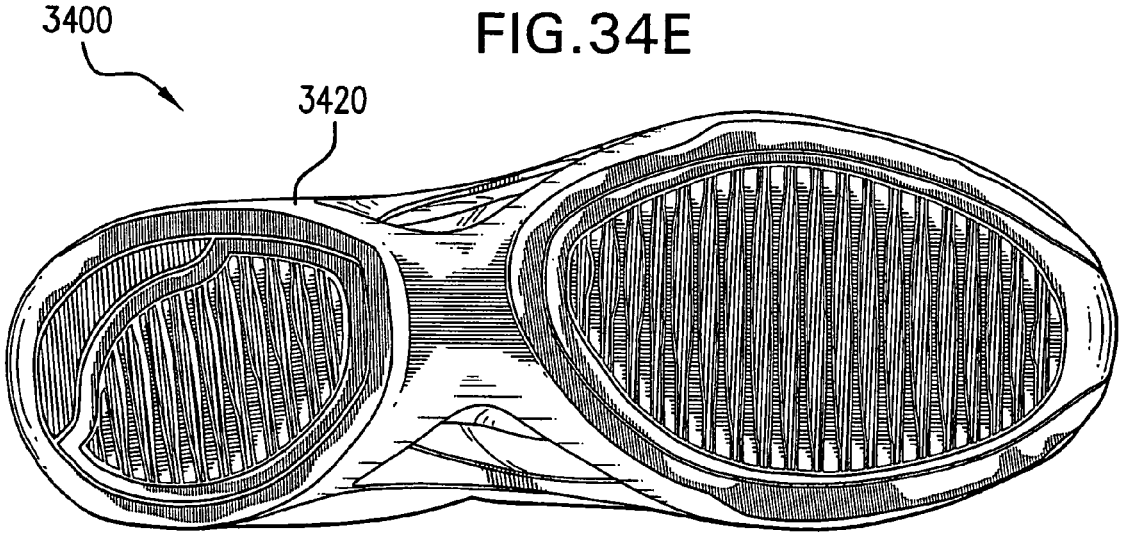
Figure 34G:
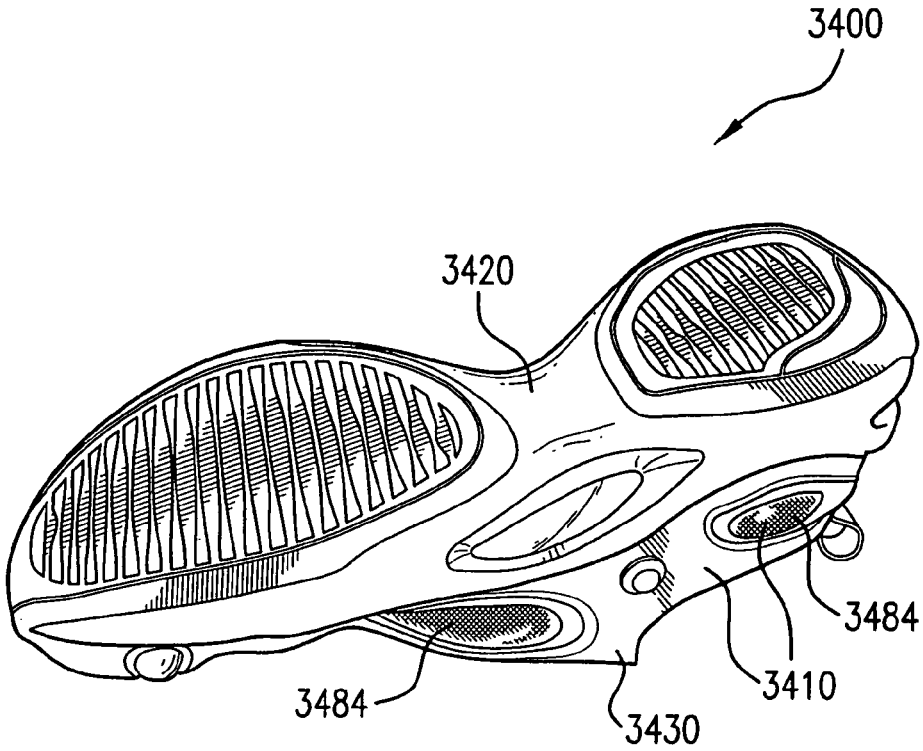
Figure 34H:
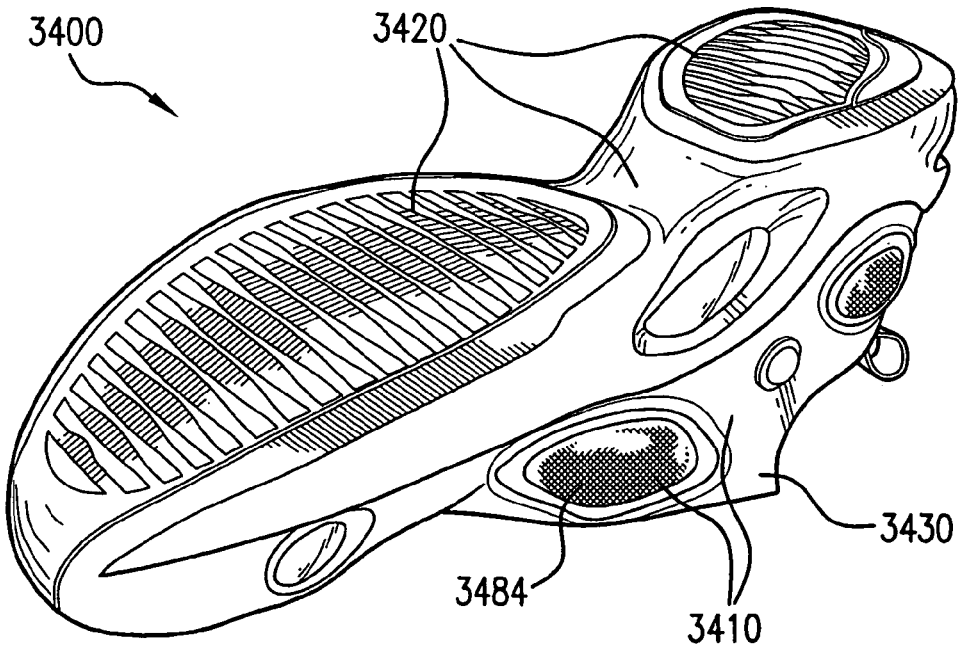
Figure 34I:
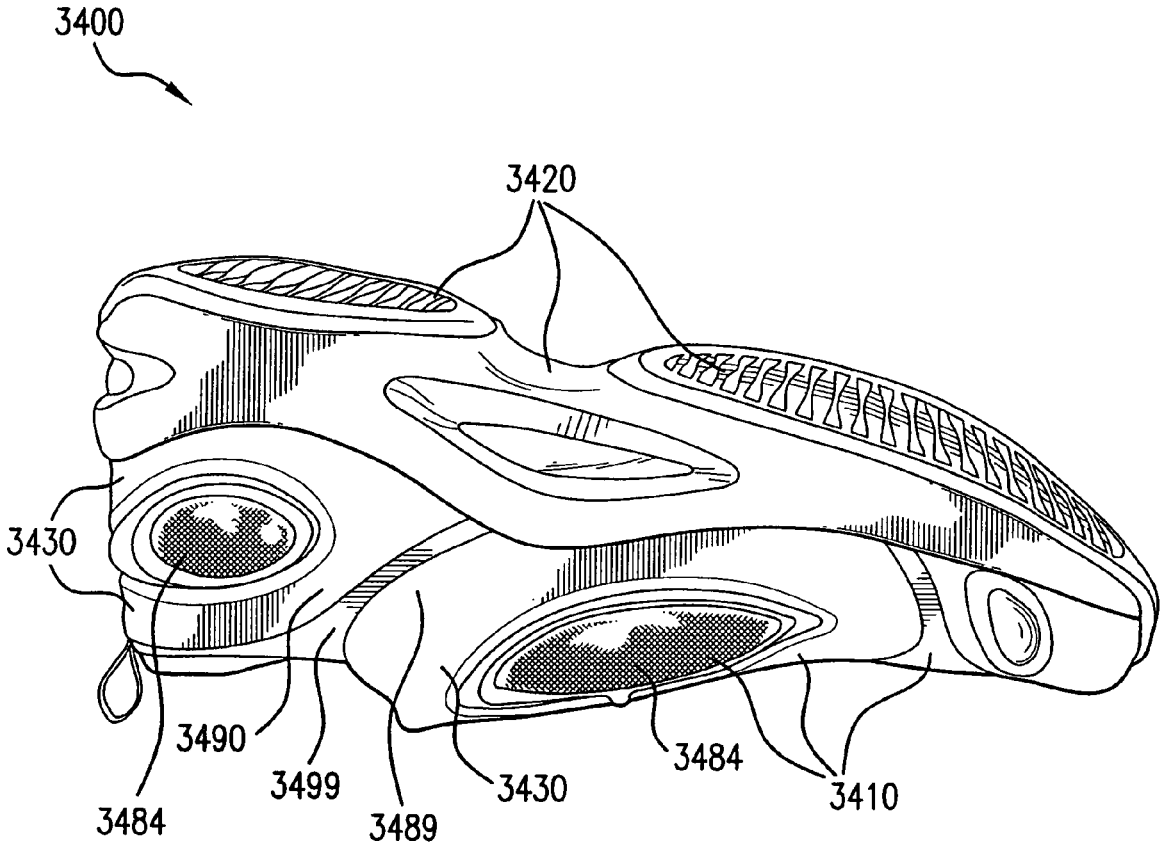

FIG. 34A is a side plan view of another embodiment of a shoe. FIG. 34B is an opposite side plan view of the shoe of FIG. 34A. FIG. 54C is an above plan view of the shoe of FIG. 34A. FIG. 34D is a front plan view of the shoe of FIG. 34A. FIG. 34E is a rear plan view of the shoe of FIG. 34A. FIG. 34F is a below plan view of the shoe of FIG. 34A. FIG. 34G is a below perspective view of the shoe of FIG. 34A. FIG. 34H is another below perspective view of the shoe of FIG. 34A. FIG. 34I is another side perspective view of the shoe of FIG. 34A.

Figure 35A:
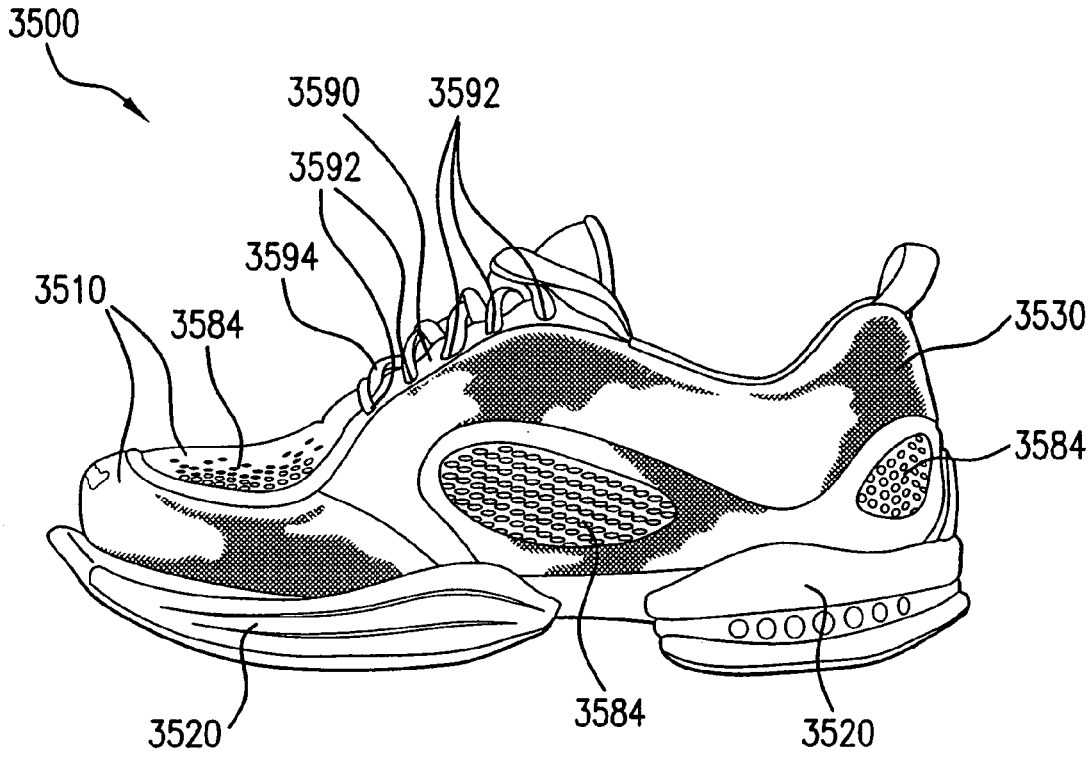
Figure 35B:
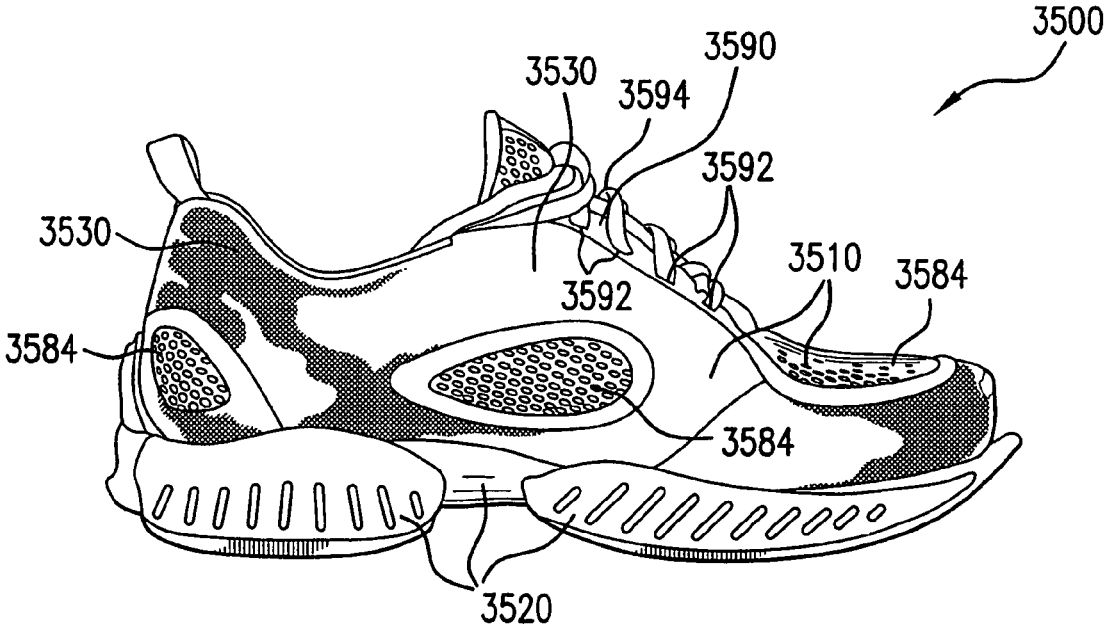
Figure 35C:
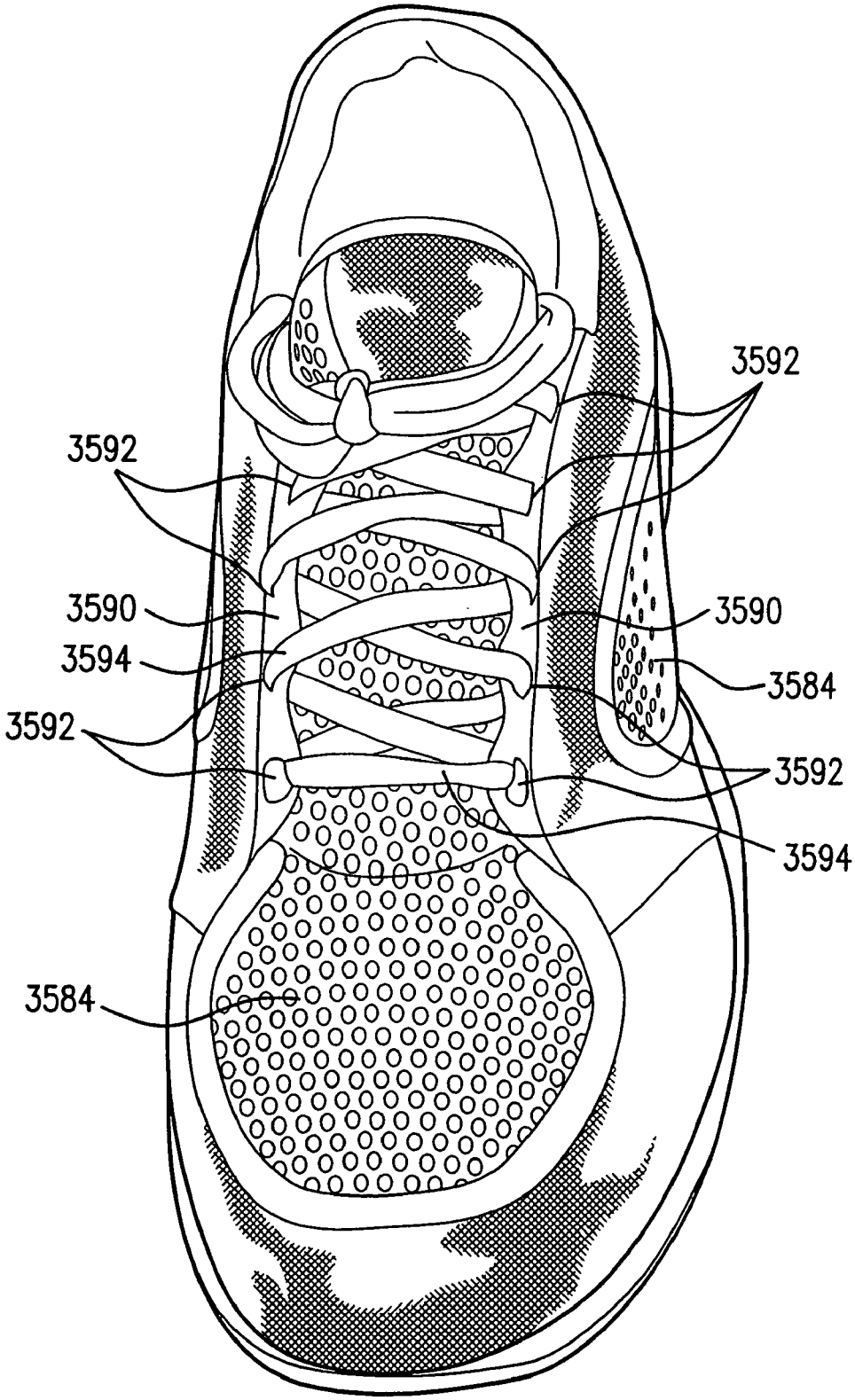

FIG. 35A is a side plan view of another embodiment of a shoe. FIG. 35B is an opposite side plan view of the shoe of FIG. 35A. FIG. 35C is an above perspective view of the shoe of FIG. 35A.

The terms "above", "below", "front", "rear" and "side" are for the purpose of reference only and are not meant to represent a specific orientation of a particular feature with respect to a shoe.

DETAILED DESCRIPTION OF THE INVENTION

Certain embodiments of the present invention are now described with reference to the Figures, in which the left most digit of each reference numeral generally corresponds to the Figure in which the reference numeral appears. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in other applications.

Figure 1:
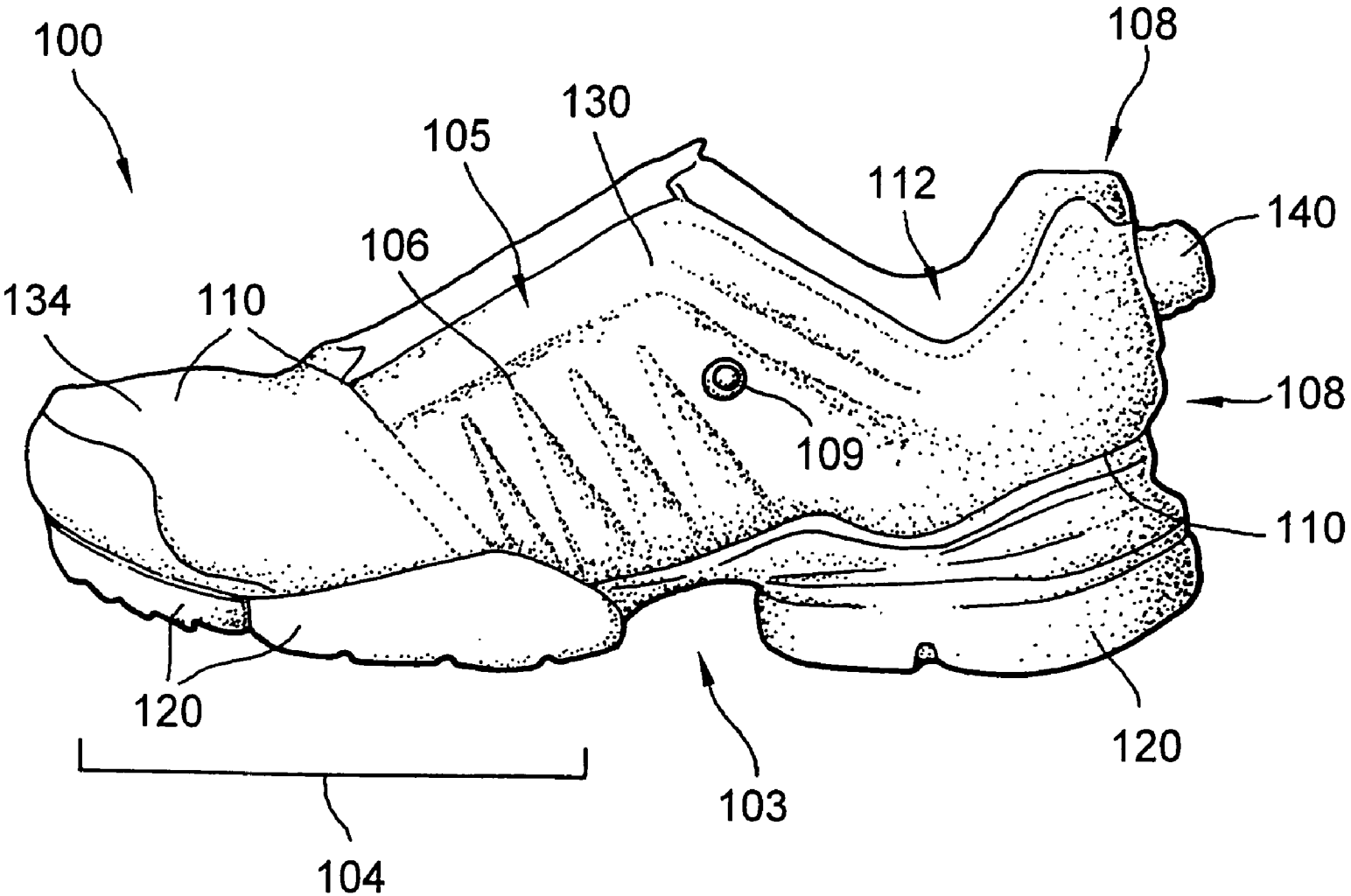
FIG. 1 is a lateral side of an embodiment of a shoe.

A shoe for a right foot according to an embodiment of the present invention is shown generally at 100 in FIG. 1. A corresponding shoe for the left foot could be a mirror image of shoe 100 and therefore, is not shown or described herein. As shown in FIG. 1, shoe 100 has a heel area shown generally at 108, an arch area shown generally at 103, a vamp area shown generally at 105, a forefoot area shown generally at 104, and a medial side area generally shown at 106. The present invention does not necessitate a conventional leather or cloth upper, particularly with the additional foam padding found along the interior of a typical athletic shoe upper. Therefore, shoe 100 includes a sole 120 and an upper 110 of which at least a portion entirely comprises an inflatable bladder 130. In addition, upper 110 of FIG. 1 has a toe portion 134. As demonstrated in FIG. 1, toe portion 134 need not be constructed from bladder 130. However, in alternative embodiments, bladder 130 may form any or all portions of upper 110, including toe portion 134. Upper 110 has an opening shown generally at 112, which is designed to receive a wearer's foot.

In order for a wearer to customize the amount of air in the bladder at any time, bladder 130 is in communication with an inflation mechanism. In an embodiment shown in FIG. 1, a generic inflation mechanism 140 is attached to bladder 130 in the heel area of the shoe. However, in alternate embodiments, inflation mechanism 140 may be located on the tongue of the shoe, on the sole of the shoe, on the side of the shoe, or any other area of the shoe as would be apparent to one skilled in the relevant art. For example, another embodiment comprising an inflation mechanism on the tongue will be later discusses with reference to FIG. 2.

A variety of different inflation mechanisms can be utilized in the present invention. The inflation mechanism may be, for example, a simple latex bulb which is physically attached to the shoe.

Alternatively, the inflation mechanism may be a molded plastic chamber as shown in FIG. 1 or may be a hand held pump such as one which utilizes $CO_2$ gas to inflate a bladder. Finally, as will be described with reference to FIG. 3 and FIG. 5, a portion of the bladder can be isolated from the remainder of the bladder. This isolated portion fluidly communicates with the remainder of the bladder via a one-way valve. This one-way valve allows the isolated portion to act as an inflation mechanism. Having an isolated portion of the bladder act as an inflation mechanism is preferably suitable for an underfoot bladder so as to automatically inflate the bladder as a user engaged in activity. However such an inflation mechanism may be used on any portion of the shoe. Preferably, the inflation mechanism is small, lightweight, and provides a sufficient volume of air such that only little effort is needed for adequate inflation. For example, U.S. Pat. No. 5,987,779, which is incorporated by reference, describes an inflation mechanism comprising a bulb (of various shapes) with a one-way check valve. When the bulb is compressed air within the bulb is forced into the desired region. As the bulb is released, the check valve opens because of the pressure void in the bulb, allowing ambient air to enter the bulb.

Another inflation mechanism, also described in U.S. Pat. No. 5,987,779, incorporated herein by reference in its entirety, is a bulb having a hole which acts as a one-way valve. A finger can be placed over the hole in the bulb upon compression. Therefore, the air is not permitted to escape through the hole and is forced into the desired location. When the finger is removed, ambient air is allowed to enter through the hole. An inflation mechanism having collapsible walls in order to displace a greater volume of air may be preferred. A similar inflation mechanism may include a temporarily collapsible foam insert. This foam insert ensures that when the bulb is released, the bulb expands to the natural volume of the foam insert drawing in air to fill that volume. A preferred foam is a polyurethane, such as the 4.25-4.79 pound per cubic foot polyether polyurethane foam, part number FS-170-450TN, available from Woodbridge Foam Fabricating, 1120-T Judd Rd., Chattanooga, Tenn., 37406.

U.S. Pat. No. 6,287,225, incorporated herein by reference in its entirety, describes another type of on-board inflation mechanism suitable for the present invention. One skilled in the art can appreciate that a variety of inflation mechanisms are suitable for the present invention. In addition, any inflation mechanism is appropriate for use with any embodiments of the present invention.

The inflation mechanism shown in FIG. 1 is an accordion style inflation mechanism comprising a plastic, collapsible case. Air enters through a hole open to the exterior of the inflation mechanism. The inflation mechanism operates similar to that described above with respect to the bulb inflation mechanism except that the casing is collapsed accordion-style to increase the amount of air forced into the system. Upon release, the accordion-style casing expands and the air is forced into the casing to regulate the pressure within the casing.

These inflation mechanisms all require a one-way valve be placed between the inflation mechanism and the bladder 130, so that once air enters the system it may not travel backwards into the inflation mechanism. Various types of one-way valves are suitable for use in conjunction with the various inflation mechanisms of the present invention. Preferably, the valve will be relatively small and flat for less bulkiness. U.S. Pat. No. 5,144,708 to Pekar, incorporated herein by reference in its entirety, describes a valve suitable for the present invention. The patent describes a valve formed between thermoplastic sheets. The valve described in the Pekar patent allows for simple construction techniques to be used whereby the valve can be built into the system at the same time the bladder is being welded. One skilled in the art would understand that a variety of suitable valves are contemplated in the present invention.

The one-way valve provides a method to avoid over inflation of the system. In particular, if the pressure in the bladder is equal to the pressure exerted by the inflation mechanism, no additional air will be allowed to enter the system. In fact, when an equilibrium is reached between the pressure in the bladder and the pressure of the compressed inflation mechanism, the one-way valve which opens to allow air movement from the inflation mechanism to the bladder 130 may remain closed. Even if this valve does open, no more air will enter the system. Further, one skilled in the art can design a pump to have a certain pressure output to limit the amount of air that can be pumped into bladder 130. Any one-way valve will provide a similar effect, as would be known to one skilled in the art. In addition, any one-way valve would be appropriate for use in any embodiments of the present invention.

One embodiment, as seen in FIG. 1, may include a deflation valve 109. The particular deflation valve in FIG. 1 is a release valve. A release valve is fluidly connected to bladder 130 and allows the user to personally adjust the amount of air inserted into bladder 130, particularly if the preferred comfort level is less than the pressure limits otherwise provided by the bladder. The release valve can comprise any type of release valve. One type of release valve is the plunger-type described in U.S. Pat. No. 5,987,779, incorporated herein by reference, wherein the air is released upon depression of a plunger which pushes a seal away from the wall of the bladder allowing air to escape. In particular, a release valve may have a spring which biases a plunger in a closed position. A flange around the periphery of the plunger can keep air from escaping between the plunger and a release fitting because the flange is biased in the closed position and in contact with the release fitting. To release air from bladder 130, the plunger is depressed by the user. Air then escapes around the stem of the plunger. This type of release valve is mechanically simple and light weight. The components of a release valve may be made out of a number of different materials including plastic or metal. Any release valve is appropriate for use in any embodiment of the present invention.

FIG. 1 shows one possible location of deflation valve 109 on shoe 100. However deflation valve 109 may be positioned in any number of different locations provided that it is fluidly connected with bladder 130, as would be apparent to one skilled in the relevant art. Additionally, shoe 100 may include more than one deflation valve.

As an alternative, deflation valve 109 may also be a check valve, or blow off valve, which will open when the pressure in bladder 130 is at or greater than a predetermined level. In each of these situations, bladder 130 will not inflate over a certain amount no matter how much a user attempts to inflate the shoe.

One type of check valve has a spring holding a movable seating member against an opening in the bladder. When the pressure from the air inside the bladder causes a greater pressure on the movable seating member in one direction than the spring causes in the other direction, the movable seating member moves away from the opening allowing air to escape the bladder. Another type of check valve is an umbrella valve, such as the VA-3497 Umbrella Check Valve (Part No. VL1682-104) made of Silicone VL1001M12 and commercially available from Vernay Laboratories, Inc. (Yellow Springs, Ohio, USA). In addition, any other check valve is appropriate for use in the present invention, as would be apparent to one skilled in the art. Further, any check valve would be appropriate for use in any of embodiments of the present invention.

In another embodiment, deflation valve 109 may be adjustable check valve wherein a user can adjust the pressure at which a valve is released. An adjustable check valve has the added benefit of being set to an individually preferred pressure rather than a factory predetermined pressure. An adjustable check valve may be similar to the spring and movable seating member configuration described in the preceding paragraph. To make it adjustable, however, the valve may have a mechanism for increasing or decreasing the tension in the spring, such that more or less air pressure, respectively, would be required to overcome the force of the spring and move the movable seating member away from the opening in the bladder. However, any type of adjustable check valve is appropriate for use in the present invention, as would be apparent to one skilled in the art, and any adjustable check valve would be appropriate for use in any embodiment of the present invention.

Bladder 130 may include more than one type of deflation valve 109. For example, bladder 130 may include both a check valve and a release valve. Alternatively, bladder 130 may contain a deflation valve 109 which is a combination release valve and check valve.

At times, a user may want to turn off the inflation of the bladder completely. Thus, another embodiment of a deflation valve 109 includes a release valve which can remain open. Any pressure build up in a bladder will be released by the open valve. Any of the features of release valve and check valve, such as a release valve that turns off and/or a check valve which is adjustable, may further be incorporated into a combination check valve and release valve, such as those discussed in detail below with respect to FIGS. 7A-7D, 8A-8B, 9, 10, 11A-11B, 25A-25F, 26A-26B, 27A-27D, 28A-28B, 29A-29D, 30A-30F, 31A-31F, and 32A-32F.

In one embodiment, small perforations may be formed in the bladder to allow air to naturally diffuse through the bladder when a predetermined pressure is reached. The material used to make bladder 130 may be of a flexible material such that these perforations will generally remain closed. If the pressure in the bladder becomes greater than a predetermined pressure the force on the sides of the bladder will open the perforation and air will escape. When the pressure in bladder 130 is less than this predetermined pressure, air will escape very slowly, if at all, from these perforations. Any embodiment of a bladder of the present invention may also have these perforations for controlling the amount of air within the bladder.

Bladder 130 may be formed from an exterior layer or film and a coextensive interior layer or film. The bladder may be shaped in a variety of configuration, such as that shown for bladder 230 in FIG. 2. The interior and exterior layers may be a lightweight urethane film such as is available from J. P. Stevens & Co., Inc., Northampton, Mass. as product designation MP1880. Alternatively, the layers may be thin films of ethyl vinyl acetate or a similar barrier film. The interior layer and the exterior layer may also be formed from different materials. In addition, the exterior layer may be a laminate formed from the combination of a urethane film and a thin fabric or synthetic material attached thereto. The interior layer is attached to the exterior layer along air-tight periphery weld lines 210. The periphery weld lines 210 attach the exterior layer to the interior layer and create a barrier to keep air between the layers.

One example of a suitable method of attachment of the exterior layer to the interior layer is the application of high radio frequency (RF welding) to the edges of the first and second film. The exterior and interior layers may alternatively be heat welded or ultrasonic welded together or attached by any other air tight means. Interior weld lines 220 are also provided. These interior welded lines 220 are also formed by RF welding, heat welding, ultrasonic welding or by other suitable means, and form the compartments of the present invention discussed in detail below. The exterior layer and interior layer are only attached along the periphery weld lines 210 and the interior weld lines 220. Consequently, a pocket or bladder is formed which allows a fluid, such as air, another gas or a liquid, to be introduced between the exterior layer and the interior layer. The sheets are welded together along all the weld lines and then die cut to form the predetermined shape. Alternatively, bladder 130 may be formed by blow molding, extrusion, injection molding and sealing, vacuum forming or any other thermoforming process using a thermoplastic material.

Since bladder 130 forms at least a portion of an exterior and/or an interior surface of upper 110, as seen in an embodiment of FIG. 1, a bladder of the present invention may also be formed with a thin layer of external material bonded or laminated to one or both of the exterior and interior layers. The bonding can occur either before or after the formation of the bladder. One suitable material is LYCRA® (available from DuPont). LYCRA® is a flexible and breathable material. Alternatively, one or both of the exterior and interior layers may be bonded to a foam laminate, any type of synthetic material, or any other material that would be available to one skilled in the art, or that is typically used in the production of a shoe. In a preferred embodiment, the bladder with or without the bonded material forms a portion of both the exterior and the interior of the shoe. Returning to FIG. 2, bladder 230 includes a plurality of compartments including medial compartment 254, lateral compartment 256, medial heel compartment 259, lateral heel compartment 258, and sole compartments designated arch compartment 252, heel compartment 260, midfoot compartment 262 and forefoot compartment 264. Those compartments disposed on the medial side of the shoe are fluidly connected to those compartments disposed on the lateral side of the shoe via fluid connection junction 274 located in the Achilles' tendon portion of the shoe. In the embodiment shown in FIG. 2, inflation mechanism 208 is fluidly connected to medial compartment 254 and fluidly connected via passageway 272 to the medial heel compartment 259. Medial compartment 254 provides cushioning to the medial side of the foot and is fluidly interconnected to arch compartment 252 which provides cushioning under the arch of the foot. Medial compartment 254 is also fluidly connected to medial heel compartment 259 via passageway 276 and to lateral heel compartment 258 via connection junction 274, providing cushioning around heel area 108. Lateral heel compartment 258 is fluidly connected to lateral compartment 256 via passageway 278 which provides cushioning along the lateral side of the foot.

Figure 2:
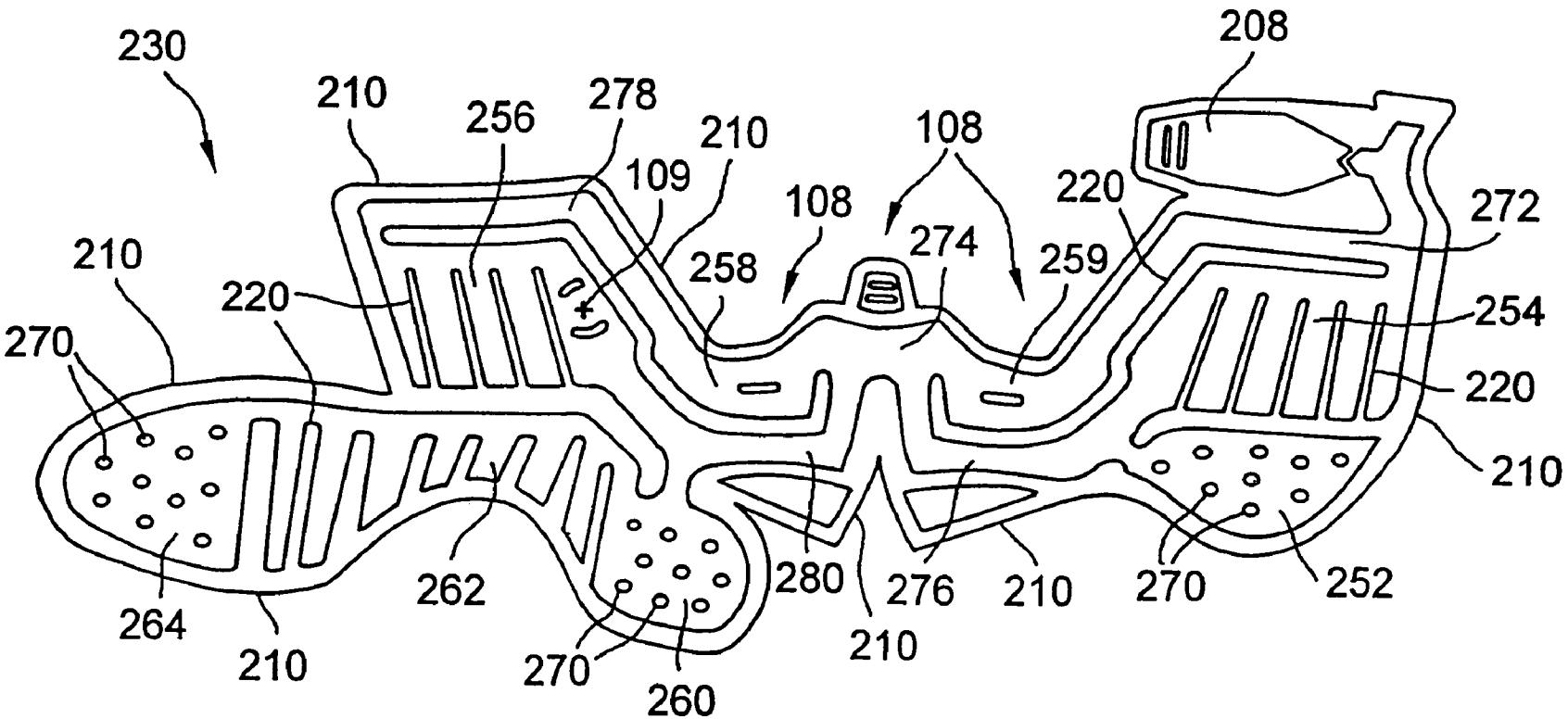
FIG. 2 is an above view of an embodiment of a bladder.

Lateral compartment 256 is fluidly connected to heel compartment 260 which provides cushioning to the heel of the foot. Heel compartment 260 is also fluidly connected to connection junction 274 through passageway 280. Heel compartment 260 is fluidly interconnected to midfoot compartment 262 and forefoot compartment 264. As shown in FIG. 2, medial compartment 254, lateral compartment 256, midfoot compartment 262, lateral heel compartment 258, and medial heel compartment 259 are further compartmentalized. This allows shoe 100 and bladder 230 to easily flex and further conform to a user's foot.

The bladder shown in FIG. 2 provides cushioning and a custom fit to the entire foot, including the sides of the foot. This increases the comfort of the wearer. Further, because the compartments located on the sides of the foot are fluidly connected to the different compartments located underneath the foot, air can flow to both sides of the shoe when the compartments located underneath the foot are under compression. Although bladder 230 is shown with lateral compartment 256 being fluidly connected to heel compartment 260 and medial compartment 254 being fluidly connected to arch compartment 252, it would be apparent to one skilled in the relevant art that any of the compartments located along the side and heel of the foot could be fluidly connected to any one of the compartments located beneath the foot to allow air to transfer from the bottom of the shoe to the sides of the shoe and vice versa. Furthermore, in alternate embodiments bladder 230 could include fewer or greater numbers of compartments, and the compartments of bladder 230 may be another size or shape, as would be apparent to one skilled in the relevant art.

In a preferred embodiment, bladder 230 may include welds 270, such as those shown in forefoot compartment 264, heel compartment 260 and arch compartment 252. Welds 270 are used to control the thickness of the bladder when the bladder is in its filled configuration (e.g., air has been pumped into the bladder). Welds 270 are also formed by RF welding, heat welding, ultrasonic welding or by other suitable means. In regions of the bladder where it is desirable to have bladder 230 inflated to a minimal thickness, the density of circular welds 270 may be greater than the areas where it is permissible or desirable for bladder 130 to be inflated to a greater thickness. These welds may be circular or any other geometry, such as triangular, oval or square, provided that they are shaped to limit and control the inflation dimensions of the bladder of the present invention.

As shown in FIG. 2, deflation valve 109 may be located in lateral compartment 256 of bladder 230, and inflation mechanism 208 may be fluidly connected to medial compartment 254. However, in alternate embodiments, inflation mechanism 208 and deflation valve 109 may be located in any area of bladder 230, which would be apparent to one skilled in the relevant art, or absent altogether. FIG. 2 shows an elongated inflation mechanism, which may fit more conveniently along a tongue portion of a shoe than a rounded bulb or an accordion style inflation mechanism. As stated earlier, any type of inflation mechanism is suitable for use in the present invention, as would be clear to one skilled in the art. Similarly all types of deflation valves described, above, with reference to bladder 130 may be used in an embodiment such as bladder 230. Bladder 230 may also use perforations or one-way valves to control the amount of air in bladder 230, as described above.

Figure 3:
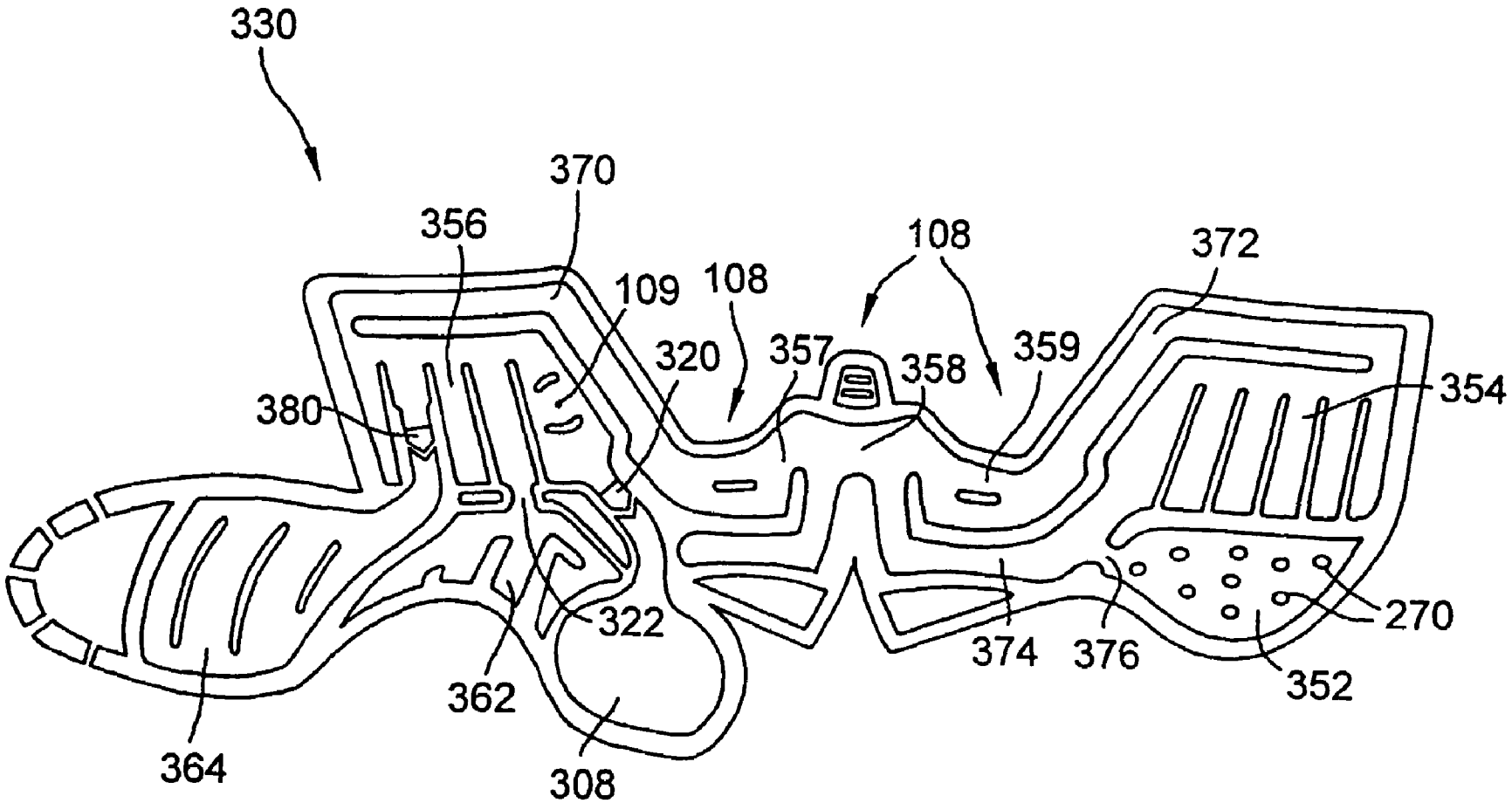
FIG. 3 is an above view of an alternate embodiment of a bladder.

FIG. 3 shows an alternate embodiment of a bladder 330, wherein heel compartment 308 acts as an inflation mechanism under the heel area of the foot. A hole may be located in heel compartment 308 so that, with each step that is taken, the hole is sealed shut and the air located in heel compartment 308 is forced through one-way valve 320 into lateral compartment 356 and on through the rest of bladder 330. The downward pressure from the heel against the hole creates an air tight seal so that the air in heel compartment 308 is forced through the one-way valve. One-way valve 320 will allow fluid to flow only in the direction opposite the direction of the arrow in FIG. 3. As the gait cycle continues, the heel of the foot rises releasing the pressure on heel compartment 308 and removing the seal covering the hole. Air, preferably from inside the shoe or alternatively from a tube directed outside of the shoe, is forced through the hole to equalize the pressure in heel compartment 308. Consequently, a inflating mechanism is created that consistently provides air to bladder 330 with each step. Alternatively, a butterfly valve could be used instead of a hole. One example is disclosed in U.S. Pat. No. 5,372,487 to Pekar, the disclosure of which is incorporated by reference. Also, as an alternative, heel compartment 308 may include a collapsible foam insert generally equivalent to the volume of heel compartment 308. The heel of the foot compressed the foam insert and heel compartment 308 in a typical gait cycle. As the heel is released, the foam insert expands to its original shape expanding the volume of the heel compartment 308 and allowing air to enter with the expansion of the heel compartment 308. A further example of a heel compartment comprising a foam insert is describe in detail below with respect to FIG. 5. Further, other under foot pumps described or otherwise disclosed below, such as satellite inflation mechanisms or inflation mechanisms with a moisture and other environmental condition barriers, maybe used instead of heel compartment 308.

Lateral compartment 356 is further fluidly connected to midfoot compartment 362 through passageway 322, and forefoot compartment 364 is fluidly connected to lateral compartment 356 through one-way valve 380. FIG. 3 shows a second inflation mechanism in forefoot compartment 364. This inflation mechanism is designed to work the same as the inflation mechanism discussed above for the heel compartment 308. In this embodiment, air is forced into lateral compartment 356 through one-way valve 380 as the forefoot rolls onto forefoot compartment 364. Air is allowed to enter forefoot compartment 364 via a hole as discussed above or via a valve as described above. Also, forefoot compartment 364 may comprise a foam insert, as described above for heel compartment 308. In other words, the shoe of FIG. 3 utilizes two inflation mechanisms, which together decrease the time it takes to inflate the bladder. By using two inflation mechanisms, one in the heel and one in the forefoot, a user begins to feel the shoe inflating in only a few steps.

In FIG. 3, both the forefoot compartment 364 and the heel compartment 308 are shown to inflate the bladder. It should be understood that as an alternative, the forefoot compartment 364 could be orientated to inflate one portion of the bladder while heel compartment 308 inflates another portion of the bladder. Weld lines can be utilized to isolate portion of the bladder to accomplish this result.

Lateral compartment 356 is fluidly connected to lateral heel compartment 357 through fluid passageway 370. Lateral heel compartment 357 is fluidly connected to medial heel compartment 359 via fluid connection junction 358, providing support around the heel portion 108 of shoe 100. Medial heel compartment 359 is fluidly connected to medial compartment 354 through fluid passageways 372 and 374. Medial compartment 354 is also fluidly connected to arch compartment 352.

FIG. 3 shows that forefoot compartment 364, midfoot compartment 362, lateral compartment 356, medial compartment 354, lateral heel compartment 357 and medial heel compartment 359 maybe further compartmentalized for the same purpose as the similar features of FIG. 2. Also, the arch compartment 352 may have welds 270 similar to those described for FIG. 2.

Consequently, as a foot moves through a typical gait cycle, the pressure caused by the foot to the various compartments located under the foot forces the air into the various other fluidly connected parts of the bladder to provide added support around the medial side, lateral side and heel of the foot.

The embodiment described in FIG. 3 may also have a deflation valve 109 which opens bladder 330 to the atmosphere to reduce the amount of air in bladder 330. Bladder 330 may have a release valve, wherein the individual wearer can release just the amount of pressure he or she desires, a check valve, which opens only when the air pressure in bladder 330 reaches a predetermined pressure, or a combination thereof as described below with respect to FIGS. 7*a*-7*d*. Bladder 330 may alternatively comprise an adjustable check valve, wherein the user can adjust the pressure at which the valve opens. Bladder 330 may have one or more inflation mechanisms with a one-way valve which itself may act as a system to regulate the pressure, as described above with respect to the embodiment of bladder 130. In other embodiments, bladder 330 of the present invention may include one or more manually operated inflation mechanisms located on the tongue of the shoe, near the heel of the shoe, on a lateral or medial side of the shoe, or anywhere else on the shoe as would be apparent to one skilled in the relevant art.

Figure 4:
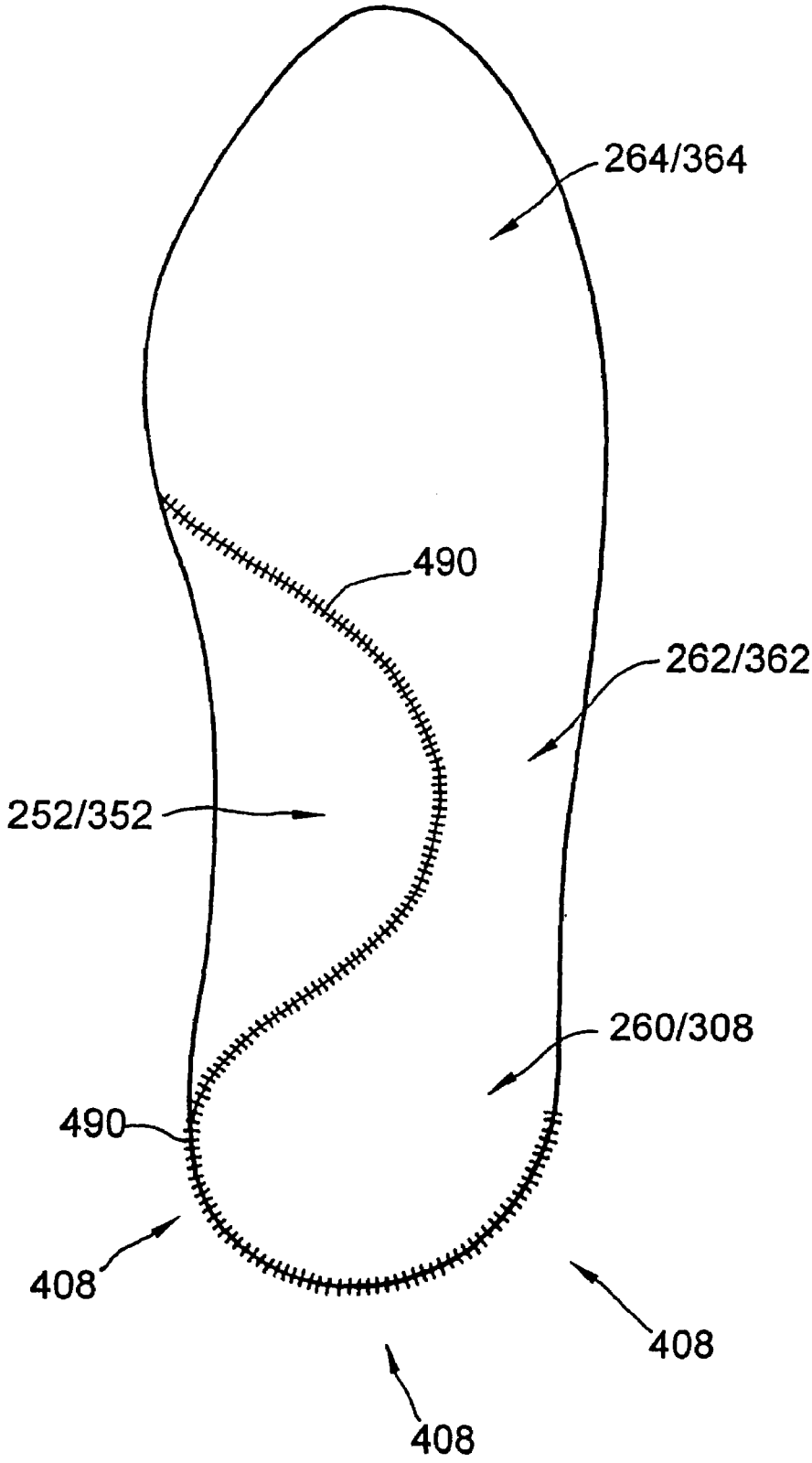
FIG. 4 is an above view of a sole portion of the bladders of FIG. 2 or 3.

In an embodiment as shown in FIG. 4, a bladder of the present invention, similar to those described in FIGS. 2 and 3, is stitched together by an S-shaped stitch 490 located under the foot of the wearer. This stitching is placed in a stitching margin of periphery weld lines that are formed when the bladder is die cut. The stitching connects a portion of the periphery weld of an arch compartment 252/352 against the periphery weld of the midfoot compartment 262/362 and heel compartment 260/308 to the periphery weld disposed in area 408 below the fluid conjunctions 274, 358, of FIGS. 2 and 3. Because the various compartments are sewn together, the bladder of the present invention forms a boot which completely surrounds the foot of the wearer. Because the components of the present invention are sewn together, the medial compartments 254, 354, of FIGS. 2 and 3, and lateral compartment 256, 356, of FIGS. 2 and 3, receive support from the other compartment. This support allows the bladder of the present invention to function as the upper itself.

Stitching is only one method for connecting these portions of the bladder. Alternatively, they may be adhered by gluing, bonding, RF welding, heat welding, ultrasonic welding, or another other method known to one skilled in the art.

Figure 5:
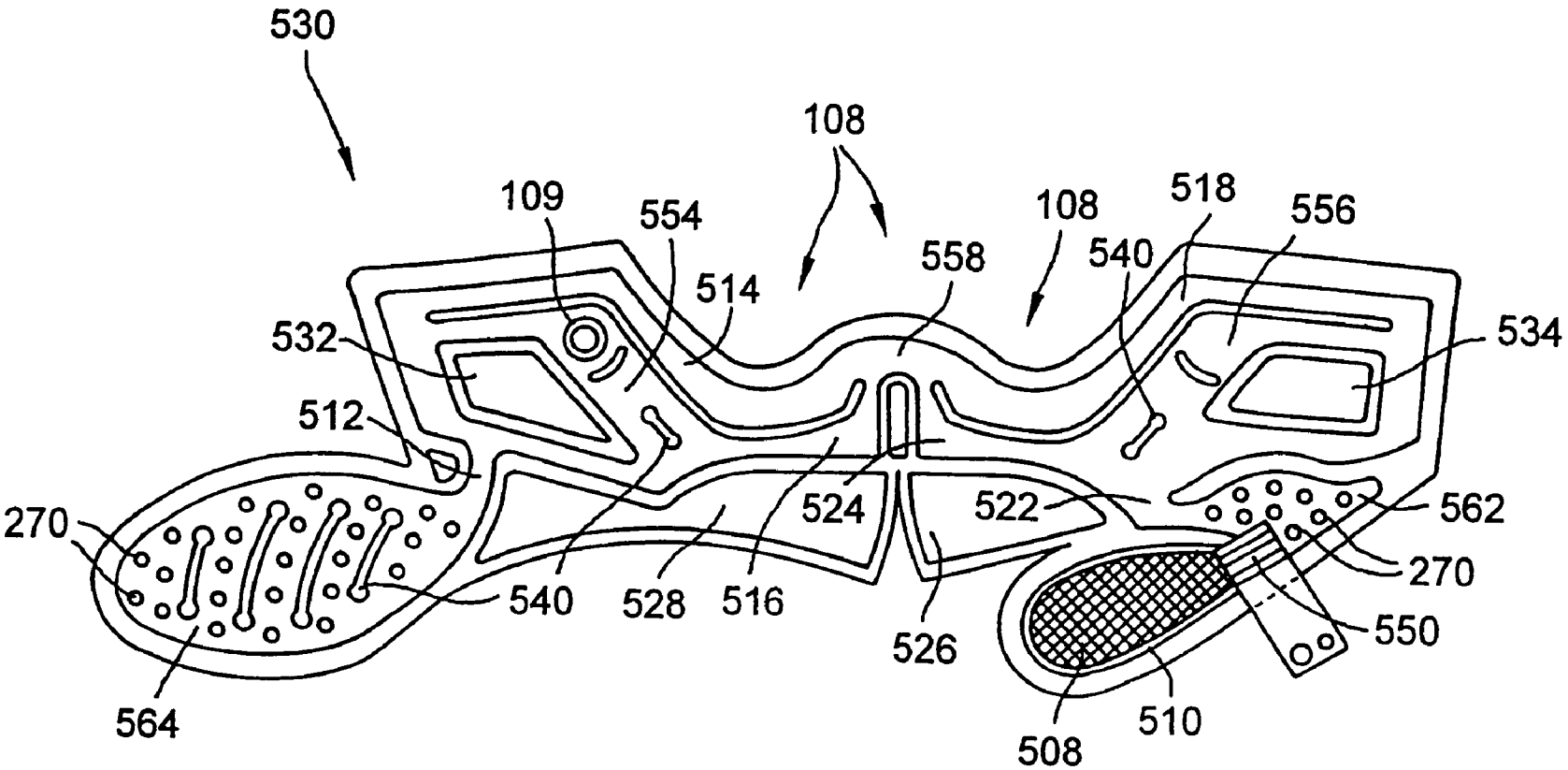
FIG. 5 is an above view of an alternate embodiment of a bladder.

In FIG. 5, another embodiment is described wherein a bladder 530 has an alternative design. Bladder 530 includes a forefoot compartment 564, which is fluidly connected to lateral compartment 554 through fluid passageway 512. Lateral compartment 554 is fluidly connected to fluid connection junction 558 through fluid passageways 514 and 516. Lateral compartment 554 and medial compartment 556 are fluidly connected across connection junction 558, which cushions the heel of the foot. Fluid connection junction 558 is fluidly connected to medial compartment 556 through fluid passageways 518 and 524. Medial compartment 556 is fluidly connected to midfoot compartment 562 through fluid passageway 522. Heel compartment 508 is fluidly connected to midfoot compartment 562 through one-way valve 550 The shape and size of each compartment may vary and may be fluidly connected in any manner by the addition or removal of various internal weld lines, as apparent to one skilled in the art. Further, alternative embodiments may have a greater or fewer number of compartments.

Each of lateral compartment 554 and medial compartment 556 may have pockets formed from internal weld lines which are not fluidly connected to the rest of the compartment. Lateral pocket 532 is located within lateral compartment 554 and medial pocket 534 is located within medial compartment 556. These pockets may in fact not be inflated, and the two layers remain flat against one another, or could be pre-inflated. In either case, in this image they are not part of the adjustable inflation system of the rest of the bladder. Further, bladder 530 comprises a third pocket 528. This third pocket provides support under and along the lateral side of the foot and in heel area 108. Similarly, a fourth pocket 526 provides support to heel area 108. The weld lines surrounding pockets 528 and 526 keep the area separated from the inflated bladder without the need to weld together the sheets of film in the interior of pockets 528 and 526. Alternatively, lateral pockets 532 and medial pocket 534 could be removed leaving openings in the bladder at the locations designated as 532 and 534.

Bladder 530 may include welds 270, such as those shown in forefoot compartment 564 and midfoot compartment 562. Welds 270 may be of any shape provided that they limit and control the inflation dimensions of the bladder of the present invention. For example, elongated welds 540 can be found in forefoot compartment 564, lateral compartment 554 and medial compartment 540. Elongated welds 540 also define and limit the inflation dimensions of bladder 530.

Any inflation mechanism may be used as described for other embodiments of the present invention. Preferred, however, is the use of heel compartment 508 as an inflation mechanism. As can be seen in FIG. 5, heel compartment 508 includes a foam core 510. Foam core 510 is likely a conventional porous polyurethane foam, such as the 4.25-4.79 pound per cubic foot polyether polyurethane foam, part number FS-170-450TN, available from Woodbridge Foam Fabricating,1120-T Judd Rd., Chattanooga, Tenn., 37406. As a user's heel steps down in a typical gait cycle, heel compartment 508 and foam core 510 are compressed. The air in heel compartment 508 and foam core 510 is forced through one-way valve 550, into midfoot compartment 562 and throughout the other fluidly connected compartments of bladder 530. As the user's heel rises, air enters heel compartment 508 through a hole or through a one-way valve open to the atmosphere. The foam core 510 has a natural elasticity, such that the foam expands to its natural condition ensuring that heel compartment 508 expands with it. Air enters and takes up the whole volume of heel compartment 508. Further, a shoe with an underfoot inflation mechanism may comprise a sole with an indented recess, or cavity, (not shown) substantially adjacent to the inflation mechanism and substantially the shape of the inflation mechanism. When the shoe is constructed, the inflation mechanism is inserted into the indented recess. During a typical gait cycle, the inflation mechanism is compressed between the indented recess and the foot such that the foot may sink into the indented recess. The indented recess may be located in either an outsole or a midsole portion of the sole.

Bladder 530 may utilize perforations or the one-way valve as a technique for limiting the amount of pressure build-up. Alternatively, deflation valve 109 may be a release valve, check valve, a combination check valve and release valve (see below), an adjustable check valve, a release valve that is capable of remaining open or any combination thereof. Further more than one type of deflation valve 109 may be used.

FIG. 5 shows one location for a generic deflation valve 109, however, a deflation valve may be located on any portion of bladder 530.

Figure 6:
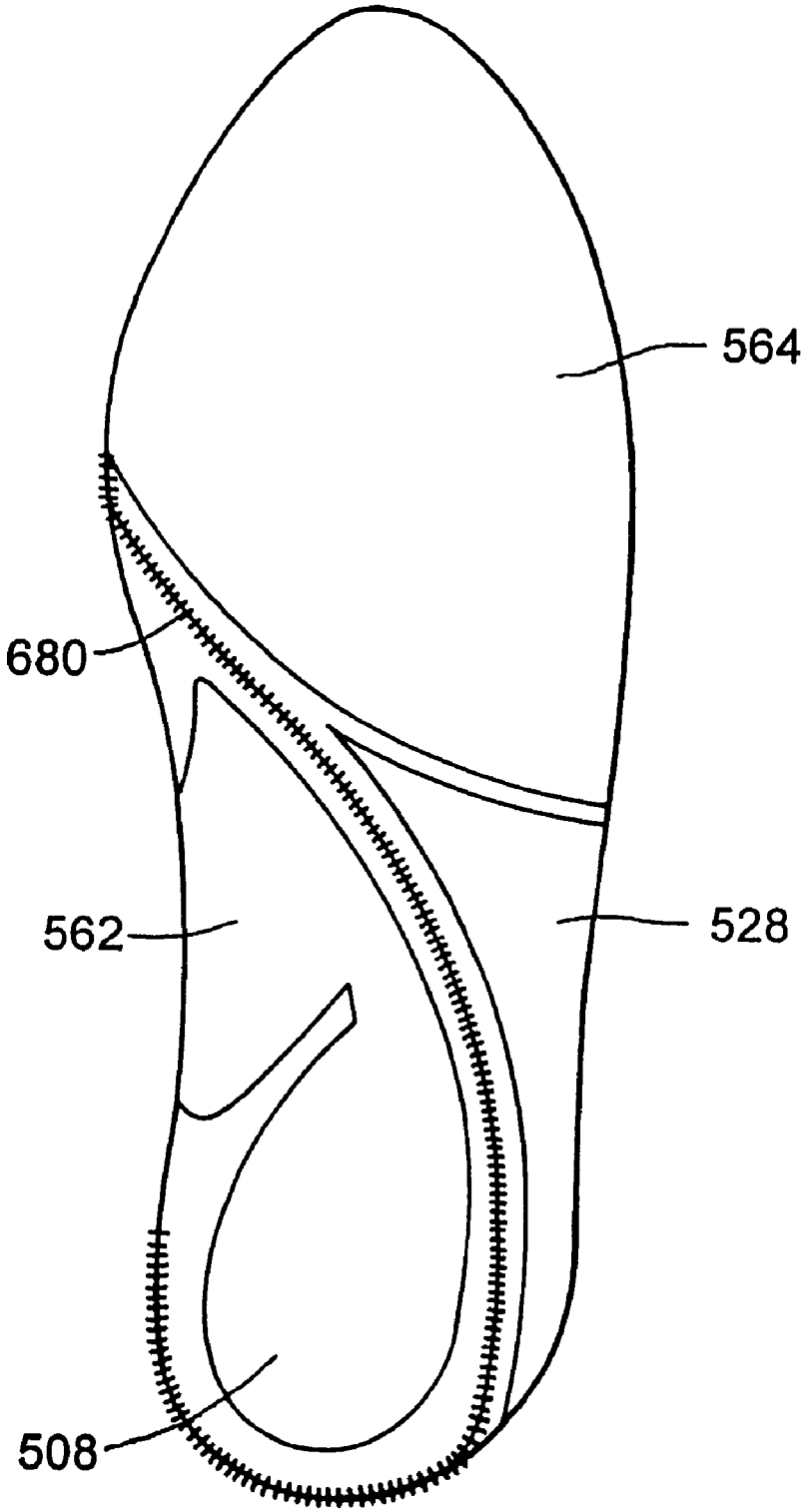
FIG. 6 is an above view of a sole portion of the bladder of FIG. 5.

In an embodiment as shown in FIG. 6, a bladder of the present invention, similar to that described in FIG. 5 is stitched together by an J-shaped stitch 690 located under the foot of the user. This stitching is placed in a stitching margin which is formed when the bladder is formed. The stitching connects a portion of the periphery weld line around forefoot compartment 564 to the periphery weld line around midfoot compartment 562 and third pocket 528 to the periphery weld line around midfoot compartment 562 and heel compartment 508, as seen in FIG. 5. In addition, the periphery weld line around heel compartment 508 is stitched to the periphery weld line adjacent to fourth pocket 526. Because the various compartments are sewn together, the bladder of the present invention forms a boot, which completely surrounds the foot of the wearer. The support of this boot allows the bladder of the present invention to function as the upper itself. Stitching is only one method for constructing the bladder. Alternatively, periphery weld lines may be adhered by gluing, bonding, RF welding, heat welding, ultrasonic welding, or another other method known to one skilled in the art.

Additional embodiments of bladders and shoes of the present invention having underfoot inflation mechanisms are discussed below with respect to FIGS. 13-18, 20-23, 24A-24E, 34A-34I and 35A-35C. Further, a satellite underfoot inflation mechanism is discussed below with respect of FIGS. 33A and 33B.

As discussed above, the present invention may include a combination check valve and release valve. This combination check valve and release valve is depicted in FIGS. 7*a*-7*d*. The combination release valve and check valve 701 is made from sleeve 704, spring 702, base 706, umbrella valve 708 and cap 710. FIG. 7*a* shows an exploded view of how sleeve 704 is supported in base 706. Sleeve 704 has a lip 712 which rest on spring 702. Spring 702 fits into base 706. Sleeve 704 is preferably made of aluminum to ensure a quality surface of lip 712. Alternatively, sleeve 704 can be made from any number of plastic materials or other materials which would be known to one skilled in the art. Preferably, all the materials in combination release valve and check valve 701 are lightweight. Spring 702 is preferably made from stainless steel but may be made from a variety of metals or other materials.

FIG. 7*b* is an exploded view of the entire combination release valve and check valve 701. Cap 710 has a surface portion 738 and a side portion 740. Cap 710 and base 706 both may be formed from a molded plastic. Preferably, cap 710 and base 706 are formed from an injection-molded resin. For example, cap 710 may be injection molded from Estane 58863 (85A hardness), while base 706 may be injection molded from Bayer resin (60D hardness). Alternatively, cap 710 and base 706 may be injection molded from the same resin. Umbrella valve 708 sits through a hole 730 in the bottom of sleeve 704, as shown in FIG. 7*a*. An assembled combination release valve and check valve 701 is shown in FIG. 7*c*, wherein the release valve mechanism is not activated. Base 706 is in contact with the bladder. Air enters the combination release valve and check valve 701 via a hole 720 in base 706 which is fluidly connected to the bladder of the present invention. FIG. 7*c* shows umbrella valve 708 having the general shape of an umbrella and forming an air-tight seal against sleeve 704. The umbrella-shape is generally thick in the middle but forms a thin flap 718 which rests and forms an air tight seal against sleeve 704. Air from the bladder travels through a first slot 722 located in the base of the umbrella valve 708 and through a second slot 724 located underneath the umbrella. Umbrella valve 708 is preferably made of a material which is more rigid when thick and somewhat flexible when thin, such as silicone, so that thin flap 718 is somewhat elastic. When the air pressure underneath the umbrella shape, and therefore the pressure in the bladder of the present invention, reaches a predetermined pressure, thin flap 718 is deformed and lifted off of the sleeve 704. Air is then allowed to escape through holes 716 in the surface portion 738 of cap 710. Dotted line 728 shows the route of air through the release valve portion of combination release valve and check valve 701. When the air pressure in the bladder and under the umbrella becomes less than the predetermined pressure, the thin flap 718 returns to its natural shape an again creating a seal against sleeve 704. The preferred umbrella valve 708, commercially available as VA-3497 Umbrella Check Valve (Part No. VL1682-104) from Vernay Laboratories, Inc. (Yellow Springs, Ohio, USA), typically deforms when the pressure in the bladder is around 5 pounds per square inch. Any other type of umbrella valve, however, would be suitable in the combination check valve and release valve of the present invention, as would be clear to one skilled in the art.

Spring 702, as seen in FIG. 7*c* is in a slightly compressed state such that it holds sleeve 704 firmly and air-tightly against cap 710 so that the only air that may escape is through umbrella valve 708, as describe above. In particular, an air tight seal is formed by the pressure of lip 712 of sleeve 704 against a molded hinge 714 jutting from cap 710. When the surface portion of cap 710 is pressed, cap 710 deforms, as can be seen in FIG. 7*d*. When this occurs the surface portion 738 becomes flat pressing down on an upper rim 742 of sleeve 704. As sleeve 704 is forced downward, spring 702 compresses and lip 712 is pulled away from hinge 714. A gap 726 between hinge 714 and lip 712 allows air to escape out holes 716 in cap 710. Dotted line 729 shows the path of air flow when the release valve portion of combination release valve and check valve is activated. In order to avoid a finger or thumb covering the holes located on the top of cap 710 and preventing the air from escaping through holes 716, an embodiment may include an extension or wall sticking out from the surface portion 738 of cap 710. For example, one embodiment may have a ring-shaped wall (not shown) outside of the holes 716. The ring-shaped wall further has holes in the sides of the wall, such that when a finger or thumb is placed on the ring-shaped wall, the wall pushes down on the cap 710 rather than the finger or thumb. The air that escapes through holes 716 is still trapped by the finger or thumb from the top, but can escape through the holes in the sides of the ring-shaped wall. Another embodiment may have an extension sticking out from the center of surface portion 738. When the extension is depressed, the cap 710 depresses without covering the holes 716. An additional cap may be placed on top of the extension or wall to provide a bigger surface for a finger or thumb to depress the extension or wall. Consequently, the air is allowed to escape from a gap between cap 710 and the additional cap.

FIGS. 8*a*, 8*b* and 9 shows an alternative combination release valve and check valve 801. Combination release valve and check valve 801 is made from a base 806, umbrella valve 808 and cap 810. Therefore, combination release valve and check valve 801 has less pieces and materials and is therefore preferred over combination release valve and check valve shown in FIG. 7. FIG. 8*a* shows a cross section of base 806, umbrella valve 808 and cap 810, wherein the release valve mechanism is not activated. FIG. 8*b* is a detailed view of the portion of combination release valve and check valve 801 that is circled in FIG. 8*a*. Wedge portion 844 is attached to side portion 840 by hinge portion 846. Preferably, cap 810 and base 806 are formed from an injection-molded resin, similar to one or more of those described above, with respect to combination release valve and check valve 701 of FIGS. 7*a*-7*d*. Cap 810 and base 806 may be made from either the same resin or different resins.

Base portion 848 which is in contact with cap portion 842. Base portion 848 and cap portion 842 form an air-tight seal. Preferably, this air tight seal is formed by gluing, bonding, RF welding, heat welding, ultrasonic welding, or another method known to one skilled in the art. Base 806 has a ledge 850 against which wedge portion 844 is pressed when combination release valve and check valve 801 is not activated. Wedge portion 844 and ledge 850 form an air tight seal.

Umbrella valve 808 sits through a hole 830 in base 806, as shown in FIG. 8*a*. Umbrella valve 808 has the general shape of an umbrella and forms an air-tight seal against a top surface 817 of ledge 850. The umbrella-shape is generally thick in the middle but forms a thin flap 818 which rests and forms an air tight seal against top surface 817 of ledge 850. Air from the bladder travels through a slot 822 located along the stem of the umbrella valve 808. Umbrella valve 808 is preferably made of a material which is more rigid when thick and somewhat flexible when thin, such as silicone, so that thin flap 818 is somewhat elastic. When the air pressure underneath the umbrella shape, and therefore the pressure in the bladder of the present invention, reaches a predetermined pressure, thin flap 818 is deformed and lifted off of top surface 817 of ledge 850, similar to the operation of the umbrella valve 708 discussed above with respect to FIGS. 7*a*-7*d*. The air moves from the bladder to the atmosphere out a hole 816 in cap 810 along a dotted line 828. When the air pressure in the bladder and under the umbrella becomes less than the predetermined pressure, the thin flap 818 returns to its natural shape an again creating a seal against base 806. The preferred umbrella valve 708, discussed above with respect to FIGS. 7*a*-7*d* is also the preferred umbrella valve 808 for the combination release valve and check valve 801. Although, many other types of umbrella valve are suitable, as would be clear to one skilled in the art.

One of cap portion 842 or base portion 848 is in contact with the bladder of the present invention depending upon how combination release valve and check valve 801 is integrated with the bladder. Base 806 has holes 820, which allow air to pass from the bladder to an area 853 closed off by wedge portion 844 and ledge 850, along dotted line 856. When the surface portion 838 of cap 810 is pressed, cap 810 deforms, as can be seen in FIG. 9. When this occurs, wedge portion 844 and surface portion 838 act like a lever, such that hinge 846 acts like a fulcrum moving wedge portion 844 away from ledge 850. Dotted line 929 shows the path of air flow out of holes 816 when the release valve portion of combination release valve and check valve 801 is activated. In order to avoid a finger or thumb covering holes 816 located on the top of cap 810 and preventing the air from escaping therethrough, holes 816 may be recessed in cap 810, as shown in FIG. 10. Thus, when surface portion 838 is depressed, fingers do not actually come into contact with holes 816, and air can escape around the finger used to depress cap 810 through channel 1027.

FIGS. 11*a* and 11*b* show yet another combination release valve and check valve 1101, which is a side-by-side valve. In this embodiment, a conventional release valve 1160 is placed side-by-side with an check valve 1108 under a cap 1110 comprising an exit hole 1116. Both check valve 1108 and release valve 1160 are embedded into a base 1106 which communicates with the interior of a bladder. Exit hole 1116 may be located anywhere within cap 1110 because both check valve 1108 and release valve 1160 create air-tight seals with base 1106. Thus, either air will exit out of exit hole 1116 in cap 1110, whether escaping from the check valve 1108 automatically due to pressure in the bladder exceeding a predetermined pressure or escaping from the release valve 1160 due to manual operation thereof.

As seen in FIG. 11*b*, which is a cross sectional view of combination release valve and check valve 1101, release valve 1160 may have a plunger 1120 and a spring 1122, similar to that described above. However, any release valve, such as those described above, may be used in this embodiment. Similarly, check valve 1108 may be an umbrella valve as described above, with respect to FIGS. 7*a*-7*d*, or it may be any other type of check valve 1108.

In other embodiments, combination release valve and check valves, such as those described above, may incorporate an adjustable check valve, such as the adjustable check valve described above with respect to FIG. 1, instead of the umbrella valves shown therein. Further embodiments of release valves, check valves and combination check valves and release valve, such as these are described below with respect to FIGS. 25A-25F, 26A-26B, 27A-27D, 28A-28B, 29A-29D, 30A-30F, 31A-31F, and 32A-32F.

As discussed above, an underfoot inflation mechanism may be used in a shoe of the present invention. One way air may enter to the underfoot inflation mechanism is through a hole in heel compartments 308 and 508, as discussed above with respect to FIGS. 3 and 5.

Compression of heel compartment 308, 508 seals the hole, such that air is forced into bladder 330, 530. However, sometimes, the materials used to make the sole are not sufficiently breathable to allow air contact to the hole. Further, moisture, bacteria and soil from the foot may enter into the hole causing damage to the inflation mechanism. One mechanism for the prevention of moisture, bacteria, dirt and other environmental particles from entering the inflation mechanism is to cover the air entry to the inflation mechanism with a fabric or other material that is permeable to air, but not moisture or other environmental particles. Suitable materials include but are not limited to fabric such as GORE-TEX or TRANSPOR or certain ceramics or other porous materials such as VERSA-POR membranes.

FIG. 12 shows a perspective exploded view of a snorkel assembly 1262. Snorkel assembly 1262 includes a valve chamber 1264, a tube 1266, a cover 1268 and a sole component 1270. Valve chamber 1264 generally is a thermoplastic unit that is adhered over a hole a heel compartment (such as heel chamber 308, 508). Valve chamber 1264 includes a flat portion 1265 that is directly adhered to an exterior or interior surface 1261 of heel compartment 308, 508 via gluing, bonding, RF welding, heat welding, ultrasonic welding, or another other method known to one skilled in the art. Valve chamber 1264 also has a domed portion 1263. Domed portion 1263 is generally a half-cylinder shape with a closed first end 1267 and a second end 1269 comprising an opening 1271.

Since valve chamber 1264 inhibits a seal of the hole in heel chamber 308, 508, valve chamber contains a one-way valve (not shown), such that air will flow through valve chamber 1264 and into a heel chamber without flowing in the opposite direction, i.e., valve will not allow air to escape from a heel compartment. Any type of one-way valve, such as those described in detail above would be suitable for use in valve chamber 1264. One such valve is a duckbill valve, wherein two flexible pieces form a funnel shape. The funnel shape has the two layers open on one end and pressed flat together on the other end, thus closing off the flat end. Air flows from the open end where the pressure is high to the flat end where the pressure is low, so that the flat end opens and the air is forced therethrough. Thus, air will flow in only one direction away from the increase in pressure. Another duckbill valve uses four flexible pieces that come together to form a plus (+) shaped closed end rather than a flat (–) shaped closed end of the duckbill valve described above. The plus-shaped valve allows for greater flow therethrough when opened and does not make as much noise as when air flows through a flat-shaped duckbill valve.

Tube 1266 has a first end 1272 and a second end 1273. Tube 1266 is generally made of a thermoplastic material, such as thermoplastic urethane tubing. Tube 1266 may be rigid or flexible. First end 1272 of tube 1266 is inserted into opening 1271 in valve chamber 1264 and forms an air tight seal therewith. Tube has a generally J-shape and curves along the outside of a bladder (such as bladder 330, 530). Second end 1273 is held against the outside of bladder by cover 1268. Cover 1268 is a thermoplastic formed piece having a flat portion 1274 and a dome portion 1275. Flat portion 1274 is adhered to the outside of the bladder via gluing, bonding, RF welding, heat welding, ultrasonic welding, or another other method known to one skilled in the art. Alternatively, cover 1268 may have a backing adhered to flat portion 1274 on a first side and the outside of bladder on a second side. Preferably, flat portion 1274 is adhered to an outside of the upper in the general vicinity of fluid connection junctions (such as fluid conjunctions 358 and 558 of FIGS. 3 and 5, respectively), such as in heel area 108 of FIG. 1. Dome portion 1275 is generally a half-cylinder shape with a closed first end 1276 and a second end 1277 open to receive second end 1273 of tube 1266. Cover 1268 also has one or more openings 1278 along the cylindrical part of dome portion 1275. Having openings 1278 on a generally vertical part of the shoe allows air to enter dome portion 1275, but keeps out dirt and moisture that may cause damage to the inflation mechanism. Thus, when there is a low pressure inside a heel compartment, air will flow into heel chamber via snorkel assembly 1262. In particular, air will flow into cover 1268 through openings 1278, through tube 1266 from second end 1273 to first end 1272, through valve chamber 1264 and a valve housed therein and into a heel compartment. In another embodiment, second end 1273 of tube 1266 may have a butterfly valve or other valve inside cover 1268 for additional protection of the inflation mechanism.

Snorkel assembly 1262 also has a sole component 1270. Sole component 1270 may be a midsole, an outsole, a thermoplastic plate or another part of a shoe sole, as are known to those skilled in the art. The sole component 1270 has a cavity 1280 therein. When sole component 1270 is adhered to a bladder, a heel compartment rests at least partially within cavity 1280. Cavity 1280 further has a recess 1282 into which valve chamber 1264 is inserted. Sole component 1270 also has a recess 1284 into which tube 1266 is inserted when the shoe is assembled. The snorkel assembly 1262 of the present invention is particularly described with respect to heel compartments 308, 508 of FIGS. 3 and 5, respectively. However, one skilled in the art can appreciate that snorkel assembly 1262 is appropriate for use with any underfoot inflation mechanism, such as those described with respect to further embodiments discussed below, or any other kind of inflation mechanism.

FIG. 13 shows yet another embodiment of the present invention. Shoe 1300 has a heel area shown generally at 1308, an arch area shown generally at 1303, a vamp area shown generally at 1305, a forefoot area shown generally at 1304, and a lateral side area generally shown at 1306. Shoe 1300 also includes a sole 1320 and an upper 1310 of which at least a portion entirely comprises an inflatable bladder 1330. In addition, upper 1310 of FIG. 1 has a toe portion 1334. As demonstrated in FIG. 13, bladder 1330 may form all portions of upper 1310, including toe portion 1334. Upper 1310 has an opening shown generally at 1312, which is designed to receive a wearer's foot.

Upper 1330 is formed from bladder 1330. Bladder 1330 is generally formed in the same manner described above with respect to the bladders of FIGS. 2, 3 and 5. However, air flows through bladder 1330 within generally cross-hatched channels 1382 formed by generally diamond shaped openings 1384 in bladder 1330. Openings 1384 are generally made in the same way as pockets 532 and 534 as described above with respect to FIG. 5. In other words, interior weld lines 1386 are formed in a closed diamond shape and the material inside of interior weld line 1386 is removed forming an opening 1384. Openings 1384 are particularly useful for cooling and drying the foot as synthetic material, such as polyurethane films, may cause the foot to generate moisture inside the shoe.

Bladder 1330 generally has a deflation mechanism 109, which may be any of the deflation mechanisms discussed above, or another deflation mechanism that would be apparent to one skilled in the art.

Further, bladder 1330 may have any type of inflation mechanism discussed above. Preferably, however, the inflation mechanism is an under foot inflation mechanism, similar to that described above with respect to FIGS. 3 and 5 and discussed further with respect to FIGS. 14-16.

FIG. 14 is generally an above plan view of a bladder 1430 that is similar to bladder 1330 shown in FIG. 13. Bladder 1430 includes an interior layer and an exterior layer of a thin film that are attached by a periphery weld line 1410 that surrounds bladder 1430. Bladder 1430 of FIG. 14 is constructed by stitching, or otherwise attaching, a first area 1489 of periphery weld line 1410 to a second area 1490 of periphery weld line 1410. Also, a third area 1491 of periphery weld line 1410 is stitched, or otherwise attached, to a fourth area 1492 of periphery weld line 1410 to form a left boot which surrounds most of the foot of the wearer. One skilled in the art can appreciate that a mirror image of bladder 1430 may be used to form a right boot.

Bladder 1430 comprises a vamp compartment 1453, a medial heel compartment 1458, and a heel compartment 1460. Vamp compartment 1453 is generally the largest compartment and provides cushioning to the medial side area 1488, vamp area 1305, lateral side area 1306 and a portion of heel area 1308. Vamp compartment 1453 is fluidly connected to medial heel compartment 1458 via fluid connection junction 1474. Medial heel compartment 1458 also provides cushioning to a portion of heel area 1308 and is fluidly connected to heel compartment 1460 via fluid passageways 1472 and 1473. Heel compartment 1460 provides cushioning to the heel of the foot and is preferably used as an inflation mechanism, as described in detail with respect to FIGS. 3 and 5. Bladder 1430 also has a deflation mechanism 109, as shown in a location of vamp area 1305 in FIG. 14. As discussed above, deflation mechanism 109 may be any deflation mechanism described above and may be located in any position on bladder 1430. Thus, in a typical gait cycle when the heel of the foot compresses heel compartment 1460, air will move out of heel compartment 1460, through a one-way valve 1480 and fluid passageways 1472 and 1473 into medial heel compartment 1458. From medial heel compartment 1458 fluid will move through fluid connection junction 1474 to inflate vamp compartment 1453. As air enters bladder 1430, the bladder may constrict around opening 1312, which operates as a closure for the shoe, such that laces, zippers, hook and loop or other closure system are not necessary.

As discussed above with respect to FIG. 13, vamp compartment 1453 and medial heel compartment 1458 have openings 1384 formed by interior weld lines 1386. FIG. 14 shows only the approximate locations of interior weld lines 1386. Openings 1384 can be of various sizes by making interior weld lines 1386 bigger or smaller in shape or by increasing or decreasing the widths of interior weld lines 1386. In addition to sizes, the locations, numbers and shapes of openings 1384 may be varied. Openings 1384 are spaced such that the inflatable area between them forms cross-hatched channels 1382. Further, the width of periphery weld lines 1410 may be larger or smaller than that shown in FIG. 14.

Bladders 1330 and 1430 as shown in FIGS. 13 and 14, respectively, make up almost all of upper 1310. However, FIGS. 15 and 16 show the top plan views of bladders 1530 and 1630 respectively that constitute a smaller portion of an upper. Thus, forefoot area 1304 is not covered by bladders 1530 and 1630 when they are fully assembled into a shoe. Vamp compartments 1553 and 1653, respectively, are shown in various sizes. In particular, vamp compartment 1553 of bladder 1530 is smaller than vamp compartment 1453 of bladder 1430. Thus, a shoe having bladder 1530 has less of the upper made from a bladder than a shoe having bladder 1430, as shown in FIG. 14. Similarly, vamp compartment 1653 of bladder 1630 is smaller than vamp compartment 1553 of bladder 1530. Thus, a shoe having bladder 1630 has less of the upper made from a bladder than a shoe having bladder 1530. However, medial heel compartments 1558 and 1658 and heel compartments 1560 and 1660 of FIGS. 15 and 16 are similar to medial heel compartment 1458 and heel compartment 1460 described above with respect to FIG. 14. FIGS. 15 and 16 show the preferred width of the interior weld lines 1586 and 1686, although interior weld lines 1586 may be a variety of widths, shapes and sizes.

FIG. 17 is a lateral side of a shoe 1700 which has a bladder 1730 similar to the bladder shown in FIG. 15. As discussed above, bladders of the present invention may be made of thin polyurethane film. The bladder in FIG. 17, however, is made from a metallized polyester film, such as MYLAR® (available from Dupont Teijin Films, Wilmington, Del.) or another thin, light weight polyester film. MYLAR® is particularly suited to be used in a bladder of the present invention because it has great strength in a very thin film. In addition, polyester films, such as MYLAR® are air-tight, tear-resistant and puncture resistant. Further, polyester films may be printed, embossed, dyed, clear, colored or metallized, which provides a variety of styles for a single shoe design. A bladder may be made from layers of polyester film has periphery and interior weld lines generally formed by heat sealing, or other such processes similar to those used in sealing packages in the food industry and/or the MYLAR® balloon industry. However, weld lines may also be made using any other method of forming an air tight seal with a polyester film, as would be known to those skilled in the art. Alternatively, the polyester film may be a composite of polyester film and urethane filaments or a very thin layer of polyurethane film, particularly for the formation of air tight seals around inflation and deflation mechanisms and components thereof. A polyester and polyurethane composite also has increased tear-resistance with the benefits of the lightweight nature of the polyester film.

Shoe 1700 is shown with openings 1784 cut inside interior weld lines 1786 to allow air to circulate through the shoe. Although openings are generally diamond-shaped in FIGS. 13-17, openings may be circular, square, oval, or any other closed regular or irregular shape. Thus, interior weld lines that form openings 1384/1784 can have an equal variety of shapes. In addition, openings 1384/1784 may vary in size and shape within various locations over the upper, as shown in FIGS. 13-17.

FIG. 18 shows another embodiment of the present invention in shoe 1800. FIG. 18 is a lateral view of shoe 1800. A medial side of shoe 1800 is similar in form. Shoe 1800 has an upper 1810 that includes a first bladder 1830*a* and a second bladder 1830*b*. First bladder 1830*a* is generally located in a vamp area 1805, and second bladder 1830*b* is generally located in a heel area 1808. A third bladder (not shown) is an underfoot inflation mechanism located substantially under the heel, as described above with respect to heel compartments 308, 508, 1460, 1560, and 1660 above. However, first and second bladders 1830*a* and 1830*b* are not manufactured as a single unit with the heel compartment in the embodiment shown in FIG. 18. Instead, the heel compartment is fluidly connected with first bladder 1830*a* via tubes 1890, and first bladder 1830*a* is fluidly connected with second bladder 1830*b* via tube 1891. In the embodiment shown in FIG. 18, tube 1891 is redirected through redirectional device 1892 between first and second bladders 1830*a* and 1830*b*. Although not shown in FIG. 18, a medial side of shoe 1800 would have tubes similar to tubes 1890 and 1891, such that the combination of bladders 1830*a*, 1830*b* and tubes 1890 and 1891 form an opening 1812 for a foot.

As a typical gait cycle occurs, air flows from the heel compartment through tubes 1890 into first bladder 1830*a* and from first bladder 1830*a* to second bladder 1830*b* through tube 1891. When inflated first and second bladders 1830*a* and 1830*b* close around an inserted foot such that laces or another closure system is not necessary.

Tubes 1890 and 1891 are fluidly connected to first and second bladders 1830*a* and 1830*b* via tube connections 1894. Tube connectors 1894 are thermoplastic cases that are fluidly connected to a hole in first bladder 1830*a* or second bladder 1830*b*. The tube connectors 1894 have a flat portion 1865 that is directly adhered to an exterior or interior surface of bladders 1830*a* and 1830*b*, depending on how tube connectors are integrated with bladders 1830*a* and 1830*b* as would be apparent to one skilled in the art. Tube connectors 1894 may be adhered via gluing, bonding, RF welding, heat welding, ultrasonic welding, or another other method known to one skilled in the art, forming an air-tight seal therewith. Tube connector 1894 also has a domed portion 1896. Domed portion 1896 is generally a half cylinder-shape with a closed first end 1897 and a second end 1898 comprising an opening, into which tube 1890 or tube 1891 is inserted. Tubes 1890 and 1891 and tube connectors 1894 form an air-tight seal such that air cannot escape where tubes are connected to first and second bladders 1830*a* and 1830*b*. In an alternate embodiment, air may flow from the heel compartment directly to second bladder 1830*b*. For example, tube 1891 could be two tubes 1891*a* and 1891*b* which are each connected to the heel compartment. Tubes 1890 and 1891 may be thermoplastic urethane or other thermoplastic tubing, and may be flexible or inflexible. Tubes 1890 extend into the sole 1820 of the shoe 1800. Shoe 1800 also includes a hard thermoplastic shank 1893, in which channels 1893*a* have been formed to receive tubes 1890 and direct them towards the heel compartment, to which they are fluidly connected under the foot of the wearer.

FIG. 18 also shows a tube 1866 and cover 1868 of a snorkel assembly, such as that described above with respect to FIG. 12, so that air can reach the heel compartment without a buildup of moisture in the inflation mechanism. Further, the embodiment of the present invention shown in FIG. 18 may include any of the deflation devices discussed above, e.g., one of the combination of release valves and check valves described above.

FIGS. 19*a* and 19*b* show one embodiment of a heel compartment assembly 1901, suitable to be used in the sole 1820 of shoe 1800 of FIG. 18. Heel compartment 1960 is fluidly connected to a plurality of tubes 1990 through a channel 1999. Channel 1999 is fluidly connected to heel compartment 1960 via a one way valve 1995. FIGS. 19*a* and 19*b* also show a valve chamber 1963 and a tube 1966 of a snorkel assembly 1962 as described above with respect to FIG. 12. Channel 1999 and heel compartment 1960 may be made by two or more layers of a flexible polyurethane film. Heel compartment 1960 may also include a polyurethane foam core, similar to that described above with respect to FIG. 5. Further, the embodiment of the present invention shown in FIG. 19 may include any of the deflation devices discussed above, e.g., one of the combination release valves and check valve described above.

Tubes 1990 are welded along with the film layers at a periphery weld line 1910 creating an air-tight seal around tubes 1990. Channel 1999 further has welds 1970. Welds 1970 are used to control the thickness of the channel 1999 when air is moving through it, and they help direct the flow of air into tubes 1990. Periphery weld line 1910 and welds 1970 may be formed by RF welding, heat welding, ultrasonic welding or by other suitable means.

FIG. 20 shows another shoe 2000 of the present invention which also uses a heel compartment assembly as shown in FIGS. 19*a* and 19*b*. Shoe 2000 is similar to shoe 1800, except that bladder 2030 is one piece. Bladder 2030 is fluidly connected to tubes 2090 via tube connectors 2094. Tube connectors 2094 have flat portions 2065 that are directly adhered to an exterior or interior surface of bladder 2030 via gluing, bonding, RF welding, heat welding, ultrasonic welding, or another other method known to one skilled in the art, forming an air-tight seal therewith. Tube connectors 2094 also have domed portions 2096. Domed portions 2096 are generally a half-cylinder shape with a closed first end 2097 and a second end 2098 comprising an opening, into which tube 2090 is inserted. Tubes 2090 and tube connector 2094 form an air-tight seal such that air cannot escape where tubes 2090 are connected to bladder 2030. As a typical gait cycle occurs, air flows from the heel compartment (not shown) through tubes 2090 into bladder 2030. When inflated bladder 2030 closes around an inserted foot such that laces or another closure system is not necessary.

Shoe 2000 also incorporates a shank 2093, which is formed with cavities 2093*a* for receiving tubes 2090. Shank 2093 may be a molded thermoplastic piece, a shaped metal plate, a midsole foam piece, or another other structure that would be apparent to one skilled in the art. Tubes 2090 arc fluidly connected with the heel compartment under the foot of the wearer, such as described above with respect to FIG. 19. Further, the embodiment of the present invention shown in FIG. 18 may include a snorkel assembly, such as that described above with respect to FIG. 12 and/or any of the deflation devices discussed above, e.g., one of the combination release valve and check valves described above.

Bladder 2030 may be connected to heel compartment via tubes 2090, as shown in FIG. 20. Alternatively, bladder 2030 and an underfoot inflation mechanism located either in the forefoot area or in the heel area may be formed as a unitary construction. One possible construction would be similar to that of shoe 2100 shown in FIG. 21.

FIG. 21 shows an exploded view of a shoe construction of shoe 2100 of the present invention. Bladder 2130 has two underfoot sections, a forefoot compartment 2164 and a heel compartment 2160. Either forefoot compartment 2164 or heel compartment 2160 may be an inflation mechanism, preferably heel compartment 2160, for inflating the remaining compartments of bladder 2130. Bladder 2130 is bonded to two outsole pieces 2120*a* and 2120*b*, via gluing or other type of adhesive. Outsole piece 2120*a* is bonded to heel compartment 2160, and outsole piece 2120*b* is bonded to forefoot compartment 2164. A portion of shank 2193 is bonded to both outsole pieces 2120*a* and 2120*b* and overlaps bladder 2130. Shank 2193 is used to provide support between the outsole pieces 2120*a* and 2120*b*. An optional midsole 2155 may be included over bladder 2130. Midsole 2155 may have indentations 2155*a* which receive and may be bonded to the interior of upper 2110. Additional, upper material (not shown) may be stitched to bladder 2130 and bonded to midsole 2155, particularly in toe area 2104. Additional material provides protection from the elements for an inserted foot where bladder 2130 does not cover the foot. Shoe 2100 may also have a sockliner 2123 above the midsole or above shank 2193. Other parts of shoe 2100 not shown may include a snorkel assembly as described with respect to FIG. 12, as well as other features that provide stability and protection to a wearer's foot.

FIG. 22 shows another shoe 2200 which incorporates the heel compartment assembly 1901 shown and described with respect to FIGS. 19*a* and 19*b* as an underfoot inflation mechanism. Shoe 2200 comprises an upper 2210 and a plurality of flexible, inflatable tubes 2290. When inflated, tubes 2290 expand and close around an inserted foot as inflatable laces, such that conventional laces or another closure system is not necessary. To remove shoe 2200 a deflation device (not shown) in fluid connection with tubes 2290, such as those discussed above, is activated releasing air from and collapsing tubes 2290. The deflation device may be any of the deflation devices discussed above, e.g., one of the combination release valve and check valve. Tubes 2290 are fluidly connected to a channel 1999 (as shown in FIG. 19) at both ends, forming a loop over upper 2210. As the wearer applies pressure to a heel compartment assembly, tubes 2290 inflate. FIG. 22 shows five tubes 2290 extending across a vamp area 2205 of shoe 2200 and three tubes 2290 extending across a heel area 2208. One skilled in the art can appreciate that more or less tubes 2290 may be used on shoe 2200. For example, shoe 2200 may have only one tube extend across each of the vamp area 2205 and heel area 2208. Alternatively, shoe 2200 may have no tubes in the heel area and only tubes in the vamp area, or vice-versa, provided that tubes 2290 when inflated help cushion and secure a foot inside shoe 2200.

Shoe 2200 also has a shank 2293 with cavities 2293*a* for receiving tubes 2290. Shank 2293 provides shoe 2200 with support and structure. Shoe 2200 may also have a covering layer of material (not shown) over tubes 2290.

Any embodiment of a shoe described or otherwise disclosed herein may include a sockliner, such as sockliner 2123 shown in FIG. 21. However, the same underfoot inflation mechanism described above may also be used in an inflatable sockliner. An overhead plan view of inflatable sockliner 2323 is shown in FIG. 23. Sockliner 2323 may also be made from two layers of a polyurethane film bonded by gluing, bonding, RF welding, heat welding, ultrasonic welding, or another other method known to one skilled in the art for forming an air-tight seal. Sockliner 2323 is generally defined by a periphery weld line 2310 and includes various compartments defined by both periphery weld line 2310 and various shaped interior weld lines 2320.

Sockliner 2323 has a heel compartment 2360 with a hole 2361 allowing air to enter heel compartment 2360. When hole 2361 is covered, and pressure is applied to heel compartment 2360, air is forced through one-way valve 2350 into a plurality of medial compartments 2354. Medial compartments 2354 are fluidly connected to a plurality of forefoot compartments 2364. Forefoot compartments 2364 are fluidly connected to a plurality of first phalanx compartments 2351 and a plurality of second through fifth phalax compartments 2353. Forefoot compartments 2364 are also fluidly connected to a plurality of lateral compartments 2356. The various compartments shown in FIG. 23 are designed to have the general shape of the foot of the wearer. However, more or less compartments and alternatively shaped compartments are suitable for a sockliner of the present invention.

Sockliner 2323 uses a perforation deflation mechanism described above. Preferably, sockliner 2323 has at least one perforation 2309, the location of which is shown in FIG. 23 by crossed lines. The material used to make sockliner 2323 may be of a flexible material such that perforation 2039 will generally remain closed. If the pressure in the sockliner 2323 becomes greater than a predetermined pressure the force on the sides of the sockliner 2323 will open perforation 2309 and air will escape. Since sockliner 2323 is inserted into the interior of a shoe, it will not be necessary for the wearer to have access to a deflation device within the shoe to avoid over inflation of sockliner 2323. However, one skilled in the art can appreciate that another deflation mechanism may be incorporated into sockliner 2323. Further, sockliner 2323 may have a snorkel assembly similar to that discussed in FIGS. 19*a* and 19*b* for introducing air into or out of sockliner 2323. Or may use an material permeable to air, but not to moisture or other environmental particles to cover an entry into an inflation mechanism, as discussed above.

Sockliner 2323 may be removable or may be permanently inserted into the shoe during the manufacture thereof. Further, sockliner 2323 may be used in any shoe of the present invention or in any conventional athletic, walking or hiking shoe or boot.

FIG. 24A shows a lateral view of a right shoe 2400 of yet another embodiment of the present invention. Shoe 2400 has a heel area shown generally at 2408, an arch area shown generally at 2403, a vamp area shown generally at 2405, a forefoot area shown generally at 2404. Shoe 2400 also includes a sole 2420 and an upper 2410 of which at least a portion comprises an inflatable bladder 2430. Upper 2410 has an opening shown generally at 2412, which is designed to receive a wearer's foot.

FIG. 24B is generally an above plan view of bladder 2430 shown in FIG. 24A. Bladder 2430 includes an interior layer and an exterior layer of a thin film that are attached by a periphery weld line 2410*a* that surrounds bladder 2430. Bladder 2430 of FIG. 14 is constructed by stitching, or otherwise attaching, a first area 2489 of periphery weld line 2410*a* to a second area 2490 of periphery weld line 2410*a*. One skilled in the art can appreciate that a mirror image of bladder 2430 may be used to form a left shoe which is a mirror image of right shoe 2400.

Bladder 2430 generally comprises a vamp compartment 2453, a medial heel compartment 2458, and a heel compartment 2460 all formed as a monolithic, fluidly continuous structure. Vamp compartment 2453 is generally X-shaped. Vamp compartment 2453 has a center 2452, which crosses the vamp of shoe 2400, as shown in FIG. 24A, in the perspective view shown in FIG. 24C and in the above view of shoe 2400 shown in FIG. 24D. As seen in FIG. 24B, vamp compartment 2453 includes arms 2470 formed by periphery weld line 2410*a*, extending from center 2452.

Vamp compartment 2453, has a lateral arm 2470*a*, which extends along a lateral side of shoe 2400 and is fluidly connected to medial heel compartment 2458 via fluid connection junction 2474. Fluid connection junction 2474, medial heel compartment 2458 and arm 2470*a* provide cushioning to a portion of heel area 2408 and cause bladder 2430 to surround opening 2412 of shoe 2400. As bladder 2430 inflates, opening 2412 closes around the wearer's foot. As such, bladder 2430 better holds the shoe onto a wearer's foot and presses against the top of the arch of a wearer's foot.

Medial heel compartment 2458 is fluidly connected to heel compartment 2460 via fluid passageways 2472 and 2473. Heel compartment 2460 provides cushioning to the heel of the foot and is preferably used as an inflation mechanism, as described in detail with respect to heel compartments 308 and 508 of FIGS. 3 and 5. Bladder 2430 also has a deflation mechanism 109, shown located at a rear end 2436 of lateral arm 2470*a* of vamp compartment 2453 in FIGS. 24A and 24B, and in rear perspective view of shoe 2400 in FIG. 24E. As discussed above, deflation mechanism 109 may be any deflation mechanism such as those particularly described or otherwise disclosed herein and may be located in any position on bladder 2430.

Thus, in a typical gait cycle when the heel of the foot compresses heel compartment 2460, air will move out of heel compartment 2460, through a one-way valve 2480 and fluid passageways 2472 and 2473 into medial heel compartment 2458. From medial heel compartment 2458, fluid will move through fluid connection junction 2474 to lateral arm 2470*a* of vamp compartment 2453 and on into the center 2452 and other arms 2470 of vamp compartment 2453. As air enters bladder 2430, the bladder constricts opening 2412, which operates as a closure for the shoe, such that laces, zippers, hook and loop or other closure system are not necessary.

In an alternate embodiment, heel compartment 2460 may be separate from and/or not formed integrally with the rest of bladder 2430. In this embodiment, as shoe 2400 is constructed, heel compartment 2460 is subsequently connected to medial heel compartment by tubing or barb fitting. In fact, any monolithic bladder embodiment shown and described herein may be constructed with a satellite inflation mechanism in a heel compartment separated from the inflatable bladder forming a portion of an upper as described or otherwise disclosed herein. An example of such a satellite inflation mechanism is particularly described below with respect to FIGS. 33A and 33B.

As illustrated in FIG. 24A, bladder 2430 does not encompass the entire upper. FIG. 24 shows at least a first portion 2484*a* of upper 2410 located on a lower vamp portion of shoe 2400, a second portion 2484*b* of upper 2410 located on a lateral side of shoe 2400 and a third portion 2484*c* of upper 2410 located at a heel area 2408 of shoe 2400, which, rather than being part of a bladder 2430, is cut out and a breathable mesh material is attached therein. FIG. 24D further shows at least a fourth portion 2484*d* of upper 2410 located on a medial side of shoe 2400 that also is a breathable mesh material rather than a bladder 2430. These portions 2484*a*, 2484*b*, 2484*c*, and 2484*d* of upper 2410 are particularly useful for providing ventilation for cooling and drying the foot, which is common where synthetic materials such as the materials used to form bladder 2430 surround the foot.

As with several other embodiments described above, bladder 2430 also includes interior weld lines 2486, so that certain locations of bladder 2430 do not over inflate. Further, the width of periphery weld line 2410*a* may be larger or smaller than that shown in 24A and 24B. Vamp compartment 2453 further includes a position 2437 for a logo or other indicia.

In one embodiment of the present invention, a user may not want a bladder to inflate with each step, such as during casual walking, sitting or standing. As such, a deflation device 109 for a bladder described or otherwise disclosed herein maybe a release valve that has an open and a closed position, such that the valve can be held in the open position. In an open position, the release valve completely opens, allowing any air in the bladder to escape through the open valve. Thus, no pressure builds in the bladder and the bladder does not inflate. When in a closed position, the valve completely closes, such that an underfoot inflation mechanism will inflate the bladder.

FIGS. 25A-25F illustrate an embodiment of a combination check valve and release valve 2501, wherein the release valve is capable of being held in an open position. Combination check valve and release valve 2501 includes a base 2506 and a cap 2510. Cap 2510 is a bezel with beveled walls and a hole 2511 through which a user can access a switch 2507 for opening and closing the release valve.

FIG. 25B shows an exploded view of the combination check valve and release valve 2501 of FIG. 25A, and FIG. 25D is a cross sectional view along line D-D of FIG. 25C, which is an above view of the combination check valve and release valve of FIG. 24A. As seen in FIGS. 25B and 25D, base 2506 includes a first air inlet 2530, into which umbrella valve 2508 is positioned forming a first air tight seal with first inlet 2530. Base 2506 also includes a flange portion 2548 which can be sealed with either an interior or an exterior of a layer of an inflatable bladder, such as those described above, via gluing, bonding, RF welding, heat welding, laser welding, ultrasonic welding or another method know to one skilled in the art.

Umbrella valve 2508 has a general umbrella-shape which is thick in the middle but includes a thin flap 2518 which rests against and forms an air tight seal with a surface 2517 of base 2506. Air from the bladder travels through a slot 2524 cut out along the stem of the umbrella valve 2508. Umbrella valve 2508 is preferably made of a material which is more rigid when thick and somewhat flexible when thin, such as silicone, so that thin flap 2518 is somewhat elastic. When the air pressure at inlet 2530, and therefore the pressure in a bladder, such as those described or otherwise disclosed herein, reaches a predetermined pressure, thin flap 2518 is deformed and lifted off of surface 2517 of base 2506, similar to the operation of the umbrella valve 708 discussed above with respect to FIGS. 7A-7D.

An interior wall 2513 extends from base 2506. FIG. 25B shows two of three base lips 2531*a* and 2531*b* which protrude from wall 2513. Three base lips engage three cap lips (of which only one cap lip 2525*a* is shown in FIG. 25B and another cap lip 2525*b* is shown in FIG. 25D) formed in a interior surface 2525 of cap 2510. FIG. 25D illustrates how base lip 2531*a* engages a second cap lip 2525*b*, which is not shown in FIG. 25B. As such, when fully assembled, cap 2510 snaps into place over base 2506 and is held in place by the engagement of base lips 2531*a*/2531*b* and cap lips 2525*a*/2525*b*.

Switch 2507 has two positions: an open position and a closed position. Switch 2507 rocks back and forth between the open and closed positions with respect to base 2506 via two pivot arms 2515. FIG. 25A shows one pivot arm 2515, and another identical pivot arm (not shown) extends from an opposite side of switch 2507 from pivot arm 2515. A pivot 2515*a* extending from pivot arms 2515 engages holes 2519 in wall 2513 of base 2506. Attached to an underside 2507*c* of switch 2507 is a sealing pad 2521. In a closed position, sealing pad 2521 engages and closes second inlet 2520 in base 2506. FIG. 25D shows switch 2507 in a closed position. When switch 2507 is rocked to an open position (not shown) sealing pad 2521 lifts off of second inlet 2520 in base 2506, allowing air to freely flow through second inlet 2520 and out of an outlet hole 2532, through which air escapes the housing formed from cap 2510 and base 2506.

Switch 2507 has two closed snap locks, one closed snap lock 2533 shown in FIG. 25A and an identical closed snap lock (not shown) on the opposite side of switch 2507 from closed snap lock 2533. Closed snap locks 2533 include protrusions 2533*a* that engage holes 2513*a* and 2513*b* in interior wall 2513 of base 2506 to hold switch 2507 in a closed position. Further, a guide 2535 slides along an interior surface 2513*c* of wall 2513 of base 2506 to help align snap locks 2533 with holes 2513*a*/2513*b* when moving switch 2507 towards a closed position. Switch 2507 also includes an open snap lock 2541 which protrudes from an exterior surface of switch 2507. Open snap lock 2541 engages a hole 2543 in interior wall 2513 of base 2506 to hold switch 2507 in an open position. Open snap lock 2541 may also be used to hold switch 2507 in a closed position, as shown in FIG. 25D. When switch is in a closed position, open snap lock 2541 is held in place by resting against an end surface 2513*d* of wall 2513, so that open snap lock 2541 will not move past the end surface 2513*d* without sufficient force.

Switch 2507, base 2506 and cap 2510 may be injection molded pieces formed from a thermo plastic resin, such as thermoplastic polyurethane (TPU) including those described above for portions of combination check valve and release valve 701 of FIGS. 7A-7D. Alternatively, these pieces may be formed by blow molding or thermoforming thermoplastics, or by another method of forming plastic parts that would be apparent to one skilled in the art.

In order to move the release valve from a closed to an open position, a user pushes on a first side 2507*a* of switch 2507 with enough force to disengage closed snap locks 2533 from holes 2513*a*/2513*b*, and to push open snap lock 2541 past end surface 2513*d* of wall 2513. Switch 2507 rocks along pivots 2515*a* until sealing pad 2521 lifts off of second inlet 2520 opening the release valve and open snap lock 2541 engages hole 2543 locking the release valve in an open position. A user can then push on a second side 2507*b* of switch 2507 with enough force to disengage open snap lock 2541 from hole 2543 and rock switch back to a closed position, where sealing pad 2521 engages and seals second inlet 2520 and closed snap locks 2533 engage holes 2513*a*/2513*b* of base 2506 locking the release valve in a closed position. When in a closed position, air will still be released by umbrella valve 2508 when the air pressure at first inlet 2530 reaches a predetermined pressure.

FIG. 25E shows another combination check valve and release valve 2501*a* in cross section. Combination check valve and release valve 2501*a* is identical to combination check valve and release valve 2501 of FIGS. 25A-25D, except that cap 2510*a* is sealed over switch 2507 so as to avoid moisture, dirt or other environmental particles from entering combination check valve and release valve 2501*a*. In particular, cap 2510*a* does not include a hole 2511, but rather includes a flexible membrane 2511*a* covering switch 2507. Flexible membrane 2511*a* may be a very thin thermoplastic polyurethane. Pressing on the membrane 2511*a* over the switch 2507 allows the user to rock the switch 2507 from the on position to the off position and vice versa. In order that a flexible membrane 2511*a* allows air to exit combination check valve and release valve 2501*a*, flexible membrane 2511 includes a pin hole 2511*b*.

Further, cap 2501*a* includes a flange 2542 which is sealed to flange 2548 of base 2506 and to an interior surface 2509*a* of an inflatable article 2509 at an opening 2509*b* therein. As with all of the combination check valve and release valves described or otherwise disclosed herein, combination check valve and release valve 2501*a* accesses a bladder 2509 at only one location via a single opening 2509*b* in bladder 2509.

In another embodiment of a combination check valve and release valve 2501*b* shown in cross-section in FIG. 25F, cap 2510*b* shown in FIGS. 25A-25D, having a hole therein 2511 through which a switch 2507 may be accessed may be covered by a thermoplastic covering 2511*c* of flexible thermoplastic material having the general shape of cap 2501 which provides protection from moisture and other environmental particles. Switch 2507 may be rocked back and forth by pressing on the covering 2511*c* rather than directly on the switch 2507. The covering may be sealed to flange 2548 of base 2506 and to an interior surface 2509*a* of an inflatable article 2509 at an opening 2509*b* therein. Flexible covering 2511*c* includes a pin hole 2511*b* in order than the air may escape the combination check valve and release valve. 2501*b*.

In other embodiments, such as combination check valve and release valves 2601*a* and 2601*b* shown in cross-section in FIGS. 26A and 26B, respectively, cap 2610*a* and cap 2610*b* act similarly to switch 2507 of FIGS. 25A-25F and rock via pivots (not shown) with respect to base 2606. In this case, no additional switch is required as sealing pad 2621 is attached to an underside 2607*a* of cap 2610*a*/2610*b*. When caps 2610*a*/2610*b* respectively are rocked into an open position, sealing pad 2621 lifts off of second inlet 2620, allowing air to escape from a hole 2632 in cap 2610*a*/2610*b*.

In the embodiment shown in FIG. 26A, cap 2610*a* slides against an exterior surface 2613*a* of a wall 2613 extending from base 2606. In the embodiment shown in FIG. 26B, cap 2610*b* glides against an interior surface 2613*b* of a wall 2613 extending from base 2606. Further, FIG. 26B illustrates that cap 2610*b* has an open snap lock 2641 that engages a hole 2643 in wall 2613. Open snap lock 2641 holds cap 2610*b* in place when it is rocked into an open position. In yet another embodiment, a combination release valve check valve (not shown) similar to those described or otherwise disclosed herein, may include a mechanism, similar to that of a retractable ball point pen, wherein a sealing pad engages a second inlet, such as second inlet 2620, upon depressing a cap one time and disengages a second inlet when cap is depressed a second time.

In another embodiment, a combination check valve an release valve 2701 is illustrated in FIGS. 27A-27D. In this embodiment, combination check valve and release valve 2701 includes a base 2706, a cap 2710 and a switch 2707. FIG. 27A shows a side plan view of combination check valve and release valve 2701 showing a cutout 2711 in cap 2710 for access to switch 2707. Cap 2710 and base 2706 form a housing enclosing an umbrella valve 2708 (see FIG. 27C), which is inserted into and forms a first air tight seal with a first fluid inlet 2730 in base 2706. Base 2706 also includes a second fluid inlet 2720.

Base 2706 and cap 2710 are sealed along a cap flange 2742 and a base flange 2748. Cap flange 2742 may be sealed to an interior of a layer of an inflatable bladder, such as those describe or otherwise disclosed herein. Alternatively, base flange 2748 may be sealed to an exterior of a layer of a bladder or a layer of a bladder may be sealed between cap flange 2742 and base flange 2748. Combination check valve and release valve 2701 may be sealed to bladder by gluing, bonding, RF welding, heat welding, ultrasonic welding or another sealing method. As such, combination check valve and release valve 2701 accesses only one location of a bladder via a single opening in the bladder.

FIG. 27B is an above plan view of combination check valve and release valve 2701 showing that cap 2710 also has a hole 2711*a* so that switch 2707 may lift with respect to cap 2710. Switch 2707 rocks from a closed position to an open position via pivots 2715, which couple switch 2707 to cap 2710. Switch 2707 also includes a hole 2732 therein for air to release from combination check valve and release valve 2701. Pressure by a user on a first side 2707*a* of switch 2707 will rock switch 2707 to an open position and pressure by a user on a second side 2707*b* will rock switch 2707 into a closed position.

FIG. 27C is a cross-section view taken along line C-C of FIG. 27B illustrating combination check valve and release valve 2701 with switch 2707 in an open position. When in an open position, a sealing pad 2721 coupled to an underside 2707*c* of switch 2707 is lifted off of second fluid inlet 2720. Switch 2707 is held in an open position by a stop 2741 protruding from cap 2710. A guide 2735 extending from switch 2707 includes an abutting surface 2735*a*, which presses against stop 2741. With enough force placed on second side 2707*b*, guide 2735 will slide past stop 2741 into a closed position, shown in FIG. 27D. In a closed position, sealing pad 2721 contacts and seals second fluid inlet 2720, such that a bladder fluidly connected with combination check valve and release valve 2701 will inflate. When the pressure in bladder and therefore the pressure at first inlet 2730 reaches a predetermined pressure, flap 2718 of umbrella valve 2708 will lift from base 2706 and air will escape bladder and combination check valve and release valve 2701 through hole 2732.

FIG. 28A illustrates a combination check valve and release valve 2801 with an adjustable check valve in an exploded view. FIG. 28B is a cross sectional view of combination check valve and release valve 2801 taken along line B-B shown in FIG. 28A.

Combination check valve and release valve 2801 includes a base 2806 and a cap 2810 forming a housing. Base 2806 and cap 2810 are sealed along a cap flange 2842 and a base flange 2848. Cap flange 2842 may be sealed to an interior of a layer of an inflatable bladder, such as those describe or otherwise disclosed herein. Alternatively, base flange 2848 may be sealed to an exterior of a layer of a bladder or a layer of a bladder may be sealed between cap flange 2842 and base flange 2848. Combination check valve and release valve 2801 may be sealed to bladder by gluing, bonding, RF welding, heat welding, ultrasonic welding or another sealing method. As such, combination check valve and release valve 2801 accesses only one location of a bladder via a single opening in the bladder.

Base 2806 has a first inlet 2830 and one or more second inlets 2820. An umbrella valve 2808 forms a first air tight seal with first inlet 2830, and a release valve 2860 forms a second air tight seal with second inlet 2820. Release valve 2860 includes a plunger 2860*a* creating the second seal with base 2806. The second seal is created where a flange 2860*b* extending from a head 2860*c* of release valve 2860 contacts base 2806. Air from second inlets 2820 creates pressure under head 2860*c* of release valve 2860. When head 2860*c* of release valve 2860 is deformed, such as by applying a force from the side perpendicular to a general axis of release valve 2860, flange 2860*b* is also deformed and partially lifts away from base 2806 to release second air tight seal. When head 2860*c* is no longer deformed, flange 2860*b* returns to a natural state and flange 2860*b* again forms the second air tight seal against base 2806. Alternatively, release valve 2860 may be a plunger and a spring, similar to that described above and shown in release valve 1160 of FIG. 11. In this case, a spring is used to bias plunger 2860*a* against base 2806. Pressing down on plunger 2860*a* causes it to move away from base 2806 to release the seal between plunger 2860*a* and base 2806. Similarly, a material used to make plunger 2860*a* may be have an elastic tendency that may be used to the same effect as a spring to bias plunger 2860*a* towards base 2806.

Cap 2810 has a hole 2811 therein. A pressure disk 2807 and a knob portion 2847*a* of a cam 2847 are accessible through hole 2811 of cap 2810. Further, cap 2810 includes an interior wall 2810*a* have a first series of threads 2810*b*. Meanwhile, pressure disk 2807 has an exterior wall 2807*a* with a second series of threads 2807*b*, which engage first series of threads 2810*b* of cap 2810. Pressure disk 2807 has a first surface 2807*c* which rests on an first surface 2847*b* of cam 2847. Pressure disk also has an second surface 2807*d* which is spaced from a second surface 2847*c* of cam 2847. Cam 2847 also has a third surface 2847*d* which contacts a crown 2808*a* of umbrella valve 2808.

Umbrella valve 2808, as illustrated in FIG. 28A functions similarly to that of umbrella valve 808 as described above with respect to FIGS. 8A-8B. When the air pressure at inlet 2830, and therefore the pressure in a bladder, such as those described or otherwise disclosed herein, reaches a predetermined pressure, thin flap 2818 is deformed and lifted off of a second surface 2817 of base 2806. However, the application of pressure to a crown 2808*a* of umbrella valve 2808 will press flap 2818 of umbrella valve 2808 more firmly against second surface 2817 of base 2806. As such, the pressure at an inlet 2830 must be greater in order to lift flap 2818 to release umbrella valve 2808.

To adjust umbrella valve 2808, a user causes pressure disk 2807 to spin. Any type of handle or knob (not shown) may be used to cause pressure disk 2807 to turn. As pressure disk 2807 spins, the engaged threads 2807*a* and 2810*a* cause pressure disk 2807 to be forced towards base 2806. The first surface 2807*c* of pressure disk 2807 presses against the first surface 2847*b* of cam 2847, which in turn causes third surface 2847*d* of cam 2847 to press on the crown 2808*a* of umbrella valve 2808. As discussed above, an increase in pressure on a crown of an umbrella valve increases pressure on a flap 2818 against base 2806. As such, additional pressure at first inlet 2830 is required to cause flap 2818 to lift, thus increasing the resistance of the umbrella valve. An additional feature of cam 2847 is that it isolates the turning motion of pressure disk 2807 from umbrella valve 2808. Pressure disk 2807 moves freely with respect to cam 2847. Thus, in turning pressure disk 2807, umbrella valve 2808 will not twist or turn so as to be unseated, prematurely releasing the seal formed with base 2806.

To operate release valve 2860, deforming pressure is applied to head 2860, such as from the side thereof, so as to cause flange 2860*b* to deform and break the second air-tight seal.

Another embodiment of a combination check valve and release valve 2901 including an adjustable check valve is shown in FIGS. 29A-29C. FIG. 29 is an above plan view of combination check valve and release valve 2901. FIG. 29B is a cross sectional view along a line B-B of FIG. 29A. FIG. 29C is an above exploded view of combination check valve and release valve 2901 of FIG. 29A. FIG. 29D is a below exploded view of combination check valve and release valve 2901 of FIG. 29A.

Combination check valve and release valve 2901 includes a base 2906 and a cap 2910 forming a housing enclosing an umbrella valve 2908 and a release valve 2960. Base 2906 includes a flange 2948 which is sealed to either an interior or an exterior of an inflatable bladder, such as those described or otherwise disclosed herein. Base 2906 also includes a first fluid inlet 2930 and a plurality of second fluid inlets 2920.

Umbrella valve 2908 forms a first seal with first fluid inlet 2930 and function similarly to umbrella valve 2808 as described with respect to FIGS. 28A-28B. Combination check valve and release valve 2901 also includes a pressure disk 2907 accessible from an opening 2911 in a side of cap 2910. Pressure disk 2907 has an interior surface 2907*a* with threads 2907*b*. Base 2906 has an interior wall 2913 with an exterior surface 2913*a* having threads 2913*b* which engage threads 2907*b* of pressure disk 2907. Pressure disk 2907 further includes a hole 2907*c* therein. Cap 2910 has a guide 2935 protruding from an interior surface 2910*a* of cap 2910 and extending through hole 2907*c* in pressure disk 2907 to align pressure disk 2907 with a crown 2908*a* of umbrella valve 2908.

To adjust the umbrella valve 2908, pressure disk 2907 is turned from outside of the housing formed by cap 2910 and base 2906. As pressure disk 2907 turns, the engaged threads 2907*b* and 2913*b* cause pressure disk 2907 to be forced towards base 2906 along guide 2935.

Pressure disk 2907 exerts pressure where it contacts crown 2908*a* of umbrella valve 2908. As discussed above, an increase in pressure on a crown of an umbrella valve increases pressure on flap 2918 against base 2906. As such, additional pressure at first inlet 2930 is required to cause flap 2918 to lift.

Further, a stop 2941 protrudes from interior surface 2910*a* of cap 2910. Stop 2941 engages a series of divots 2949 on a first exterior surface 2907*d* of pressure disk 2907. As pressure disk 2907 turns, stop 2941 holds pressure disk 2907 at a variety of positions, thus holding the resistance of umbrella valve 2908, such that it will release at a particular predetermined pressure at inlet 2930. Cap 2910 also includes a window 2981 through which can be viewed one or more indicia 2983 printed on or etched into a second exterior surface 2907*e* of pressure disk 2907. Indicia 2983 provides a gauge for a user to determine different levels of resistance of umbrella valve 2908.

Similar indicia for gauging the level of resistance of an umbrella valve are suitable for any of the embodiment of adjustable check valves described or otherwise disclosed herein. Such indicia may be printed anywhere on a valve, such as on a cap or base thereof, on a bladder sealed with a valve or on a margin where a bladder and a valve are welded or sealed together.

The release valve 2960 of combination check valve and release valve 2901 forms a second seal over the plurality of second inlets 2920 where a flange 2960*b* on a head 2960*c* of release valve 2960 contacts base 2906. Combination check valve and release valve 2901 also includes a side button 2985, which is biased away from release valve 2960 by arms 2985*a*, which engage brackets 2910*a* formed in cap 2910. When side button 2985 is pushed towards release valve 2960, a center wedge 2985*b* is pushed past brackets 2910*a* and engages a side of head 2960*c* of release valve 2960. Wedge 2985*b* pushes head 2960*c*, so that head 2960*c* and flange 2960*b* deform and release the seal formed by flange 2960*b* and base 2906 and allowing air to escape from combination check valve and release valve 2901. In alternate embodiments, release valve 2960 may be a plunger-type valve, such as those described with a spring, as in FIGS. 11A and 11B, or biased by the elastic nature of the material used to form a head of a plunger.

Figure 30F:
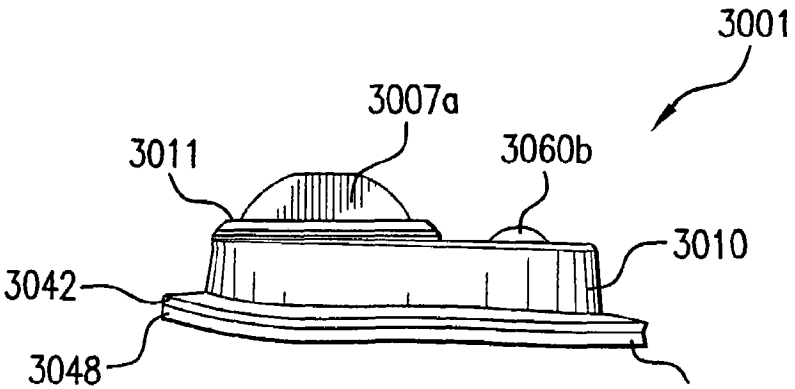
Figure 30D:
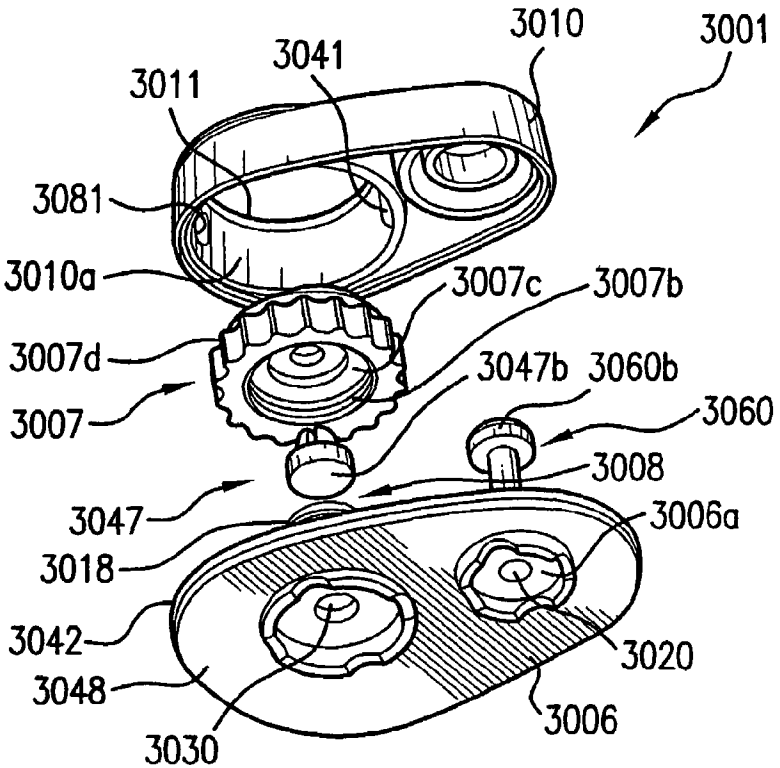

Another embodiment of a combination check valve and release valve 3001 is shown in FIGS. 30A-30F. FIG. 30A shows an above partial cross sectional view of the combination check valve and release valve 3001 taken along the line A-A of FIG. 30B, while FIG. 30B is a cross-sectional view taken along line B-B of FIG. 30A. FIG. 30D is a below exploded view of combination check valve and release valve 3001. FIGS. 30E and 30F are plan views of a front and side respectively of combination check valve and release valve 3001. Combination check valve and release valve 3001 includes a base 3006 having a first inlet 3030 and a second inlet 3020.

Base 3006 forms a housing with a cap 3010. Base 3006 includes a first flange 3042 and a second flange 3048. First flange 3042 may be sealed to an interior of a layer of an inflatable bladder, such as those describe or otherwise disclosed herein. Alternatively, second flange 3048 may be sealed to an exterior of a layer of a bladder or a layer of a bladder may be sealed between first flange 3042 and second flange 3048. Combination check valve and release valve 3001 may be sealed to bladder by gluing, bonding, RF welding, heat welding, ultrasonic welding or another sealing method. As such, combination check valve and release valve 3001 accesses only one location of a bladder via a single opening in the bladder. In another embodiment, first flange 3042 may be integral with cap 3010 rather than with base 3006.

Often the materials used to form a bladder may be different and/or incompatible with the materials used to form a valve, such that they may not be directly sealed together. For example, the material used to make combination check valve and release valve 3001 may be nylon or another material that is unsuitable for welding directly with a polyurethane or other material used to form a bladder. In this case, one of first flange 3042 or second flange 3048 may instead be an intermediate material that allows unlike or incompatible materials to be bonded together by one of the methods discussed above, such as by RF welding. As such, the intermediate material, rather than the flange that forms part of the combination check valve and release valve 3001 is welded to the bladder to form an air tight seal. Such an intermediate material may be used to bond any of the valves described or otherwise disclosed herein to any type of bladder described or otherwise disclosed herein.

An umbrella valve 3008 is disposed in the housing formed by cap 3010 and base 3006 and forms a first air tight seal with first inlet 3030, and a release valve 3060 forms a second air tight seal with second inlet 3020. Release valve 3060 functions similarly to that described in FIG. 11A and 11B. Release valve 3060 includes a plunger 3060*a* creating a seal with base 3006, as plunger 3060*a* is biased towards a first surface 3006*a* of base 3006. The bias is created by a spring 3022 positioned between a head 3060*b* of release valve 3060 and an second surface 3017 of base 3006. When head 3060*b* of release valve 3060 is depressed, spring 3022 compresses and plunger 3060*a* is pushed away from the first surface 3006*a* of base 3006 to release second air tight seal. When head 3060*b* is no longer depressed, spring 3022 expands to a natural state again biasing plunger 3060*a* against base 3006. Alternatively, release valve 3060 may be another type of release valve described or otherwise disclosed herein.

Cap 3010 has a hole 3011 therein. A pressure disk 3007 includes a knob portion 3007*a* which is accessible through hole 3011 of cap 3010. Knob portion 3007*a* protrudes from pressure disk 3007 and includes a first side 3007*a*' and a second side 3007*a*", such that a user may place a finger on first side 3007*a*' and a thumb on second side 3007*a*" to turn pressure disk 3007. Further, pressure disk 3007 includes a first interior surface 3007*b* having a first series of threads. Meanwhile, base 3006 has a wall 3013 with an exterior surface 3013*a* having a second series of threads, which engage first series of threads of pressure disk 3007. Pressure disk 3007 has a second interior surface 3007*c* which rests on an first surface 3047*a* of a cam 3047. Cam 3047 also has a second surface 3047*b* which contacts a crown 3008*a* of umbrella valve 3008.

Umbrella valve 3008 functions similarly to that of umbrella valve 808 as described above with respect to FIGS. 8A-8B. When the air pressure at inlet 3030, and therefore the pressure in a bladder, such as those described or otherwise disclosed herein, reaches a predetermined pressure, thin flap 3018 is deformed and lifted off of a third surface 3017*a* of base 3006. However, the application of pressure to a crown 3008*a* of umbrella valve 3008 will press flap 3018 of umbrella valve 3008 more firmly against third surface 3017*a* of base 3006. As such, the pressure at an inlet 3030 must be greater in order to lift flap 3018 to release umbrella valve 3008.

To adjust umbrella valve 3008, a user turns knob 3007*a* of pressure disk 3007, which in turn causes pressure disk 3007 to spin. As pressure disk 3007 spins, the engaged threads on first interior surface 3007*b* and on exterior surface 3013*a* of wall 3013 causes pressure disk 3007 to be forced towards base 3006. The second interior surface 3007*c* of pressure disk 3007 presses against the first surface 3047*a* of cam 3047, which in turn causes second surface 3047*b* of cam 3047 to press on the crown 3008*a* of umbrella valve 3008. As discussed above, an increase in pressure on an umbrella valve increases pressure on a flap 3018 against base 3006. As such, additional pressure at first inlet 3030 is required to cause flap 3018 to lift, thus increasing the resistance of umbrella valve 3008. As discussed above with respect to cam 2847 of FIG. 28, cam 3047 isolates the turning motion of pressure disk 3007 from umbrella valve 3008. Pressure disk 3007 moves freely with respect to cam 3047. Thus, in turning pressure disk 3007, umbrella valve 3008 will not twist or turn so as to be unseated, prematurely releasing the seal formed with base 3006.

Further, a stop 3041 protrudes from an interior surface 3010*a* of cap 3010. Stop 3041 engages a series of divots 3049 on an exterior surface 3007*d* of pressure disk 3007. As pressure disk 3007 turns, stop 3041 holds pressure disk 3007 at a variety of positions, thus holding the resistance of umbrella valve 3008, such that it will release at various particular predetermined pressures. Cap 3010 also includes a window 3081 through which exterior surface 3007*d* of pressure disk 3007 is visible. Exterior surface 3007*d* may include one or more indicia 3083 printed or etched thereon, to provide a gauge for a user to determine different levels of resistance of umbrella valve 3008.

Another embodiment of a combination check valve and release valve 3101 is shown in FIGS. 31A-31F. FIG. 31A shows an above perspective view of the combination check valve and release valve 3101. FIG. 31B is an above partial cross-sectional view taken along the line B-B of FIG. 31C, while FIG. 31C is a cross-sectional side view taken along line C-C of FIG. 31B. FIG. 31D is a rear cross-sectional view taken along a line D-D of FIG. 31B. FIG. 31E is an above exploded view of combination check valve and release valve 3101. FIG. 31F is a below exploded view of combination check valve and release valve 3101.

Combination check valve and release valve 3101 includes a base 3106 and a cap 3110. Base 3106 includes a base flange 3148, and cap 3110 includes a cap flange 3142. Cap flange 3142 may be sealed to an interior of a layer of an inflatable bladder, such as those describe or otherwise disclosed herein. Alternatively, base flange 3148 may be sealed to an exterior of a layer of a bladder or a layer of a bladder may be sealed between cap flange 3142 and base flange 3148. Combination check valve and release valve 3101 may be sealed to bladder by gluing, bonding, RF welding, heat welding, ultrasonic welding or another sealing method. As such, combination check valve and release valve 3101 accesses only one location of a bladder via a single opening in the bladder.

In yet another embodiment, combination check valve and release valve 3101 may be made from a material different from or incompatible with the material used to form a bladder sealed thereto. As such, cap flange 3142 and/or base flange 3148 may be an intermediate material such as that described with respect to FIGS. 30A-30F. Alternatively, one or both of cap flange 3142 and base flange 3148 may have an intermediate material subsequently attached thereto for bonding the flanges 3142, 3148 to bladder, as described above.

A first inlet 3130 is formed in base 3106. A seating 3125 projects from an first surface 3110*a* of cap 3110. Seating 3125 includes a shoulder 3125*a* (see FIG. 31C). Further, when cap 3110 and base 3106 are sealed, seating 3125 extends through a hole 3106*a* in base 3106 and shoulder 3125*a* engages a ridge 3106*b* formed in base 3106 to secure cap 3110 to base 3106. A second inlet 3120 is formed in seating 3125. An umbrella valve 3108 is disposed in a housing formed by a pressure disk 3107 and base 3106 and forms a first air tight seal with first inlet 3130. A release valve 3160 forms a second air tight seal with second inlet 3120.

Release valve 3160 functions similarly to that described in FIG. 11A and 11B. Release valve 3160 includes a plunger 3160*a* creating a seal with seating 3125, as plunger 3160*a* is biased towards a first surface 3125*b* of seating 3125. The bias is created by a spring 3122 positioned between a head 3160*b* of release valve 3160 and an second surface 3125*c* of seating 3125. When head 3160*b* of release valve 3160 is depressed, spring 3122 compresses and plunger 3160*a* is pushed away from the first surface 3125*b* of seating 3125 to release the second air tight seal. When head 3160*b* is no longer depressed, spring 3122 expands to a natural state again biasing plunger 3160*a* against seating 3125. Alternatively, release valve 3160 may be another type of release valve described or otherwise disclosed herein.

Cap 3110 has a hole 3111 therein. Pressure disk 3107 engages an interior wall 3113 of base 3106 through hole 3111 of cap 3110. Interior wall 3113 of base 3106, as shown in FIG. 31E, includes two inclined tracks 3145*a* and 3145*b*. These tracks engage posts 3107*a* formed in pressure disk 3107. As pressure disk 3107 turns with respect to base 3106, inclined tracks 3145*a* and 3145*b* move pressure disk 3107 toward and away from base 3106. Interior wall 3113 also includes springs 3122*a*, which bias against an interior surface 3107*b* of pressure disk 3107, to bias pressure disk 3107 towards the more inclined portion of tracks 3145*a* and 3145*b*. Interior wall 3113 also includes guides 3135, for engaging notches 3179*a* formed in a lever 3179. Lever 3179 contacts a crown 3108*a* of umbrella valve 3108. A cam 3147 extends from interior surface 3107*b* of pressure disk 3107.

Umbrella valve 3108 functions similarly to that of umbrella valve 808 as described above with respect to FIGS. 8A-8B. When the air pressure at inlet 3130, and therefore the pressure in a bladder, such as those described or otherwise disclosed herein, reaches a predetermined pressure, thin flap 3118 is deformed and lifted off of a first surface 3117 of base 3106. However, the application of pressure to a crown 3108*a* of umbrella valve 3108 will press flap 3118 of umbrella valve 3108 more firmly against first surface 3117 of base 3106. As such, the pressure at an inlet 3130 must be greater in order to lift flap 3118 to release umbrella valve 3108.

To adjust the resistance of umbrella valve 3108, pressure disk 3107 is turned. Posts 3107*a* engage tracks 3145*a* and 3145*b* and move pressure disk 3107 toward and away from base 3106. As pressure disk 3107 is turned in a first direction along the incline in tracks 3145*a* and 3145*b*, pressure disk moves towards base 3106 and presses against springs 3122*a*. Cam 3147 contacts and applies pressure to lever 3179, which in turn applies pressure to crown 3108*a* of umbrella valve 3108. Turning pressure disk 3107 in an opposite direction moves pressure disk 3107 in a direction away from base 3106 and the natural state of springs 3122*a* lifts cam 3147 off of lever 3179, releasing the pressure on crown 3108*a* of umbrella valve 3108. Cam 3147 isolates the turning motion of pressure disk 3107 from umbrella valve 3108. Pressure disk 3107 moves freely with respect to cam 3147. Thus, in turning pressure disk 3107, umbrella valve 3108 will not twist or turn so as to be unseated, prematurely releasing the seal formed with base 3106.

Further, a stop 3141 protrudes from a second surface 3117*a* of base 3106. Stop 3141 engages a series of divots 3149 on an exterior surface 3107*c* of pressure disk 3107. As pressure disk 3107 turns, stop 3141 holds pressure disk 3107 at a variety of positions along tracks 3145*a* and 3145*b*, thus holding the resistance of umbrella valve 3108, such that it will release at various particular predetermined pressures.

FIG. 32A illustrates an adjustable check valve 3201. Adjustable check valve 3201 includes a base 3206 and a cap 3210 which form a housing enclosing an umbrella valve 3208 (shown in cross-section in FIG. 32C). Adjustable check valve 3201 also includes a sliding switch 3207, which slides along a track 3245 formed in cap 3210. Sliding switch 3207 is used to increase or decrease the resistance of umbrella valve 3208, i.e., the predetermined pressure at inlet 3230 at which a seal formed between umbrella valve 3208 and base 3206 is released. FIG. 32B shows an above plan view of adjustable check valve 3201. FIGS. 32C and 32D are cross-sections of adjustable check valve 3201 taken along lines C-C and D-D of FIG. 32B, respectively.

Umbrella valve 3208, as illustrated in FIG. 32C functions similarly to that of umbrella valve 2808, as described above with respect to FIGS. 28A-28B, in that pressure to a crown 3208*a* of umbrella valve 3208 will press flap 3218 of umbrella valve 3208 more firmly against base 3206. As such, the predetermined pressure at an inlet 3230 required to lift flap 3218 and to release the seal formed by umbrella valve 3208 and base 3206 must be higher than when the pressure is reduce or removed. Adjustable check valve 3201 includes an arm 3213 extending from base 3206. Arm 3213 is coupled to a lever 3279, which contacts crown 3208*a*. Sliding switch 3207 also includes a cam 3247 and a guide 3235, which extend from a underside 3207*a* of sliding switch 3207. Guide 3235 is driven along track 3245 moving cam 3247 into contact with and along the length of lever 3279. FIG. 32C illustrates sliding switch 3207 in a first position. As it moves along track 3245, cam 3247 applies increasing pressure on lever 3279, which in turn applies increasing pressure onto crown 3208*a* of umbrella valve 3208. The farther along track 3245 that sliding switch 3207 moves, the greater the pressure transmitted to umbrella valve 3208 from lever 3279.

FIG. 32F shows two stops 3241*a*/3241*b*, which also extend from underside 3207*a* of sliding switch 3207. As sliding switch 3207 moves along track 3245, stops 3241*a*/3241*b* engage a series of divots 3249 formed in an exterior surface 3210*a* of cap 3210. Stops 2741*a*/2741*b* and divots 2749 hold sliding switch 3207 in place at various locations along the length of lever 3279, which in turn holds the predetermined pressure at which flap 3218 of umbrella valve 4708 lifts at a particular pressure. FIG. 32E is an above exploded view of the base 3206, cap 3210 (including track 3245 and divots 3249) and sliding switch 3207. FIG. 32F is a below exploded view of base 3206, cap 3210 and sliding switch 3207 (including guide 3235, cam 3247, and stops 3241*a*/3241*b*.

Another embodiment of a combination adjustable check valve and release valve (not shown), such as those described or otherwise disclosed herein, may be formed with a sliding switch, such as that described above with respect to FIGS. 32A-32F, and any of the release valves described or otherwise disclosed herein.

FIGS. 33A and 33B illustrate an example of a satellite underfoot inflation mechanism 3308. Inflation mechanism 3308 may be an injection molded thermoplastic polyurethane (TPU), for example hardness 40-50 shore D. Alternatively, inflation mechanism 3308 may be blow molded, thermoformed or manufactured by another method for forming plastic parts. Inflation mechanism 3308 includes a first sheet 3308*a* and a second sheet 3308*b*, each having a flat margin portion 3308*a*'/3308*b*' and a relief portion 3308*a*"/3308*b*". Margin portions 3308*a*'/3308*b*' are sealed together via gluing, bonding, RF welding, heat welding, ultrasonic welding, or another other method known to one skilled in the art. Alternatively, inflation mechanism 3308 may be formed in one piece. Relief portions 3308*a*"/3308b" form a compartment 3360.

Inflation mechanism 3308 includes a first chamber 3371 for an intake valve (not shown) and an inlet 3371*a*. The intake valve flow back is a one way valve allowing air to flow into inflation mechanism 3308, but flow back through the same inlet 3371*a*. Inflation mechanism 3308 also includes a second chamber 3320 for an inflation valve (not shown) and an outlet 3320*a*. The inflation valve is also a one way valve allowing air to flow from inflation mechanism 3308 into a bladder, but not flow back into inflation mechanism 3308. The intake valve and the inflation valve may be any of the one-way valves described or otherwise disclosed herein, and may be molded along with first sheet 3308*a* or subsequently installed. Inflation mechanism also includes a cover 3363 to seal first and second chambers 3371 and 3320 when one or both of intake valve and inflation valve are subsequently installed.

Satellite inflation mechanism 3308 is not formed coextensively with a bladder. As such, it may replace any of the underfoot inflation mechanisms described or otherwise disclosed above that are formed as a monolithic structure with a bladder. As a heel strikes compartment 3360, relief portions 3308*a*"/3308b" collapse forcing air from inflation mechanism 3308 into a inflatable article, such as any of the inflatable bladders described or otherwise disclosed herein. The inflatable article may be subsequently connected to outlet 3320*a* via a portion of the inflatable article, tubing, a barb fit, a combination thereof or another fluid tight connecting system. As the foot lifts off of compartment 3360, negative pressure in compartment 3360 causes intake valve to open and draw air into inflation mechanism 3308. As air enters inflation mechanism 3308, compartment 3360 expands. Compartment 3360 may also include a foam core (not shown), such as that described above in FIG. 5, to aid in the expansion of compartment 3360 once the pressure of the wearer's foot is removed.

FIGS. 34A-34I illustrate yet another embodiment of a shoe 3400 including a sole 3420 and an upper 3410 at least partially formed by a bladder 3430 of the present invention. Bladder 3430 does not cover a entire upper 3410. Instead, bladder 3430 includes cut out portions 3484. Padding materials, such as fabric, foam, silicone, or other padding materials known to those skilled in the art are provided at cut out portions 3484 to provide extra comfort for a wearer. Further, instead of sewing a first portion 3489 of bladder 3430 to a second portion 3490 of bladder, so that it surrounds the foot and forms an opening 3412 therein, first portion 3489 and second portion 3490 are separated by a stretchable upper material 3499, such as lycra or other elastic materials, to aid in the entrance and removal of a wearer's foot into opening 3412.

Laces or another closure system may be incorporated into any shoe design of the present invention. For example, FIGS. 35A-35C illustrate yet another embodiment of a shoe 3500 including a sole 3520 and an upper 3510 at least partially formed by a bladder 3530 of the present invention. Bladder 3530 does not cover a entire upper 3510. Instead, bladder 3530 includes cut out portions 3584 with breathable mesh material sewn therein. Shoe 3500 also includes eyelets 3592 formed in a periphery weld line 3590 of bladder 3530 through which a lace 3594 is laced.

While the invention has been particularly shown and described with reference to preferred embodiments thereof, it will be understood by those skilled in the art that they have been presented by way of example only, and not limitation, and various changes in form and details can be made therein without departing from the spirit and scope of the invention.

Thus, the breadth and scope of the present invention should not be limited by any of the above-described exemplary embodiments, but should be defined only in accordance with the following claims and their equivalents. Additionally, all references cited herein, including issued U.S. patents, or any other references, are each entirely incorporated by reference herein, including all data, tables, figures, and text presented in the cited references.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. An article of footwear, comprising:

a sole;

an upper attached to said sole, including an opening therein for inserting a user's foot, wherein at least a portion of said upper is formed from an inflatable bladder, said inflatable bladder includes a vamp portion positioned across a vamp area of said article of footwear, and a second portion substantially disposed on one of the lateral and medial sides of said article of footwear, wherein, between said vamp portion and said second portion of said inflatable bladder, said inflatable bladder includes a heel portion which extends around a heel area of said article of footwear; and an inflation mechanism fluidly connected to said second portion of said inflatable bladder, wherein said inflation mechanism and said inflatable bladder are monolithic.

2. The article of footwear of claim 1, wherein said article of footwear further comprises a deflation mechanism fluidly connected to said inflatable bladder.

3. The article of footwear of claim 2, wherein said deflation mechanism is a combination check valve and release valve.

4. The article of footwear of claim 2, wherein said deflation mechanism includes a release valve capable of remaining in an open position.

5. The article of footwear of claim 2, wherein said deflation mechanism includes an adjustable check valve.

6. The article of footwear of claim 1, wherein an air entry to said inflation mechanism is covered by a material that is permeable to air but not to moisture.

7. The article of footwear of claim 1, wherein said inflation mechanism is a satellite inflation mechanism fluidly connected to said inflatable bladder.

8. The article of footwear of claim 1, wherein said inflation mechanism is positioned so as to be operated by the downward pressure of a wearer's foot.

9. An article of footwear comprising:

a sole;

an upper attached to said sole, wherein said upper includes an inflatable bladder extending across at least a vamp area of said article of footwear from a medial side to a lateral side of said article of footwear; and an inflation mechanism fluidly connected to said inflatable bladder, wherein said inflation mechanism is disposed in a location which allows operation of said inflation mechanism by downward pressure of a wearer's foot;

wherein said inflatable bladder constricts around the wearer's foot when said inflatable bladder is inflated to maintain said article of footwear on the wearer's foot and wherein said article of footwear is laceless.

10. The article of footwear of claim 9, wherein air is directed into said inflation mechanism from a location outside of said article of footwear.

11. The article of footwear of claim 9, wherein said inflatable bladder further comprises a heel compartment and wherein said inflation mechanism is disposed in said heel compartment of said inflatable bladder.

12. The article of footwear of claim 9, wherein said inflatable bladder comprises at least one sheet of polyester and polyurethane composite film.

13. The article of footwear of claim 9, wherein said inflatable bladder comprises at least one polyester film, wherein said polyester film is a metallized polyester film.

14. The article of footwear of claim 9, wherein said inflatable bladder comprises at least one sheet that is a laminate of a urethane film and another material.

15. The article of footwear of claim 9, wherein said sole further comprises at least one of a midsole and sockliner.

16. The article of footwear of claim 9, further comprising a deflation mechanism.

17. An article of footwear, comprising:

a sole;

an upper attached to said sole, wherein said upper includes an inflatable bladder that substantially surrounds an opening in said upper for receiving a wearer's foot; and an inflation mechanism fluidly connected to said bladder and located within said article of footwear beneath the wearer's foot;

wherein, when said bladder is inflated, said inflatable bladder constricts around the wearer's foot at said opening in said upper to maintain said article of footwear on the wearer's foot and wherein said article of footwear does not have a closure system.

18. The article of footwear of claim 17, wherein said inflatable bladder further comprises a heel compartment and said inflation mechanism is disposed in said heel compartment of said inflatable bladder.

19. The article of footwear of claim 17, wherein said inflatable bladder further comprises a forefoot compartment and said inflation mechanism is disposed in said forefoot compartment of said inflatable bladder.

* * * * *